US010463113B2

(12) United States Patent
Manz et al.

(10) Patent No.: US 10,463,113 B2
(45) Date of Patent: Nov. 5, 2019

(54) METHOD FOR PATCH PLACEMENT AND ARTICLES PRODUCED

(71) Applicant: adidas AG, Herzogenaurach (DE)

(72) Inventors: Gerd Rainer Manz, Oberreichenbach (DE); Jan Hill, Großenseebach (DE); Clemens Paul Dyckmans, Erlangen (DE); Paul Leonard Michael Smith, Nürnberg (DE); Zachary Clinton Coonrod, Nürnberg (DE); Stuart David Reinhardt, Nürnberg (DE); Thomas Hoewelmann, Reutlingen (DE); Peter Aul, Stuttgart (DE); Stefan Kallfass, Reutlingen (DE); Thomas Betzitza, Tübingen (DE); Jan Keller, Ulm (DE); Martin Steyer, Kusterdingen (DE)

(73) Assignee: adidas AG, Herzogenaurach (DE)

( * ) Notice: Subject to any disclaimer, the term of this patent is extended or adjusted under 35 U.S.C. 154(b) by 61 days.

(21) Appl. No.: 15/374,860

(22) Filed: Dec. 9, 2016

(65) Prior Publication Data

US 2017/0188664 A1 Jul. 6, 2017

(30) Foreign Application Priority Data

Dec. 10, 2015 (DE) ..... 10 2015 224 885

(51) Int. Cl.
*A43D 86/00* (2006.01)
*A43D 25/07* (2006.01)
(Continued)

(52) U.S. Cl.
CPC ..... *A43D 86/00* (2013.01); *A43D 8/02* (2013.01); *A43D 25/07* (2013.01);
(Continued)

(58) Field of Classification Search
CPC ..... A43D 2200/10; A43D 2200/20; A43D 2200/60; A43D 25/07
See application file for complete search history.

(56) References Cited

U.S. PATENT DOCUMENTS 3,246,352 A * 4/1966 Fladeland ..... A43D 27/00 12/1 A
8,578,632 B2 * 11/2013 Bell ..... A43B 1/0072 36/88

(Continued)

FOREIGN PATENT DOCUMENTS

DE 102013221018 A1 4/2015
EP 2274994 A1 1/2011

(Continued)

OTHER PUBLICATIONS

Extended European Search Report issued in European Application No. 16202873.2 dated Apr. 20, 2017, 5 pages.

*Primary Examiner* — Ted Kavanaugh
(74) *Attorney, Agent, or Firm* — Sterne, Kessler, Goldstein & Fox P.L.L.C.

(57) ABSTRACT

The present invention refers to a method for the manufacture of sporting goods, in particular shoes, comprising the steps of providing a plurality of components in one of a plurality of predefined shapes, and placing the plurality of components onto a two-dimensional or three-dimensional carrier surface to create the sporting good or a part thereof.

15 Claims, 80 Drawing Sheets

(51) Int. Cl.
*A43D 111/00* (2006.01)
*A43D 8/02* (2006.01)

(52) U.S. Cl.
CPC ..... *A43D 111/003* (2013.01); *A43D 2200/10* (2013.01); *A43D 2200/60* (2013.01)

(56) References Cited

U.S. PATENT DOCUMENTS

2004/0172855 A1* 9/2004 Aslanides ..... A43B 1/0027 36/136
2006/0034548 A1* 2/2006 Pishdadian ..... A43D 1/025 382/312
2008/0250668 A1* 10/2008 Marvin ..... A43B 9/12 36/54
2010/0077634 A1* 4/2010 Bell ..... A41D 27/24 36/54
2012/0186102 A1* 7/2012 Lee ..... A43B 1/0027 36/45
2013/0125319 A1* 5/2013 Regan ..... A43D 11/00 12/142 R
2014/0081441 A1* 3/2014 Regan ..... G05B 19/4093 700/98
2014/0237738 A1* 8/2014 Johnson ..... A43D 25/07 12/107 R
2014/0239556 A1 8/2014 Fisher et al.
2015/0101134 A1* 4/2015 Manz ..... A43D 119/00 12/142 R
2015/0201711 A1 7/2015 Jurkovic et al.
2015/0342291 A1 12/2015 Mariacher
2015/0342296 A1* 12/2015 Skaja ..... A43B 9/12 36/83
2016/0135543 A1* 5/2016 Anceresi ..... A43B 3/0078 36/45

FOREIGN PATENT DOCUMENTS

EP 2 625 979 A1 8/2013
JP 2002-65312 A 3/2002

* cited by examiner

- The coordinate system is set by adidas for every single layer (base and patches)
- The zero point is center of the boundary box and center of the gripping point
- X-axis is defined as tape feeding direction
- Coordinate system is the same in 3D (directly draped from 2D to 3D)

METHOD FOR PATCH PLACEMENT AND ARTICLES PRODUCED

CROSS-REFERENCE TO RELATED APPLICATIONS

This application claims priority to German application 10 2015 224 882.2, filed Dec. 10, 2015, which is incorporated herein in its entirety by reference thereto.

1. TECHNICAL FIELD

The present invention relates to a method and apparatus for the manufacture of sporting goods, in particular shoes, as well as sporting goods, in particular a shoe or a part thereof, manufactured by such a method.

2. BACKGROUND

Each year the manufacture and sale of sporting goods leads to a significant number of new product designs and product properties. For a manufacturer it is essential to quickly follow the latest developments on the market and/or to present a number of innovative products himself. Sporting goods in this context are for example shoes, textiles and accessories in a plurality of models, designs, production options, colors, sizes etc. Currently, most of the new products are in a first step digitally designed, modeled and tested using three-dimensional computer-aided design and/or finite element analysis systems ("3D CAD"/"FEA").

However, in order to bring a new product on the market, a prototype at first has to be manually made from the digital design. This is typically done in factories which may be located at a different place than the development department which is responsible for the product design. Only after shipment and receipt of the real samples are the product designers able to further optimize their digital designs and return them to the factories, in turn. This process is repeated until the samples have the desired functionality, appearance, cost and quality and can then be released for serial production in the factories. As a result, it often takes several weeks to months or even years until a result is reached.

Moreover, the entire development chain is very inflexible. Thus, the manufacturer can only slowly react to short-lived, fashion market trends and demands. The advantage regarding speed gained by the use of CAD/FEA systems for development is at least partly lost by the overall slow production processes on the part of the factories all over the world.

A manufacturing process which addresses this overall problem is schematically shown in FIG. 1. As can be seen, the known process starts with the unwinding of a composite tape on a roll, which is then cut into individual strips on a conveyor belt (step 1). The strips are then picked up by a robot equipped with a gripping device (step 2). A meltable layer of each strip is then activated by heat to provide adhesion (step 3), and the strip is placed onto a two-dimensional or three-dimensional carrier surface (steps 4*a* and 4*b*). Processing a plurality of strips in this manner allows for the assembly of a complex product including such strips in a layered manner. While the existing process improves the manufacturing efficiency and flexibility to some extent, the resulting products still have room for further improvements, since the plurality of strips typically have to be further processed in additional—possibly manual—manufacturing steps to achieve the desired product.

Further manufacturing techniques for creating products based on individual pieces of material and corresponding gripping devices are disclosed e.g., in U.S. Pat. No. 8,567,469 B2, US 2014/0134378 A1, U.S. Pat. Nos. 5,427,518, 8,371,838 B2, 7,182,118 B2 and US 2005/0061422 A1. However, also these approaches suffer from the drawback that the characteristics of the resulting products are very limited and that the manufacturing of complex products using these approaches requires significant additional, possibly manual, manufacturing steps.

Further background is disclosed in DE 10 2013 221 018 A1, US 2015/0 101 134 A1, US 2014/0237 738 A1 and US 2014/0 239 556 A1.

Taking the background as a basis, it is therefore the object of the present invention to provide improved manufacturing methods and production means that allow to promptly, at least partially automatically, and preferably locally manufacture a plurality of different prototypes, final products or the like from individual pieces of material (also referred to as "patches") in a particular flexile manner. In this context, it is another object of the invention to allow for quick and particularly flexible design and/or functional changes to the manufactured objects. Increasing the ability to alter designs of sporting goods on a short timeline will provide for more response capability with respect to the demands of the market and/or customer.

SUMMARY OF THE INVENTION

According to a first aspect of the present invention, this object is at least partially achieved by a method for the manufacture of sporting goods, in particular shoes. In one embodiment, the method comprises the steps of providing a plurality of components in one of a plurality of predefined shapes, and placing the plurality of components onto a two-dimensional or three-dimensional carrier surface to create the sporting good or a part thereof.

While preferred embodiments of the invention are in the following described in relation to sports shoes, the present invention is not limited to these embodiments. Rather, the present invention can also be advantageously used for other types of sporting goods, such as sportswear, e.g., shirts, pants, gloves, etc., as well as sports equipment, e.g., balls, bats, hockey sticks, and rackets.

Moreover, it is generally conceivable that embodiments of the method according to the invention are essentially fully automatic. However, a certain amount of manual support work may still be involved. In other words, embodiments of a method according to the invention can be carried out, at least predominantly, by robots, robotic systems or automated systems and/or the embodiments can still include a certain amount of human (support) work. The robots, robotic systems or automated systems can further be equipped with hardware and/or software specifically adapted to the respective tasks or they can be general-purpose machines.

Advantageously, the method of the invention allows the manufacturing of a sporting good or a part thereof in a particularly flexible manner. This is because the sporting good is, preferably essentially automatically, assembled from individual components in one of a plurality of predefined shapes. This enables the manufacturing of sporting goods which have any of a wide variety of characteristics due to the placement and shape of the used components, which is a considerable improvement over approaches which employ only simple strips of material in one predefined length. It should be noted that the two-dimensional or three-dimensional carrier surface onto which the components are placed to form the product can either form part of the final product (e.g., if the carrier surface is itself an element of the final product) or that the assembled components can be removed from the carrier surface (e.g., if the carrier surface is a tray, fabric, carrier, dissolvable base layer, or last).

In some instances, carrier surfaces may be constructed from materials having low thermal conductivity. It may be beneficial in some instances for materials used as carrier surfaces and/or surfaces on which consolidation occurs to have a thermal conductivity of less than about 25 Watts per meter per Kelvin (W*m−1*K−1). For example, in some embodiments it may be desirable to use a material having a thermal conductivity of less than about 1 Watt per meter per Kelvin (W*m−1*K−1). Further, in some instances surfaces used to transport materials on which consolidation may occur may have low thermal conductivities. For example, a glass plate may be used during consolidation of a two dimensional upper.

In some instances, it may be desirable to construct a carrier surface, a surface on which consolidation occurs, and/or a transportation device to have varying thermal conductivities in different areas of the surface on which the patches and/or components rest. This may allow for controlled application of heat to certain areas of patches and/or components.

Preferably, the plurality of components comprises at least one patch, i.e., a piece of material. Assembling a sporting good or part thereof from a plurality of patches allows one to provide a wide variety of desired characteristics to the sporting good, such as reinforcement, breathability, flexibility, grip and/or many more which will be explained further below. Additionally or alternatively, the plurality of components may comprise other elements such as a structural element (e.g., a heel counter, cage, support structure, tube or band), an outsole component (e.g., a stud, lug, outsole or outsole element), an eyelet reinforcement element, a midsole element, a closure mechanism (e.g., laces, a lacing structure or a hook and loop closure system), a bar code, a quality assurance code ("QC code"), an electrical component (e.g., a Near Field Communication (NFC) chip, a Radio Frequency Identification (RFID) chip, a motor, a chip set, an antenna, a microchip, an interface, a light source, a wire, a circuit, an energy harvesting element, a battery, etc.), a sensor (e.g., a pressure sensor such as a comfort pressure sensor, a strain sensor, an accelerometer, a magnetometer or a positioning sensor, such as a Global Positioning System (GPS) sensor), a mechanical component, or any combination thereof. As can be seen, the method of the invention allows in this aspect to manufacture very complex sporting goods in an efficient and flexible manner.

According to an aspect of the present invention, the step of providing the plurality of components comprises using a configurable cutting device to cut a plurality of patches. The cutting device may comprise at least one of a laser source, a knife, a cutting die, a water jet, a heat element, a solvent, ultrasonic device, or any combination thereof. Accordingly, the patches can be produced "on the fly" during the manufacturing process. In addition or alternatively, at least one of the patches might be provided in a pre-cut form.

For example, the configurable cutting device may comprise a laser source and means for controlling movement of a laser beam emitted by the laser source, wherein the means preferably comprises at least one mirror. Accordingly, this allows for a particularly accurate and precise cutting of patches, since the laser beam emitted from the preferably stationary laser can be efficiently guided by way of the mirror(s).

In addition, laser cutting may be used to impart patterns to the patches. For example, a laser may be used to engrave a pattern on the patch. In particular, sipes, lines, and/or various shapes may be engraved in the patch.

In another aspect of the present invention, the method comprises the further step of consolidating the plurality of components using heat and/or pressure for a predefined amount of time. Accordingly, after a plurality of patches and/or other components have been placed onto the carrier surface in the above-described method, a so-called "consolidation" can be performed by applying heat and/or pressure to the plurality of patches. This may involve two or more steps depending on the materials used. In one embodiment, a flexible membrane, such as a stretchable silicone skin, which may initially be mounted on a frame, is used to consolidate the patches and/or other components into an article, for example a shoe. By means of the consolidation step, the process of the invention can be performed without the use of a rigid overmold or a rigid female mold component.

Consolidation is preferably performed at a temperature in a range from 40° C. to 240° C. Further, some constructions may be consolidated at temperatures in a range from 55° C. to 200° C. In addition, there may be constructions where consolidation is performed at temperatures ranging from 100° C. to 180° C. Pressure during consolidation may be controlled such that pressure is in range from 0.1 bar to 10 bar above atmospheric pressure. In some instances, pressure during consolidation may be controlled in a range between 1.1 bar and 4 bar. Further, pressure during consolidation may be controlled in a range from about 1.5 bar to about 2 bar. For example, using particularly thin patches, for example, made of tape, less time and pressure may be applied, such as 180° C. at 1.5-2 bar for 60-90 seconds.

Pressure used to consolidate the patches and/or other components may be an overpressure applied to the flexible membrane. Thus, pressure may be applied to the flexible membrane which has been positioned over the patches and/or other components to be consolidated. In some cases, a negative pressure may be used to consolidate materials. For example, vacuum may be applied to the patches to position the flexible membrane over patches, as well as consolidate the patches.

As a result, the manufacturing process is significantly simplified while the obtained good at the same time has improved robustness due to the consolidation of the plurality of individual patches and/or other components. The consolidation step may be a fully automated step.

In some instances, a flexible member may be placed onto the plurality of patches. In one aspect, the at least one flexible member is substantially planar before being applied onto the plurality of patches of material. Such a substantially planar flexible member is particularly well-suited if the carrier surface is two-dimensional, such as a work top, table, or flat base material. It may, however, also be applied to the three-dimensional carrier surfaces.

In the alternative, the flexible member may be pre-formed to match, at least partially, the contour of the sporting good to be manufactured. This allows for a particularly good fit of flexible member, in particular if the patches have been placed on a three-dimensional carrier surface, such as a last for a shoe to be manufactured.

In any case, as already noted above, the flexible membrane may, for example, comprise silicone. Consolidation through use of a flexible membrane may include applying a pressure and/or heat to the flexible membrane.

The method may comprise the further step of withdrawing air from the plurality of patches of material with the flexible membrane applied thereon. For example, the carrier surface may be located on a working table equipped with holes through which a vacuum can be created from the bottom side of the good to be manufactured. Withdrawing air from the assembled patches before, during and/or after overlaying the flexible membrane advantageously improves the consolidation of these components.

Furthermore, heat may be applied to the plurality of patches of material with the flexible member applied thereon. For example, the aforementioned work top may be a hot table, such that the adhesive properties of the patches are increased and not only the patches are consolidated relative to each other. Heat may be applied before, during and/or after use of the flexible member to apply pressure to the patches. For example, heat may be applied to the plurality of patches prior to the application of pressure.

In some instances, heat may be provided to the patches through the flexible member. Thus, the flexible member may provide heat and pressure to consolidate the patches.

In a further aspect of the invention, the step of providing a plurality of components may comprise the steps of providing material from a spool, a belt, a tray, and/or a stack onto a transportation device, cutting the plurality of components out of the material using a cutting device, and removing excess material from the transportation device in an automated way. For example, materials may be processed by providing the material using a first spool, cutting the plurality of components out of the material using a cutting device, and removing excess material preferably by using a second spool. Such a "spool to spool" process which results in an automated removal of excess material after cutting can be fully or at least partly automated to provide considerable efficiency improvements.

In some aspects of the invention, at least one of the plurality of components and/or the carrier surface may comprise a coupling mechanism such that an electrostatic force, a chemical and/or a mechanical lock is formed between at least two of the plurality of components or a portion of the sporting good. For example, the coupling mechanism may comprise at least one of electrostatic forces, a hot melt adhesive, a solvent based process, a hook loop fastener, or any combination thereof.

In yet another aspect, the method comprises the step of activating at least one of the components, preferably by heating, to obtain a robust composition of patches and/or other components. The activation step may be performed before the respective at least one patch/component is placed on the carrier surface, and/or after a plurality of patches/components have been placed on the carrier surface. To this end, the adhesive component preferably comprises a hot melt adhesive.

In one embodiment, the step of placing the plurality of patches of material onto the carrier surface is performed by an automated gripping device, which allows for a significant automation of the process. The gripping device may comprise one or more grippers which can be arranged in a modular manner. Thus, it is possible to provide a gripping device in a flexible manner which is able to process any sort of patches, regardless of their composition or shape.

As mentioned further above, the two-dimensional carrier surface may comprise a work top (from which the good is removed after production) or a substantially flat base material, such as a knit material or a midsole (which becomes part of the manufactured good). Likewise, a three-dimensional carrier surface may comprise a work form, such as a last, or a base material carried on a work form.

The patch material used in embodiments of the invention may comprise a metal, a polymer, such as polyurethane, for example thermoplastic polyurethane, nylon, or other polymers known in the art, foam, such as expanded foams, particle foams, textile material, for example, a knit, non-woven, woven, or the like, hook and loop material, synthetic leather, coated material, transparent material, colored material, printed material, structured material, natural fiber, for example, silk, wool, hair such as camel hair, cashmere, mohair, or the like, cotton, flax, jute, kenaf, ramie, rattan, hemp, bamboo, sisal, coir, or the like, leather, suede, rubber, a woven structure, or any combination thereof.

In some embodiments, the carrier surface may comprise, or even consist of, a non-woven material and the component may comprise, or even consist of, a non-woven material. The component may be a patch. The non-woven material may be obtained by the technique of blown fibers whereby fibers are extruded and blown towards a supporting surface so as to stick together and form a thin layer of non-woven material.

In some embodiments, the carrier surface and the component may be made of the same material. The component may be a patch. The recycling of such product is thus made easier as it may comprise only one material. In some particular embodiments, the carrier surface may be a non-woven and the component may be a non-woven of the same material as the carrier surface.

The plurality of patches may be arranged in a manner to provide one or more characteristics to a given area of an article. Characteristics of interest for patch materials may include, but are not limited to reinforcement, breathability, durability, grip, flexibility, thermoplasticity, adhesiveness, traction, water resistance, waterproofing, electrical conductance, electrical resistance, or any combination thereof (see the examples in the detailed description further below).

Also, the method may comprise a step of providing at least one additional element to the plurality of patches, in particular at least one structural element such as a heel counter, cage, support structure, tube or band, at least one outsole component such as a stud, lug, outsole or outsole element, at least one eyelet reinforcement element, at least one midsole component, at least one closure mechanism, such as laces, lacing structures, hook and loop closures systems, or any combination thereof. As a result, the manufacture of a final complex sporting good can be to a large extent automated.

In some instances, a coating layer may be placed on the plurality of patches and/or components. Placement of the coating layer may occur before, after, and/or during the consolidation process. Coating layers for use on patched articles may include, but are not limited to films, foils, polymers, membranes, synthetic materials, natural materials and/or combinations thereof.

A coating layer may, in some instances, provide a relatively tight and glove-like fit to an article that has been produced in part or in whole from patches and/or other components. When the article is formed as a shoe, for example a soccer shoe, a coating layer may enhance feel, control and increase spin of a ball hit by the shoe resulting in greater curvature during flight of the ball. Typically, coating layers may provide functional properties to the article. For example, a coating layer may be used to impart wear, abrasion, or water resistance, control air and/or water permeability, reduce stretch, control other predetermined characteristics, or combinations thereof.

Using an image processing means, such as one or more cameras and corresponding image recognition software, at least one of the plurality of patches and/or components may be identified before being placed on the carrier surface, which allows for an automated identification and corresponding correct placement of the patch(es) and/or components.

It is furthermore conceivable that the method enables an, at least partially, automated "idea to product" process. To this end, the method may comprise the steps of receiving a design specification of the sporting good to be manufactured, in particular a computer-aided design (CAD) file, for example as a result of a purchase order, automatically generating a production plan based on the design specification, and performing the step of placing the plurality of components in accordance with the production plan. The production plan may be adjusted in a 2D version by comparing a reference carrier surface to the actual carrier surface and adjusting the position of the robot and the patches to be placed. Due to this adjustability, the carrier surface does not have to be placed having a specific orientation.

In a further aspect, the method of the invention may comprise identifying the carrier surface by an image processing means and providing positioning data to a controller to adjust placing of at least one of the plurality of components. A vision system may recognize the parts using contours of the parts. When the contour is distorted, feedback may be provided to a controller to adjust positioning of the components. Thus, multiple patches may be placed with high accuracy of placing the patches.

Automatically generating a production plan based on the design specification may further comprise generating a point cloud to position at least one of the plurality of components on the carrier surface. In particular, point clouds may be used to position the components on 3D lasts/uppers.

In a further aspect of the invention, any of the above methods may be performed in an apparatus provided for performing an embodiment of an inventive method. Within such an apparatus, a plurality of differently designed shoes or other sporting goods can be almost fully automatically manufactured, as already discussed above.

In particular, the method may be performed inside a movable container. It is particularly preferable that the container is at least partially transparent. This allows practicing the methods of the invention directly "on site", for example at sporting events or in a sales outlet, etc. A purchaser may then "put together" a desired shoe model directly at the site of the apparatus or even beforehand via the internet or the like, this model then being manufactured by the portable manufacturing device. If the container is partially transparent, the customer can even watch the shoes or goods being manufactured. In addition, the process could be captured by video and live broadcasted in digital media networks/channels.

A further aspect of the present invention involves a sporting good, in particular a shoe or part thereof, having been manufactured using an embodiment of a method according to the invention.

As already repeatedly mentioned, it is possible, in this respect, for each of the plurality of shoes manufactured to be individually customized and modified, for example based on a design of a development designer, a wearer's anatomy or even based on a customer's wishes, for example received over the internet.

In some embodiments, it is possible to utilize an analysis tool, including, but not limited to pressure plates, cameras with glass, pressure distribution of barefoot runner, insoles which measure pressure distribution, pressure paper such as carbon or ink-microcapsule based paper, 3D scans, strain maps (e.g., Aramis System data), gait analysis, movement analysis, sweat maps, molds of the foot, to determine the needs of an individual athlete. The output from one or more of these analysis tools may be used to develop designs individualized for the athlete. For example, customized outsoles, midsoles, uppers and/or combinations thereof may be developed using the data collected using analysis tools.

For athletes, zones in the outsole and/or midsole may be created which match the needs of the athlete, for example, functional properties such as for cushioning, abrasion resistance, traction or the like. For example, a forefoot runner may not need a full rubber outsole. By reducing the number of rubber elements the weight of the shoe may be reduced. At this point, it should again be explicitly pointed out that for embodiments of an inventive method, embodiments of an inventive apparatus and/or embodiments of an inventive shoe a plurality of design possibilities and embodiments disclosed herein can be combined with one another depending on the specific requirements. Individual options and design possibilities described herein can also be disregarded where they appear to be dispensable for the respective method, the respective apparatus or the shoe to be manufactured, with the resulting embodiments still being part of the invention.

According to a further aspect of the inventive idea of the present invention, a method of manufacturing sporting goods comprises: (a.) selecting a base layer; (b.) selecting a thin component comprising an at least partially meltable layer; (c.) applying at least a part of the thin component on at least part of the base layer so as to form an intermediate assembly, such that the meltable layer is at least partially in contact with the base layer; (d.) a first consolidation step during which pressure is applied to the intermediate assembly at a first temperature; and (e.) a second consolidation step during which pressure is applied to the intermediate assembly at a second temperature which is higher than the first temperature, wherein the second consolidation step is performed after the first consolidation step.

The component may be a component as described above and as described in more detail with reference to the exemplary embodiments.

The step of applying the thin component may be achieved by a step of placing a plurality of components onto a two-dimensional or three-dimensional carrier surface as described above and as will be described in more detail with reference to the exemplary embodiments.

The base layer may be a carrier surface as described above and as will be described in more detail with reference to the exemplary embodiments.

The method according to this further aspect of the inventive idea of the present invention overcomes the problems of the prior art in that it provides a very strong, stable and durable bond between the component and the base layer. The inventors have realized that the weak bonds of prior art methods are often due to small bubbles in the heat activated adhesive which cause on incomplete bonding, i.e., the effective contact area between the component and the base layer is reduced due to the bubbles. Furthermore, during mechanical stress, the bubbles may weaken the surrounding stiffened adhesive as they tend to relocate, thereby causing the adhesive to separate from the base layer.

The inventors have realized that surprisingly, the formation of bubbles in the meltable layer may substantially be reduced by applying the claimed consolidation method. According to this method, pressure is applied to the thin component at a first temperature. The pressure causes most, if not all, of the bubbles to move towards the edges of the thin component, where they finally disappear. As the first temperature is relatively low (compared to the second temperature), the meltable layer is not substantially softened or molten and does not adhere or adheres only weakly to the base layer, such that the bubbles may freely move between the thin component and the base layer. Surprisingly this also happens when the component has been weakly pre-consolidated, e.g., by application of heat to the meltable layer and then application of the component on the base layer, in a step previous to the claimed process. Thus, after the first consolidation step, the interface between the base layer and the thin component is essentially free of bubbles.

The second consolidation step according to this further aspect of the inventive idea of the present invention causes the meltable layer to soften or melt to some degree due to the higher second temperature. Thus, the meltable layer may form firm bonds with the base layer, independently on the surface texture of the base layer, thanks to the applied pressure.

Thus, the method according to this further aspect of the inventive idea of the present invention may effectively reduce the formation of bubbles during bonding a thin component to a base layer, resulting in a strong and durable bond. When the component is at least partially translucent, the aesthetic of the final assembly is also improved due to the absence of bubbles between the component and the underneath layer.

It should be noted that in the first consolidation step as well as in the second consolidation step, the adhesive layer may not completely melt according to the invention. It is sufficient if the meltable layer is softened. In this sense, the meltable layer is an "at least partially meltable layer".

Also, the meltable layer may cover only a portion of the surface of the thin component. It need not cover the entire surface of the thin component.

The thickness of the thin component may be smaller than its length and its width. A method according to this further aspect of the inventive idea of the present invention is particularly suitable for this type of components as the formation of bubbles is often observed when bonding thin components, such as patches, to a base layer. A method according to the invention is also suitable because thin components are often transparent and therefore need a clean, aesthetic bonding to the underneath layer.

In the first consolidation step the surface area of pressure application to the intermediate assembly may be progressively increased over time. Thus, bubbles are forced in the direction of the resulting pressure gradient towards an edge of the thin component. In this way, bubbles may be avoided or at least reduced even more reliably. In particular the largest bubbles are removed by such method. For example, the lines of equal pressure may progress over time over the component, and in some embodiments over the assembly. The lines of equal pressure may for example be circular in case a convex-shaped bladder is used to apply pressure.

In the first consolidation step the pressure may be applied first to a first portion of the intermediate assembly and then to a second portion of the intermediate assembly. Thus, bubbles may be forced from the first portion to the second portion and finally towards the edge of the thin component. In this way, bubbles may be avoided or at least reduced even more reliably. The pressure may in particular be applied first to a first portion and then to a second portion in a continuous manner, for example along linear lines of pressure by the use of cylindrical means to apply pressure such as a calendrer.

The first temperature may differ from room temperature by no more than 50° C. More specifically, the first temperature may differ from room temperature by no more than 20° C. In particular, the first temperature may differ from room temperature by no more than 10° C. The first temperature may be higher than room temperature. Thus, a complete softening or melting of the adhesive layer is avoided in the first consolidation step, such that it does not hinder the evacuation of air bubbles. Bubbles may easily move between the thin component and the base layer and are forced by the pressure to the edge of the thin component, where they finally disappear.

The pressure applied to the intermediate assembly may be maintained between the first consolidation step and the second consolidation step. This avoids or at least reduces the formation of new bubbles between the thin component and the base layer.

The first consolidation step and the second consolidation step may be performed on the same device. This avoids the need for additional devices and reduces manufacturing time as the additional effort to move the base layer with the thin component to a further device may be omitted.

Pressure may be applied by an inflatable bladder. An inflatable bladder helps to effectively "squeeze out" bubbles in the meltable layer. Furthermore, an inflatable bladder may adapt to varying heights of intermediate assemblies, such that a corresponding height adjustment may be omitted. In general, inflatable bladders are beneficial over other devices to apply pressure and heat (in particular rigid devices such as a rigid plate of a heat press) because the bladder applies uniformly a pressure to the intermediate assembly even when the assembly is not flat. For example, when there is a stack of e.g., three patches beside a single patch, the stacked patches would get a high pressure with the rigid plate compared to the single patch, but would get about the same pressure as the single patch when using a bladder.

At least one contact layer may be applied to the intermediate assembly during the first consolidation step. Alternatively, or in addition, at least one contact layer may be applied to the intermediate assembly during the second consolidation step.

The contact layer may be placed between the intermediate assembly and the inflatable bladder, and pressure may be applied by the inflatable bladder to the contact layer. Thus, the contact layer is clamped between the bladder and the assembly to transfer the pressure of the inflatable bladder to the intermediate assembly.

The contact layer may avoid sticking of the thin component to the bladder. Furthermore, it may protect the bladder from damages such as hot-melt spill and thereby improves its life duration. Finally, the contact layer may be quickly changed if it is damaged, for example, if some material (e.g., polymeric material) from components accumulates on the surface after a series of consolidation steps according to the invention, thereby improving the manufacturing efficiency of a method according to the invention.

The contact layer may be held in contact with the intermediate assembly during and between the first and the second consolidation step. This may be in particular advantageous in combination with maintained pressure to avoid the formation of new bubbles in the meltable layer.

The contact layer may be at the first temperature when first placed in contact with the intermediate assembly during the first consolidation step, and may be heated up afterwards to the second temperature during the second consolidation step. Thus, the contact layer may provide the meltable layer with the correct temperatures to achieve the described advantages of the method according to the invention. Such method also improves the manufacturing efficiency in that there is no need to vary the temperature of the heating device, such as a heating bladder, in order to perform the two steps on the same device. Since the contact layer is at a first low temperature when it comes into contact with the intermediate assembly, and before it warms up under the effect of a heating device, the first step of manufacturing according to the invention is performed. When the contact layer finally heats up under the effect of the heating device, the second step is performed, without removal of the contact layer, and therefore potentially without the removal of the pressure between the first step and the second step. Besides, it also allows having one single element, such as a heating bladder, to perform both the function of applying pressure and of heating, without changes in the heat setting of this single element.

The contact layer may be a silicone layer. Silicone is a nonstick material, such that sticking of the contact layer to the intermediate assembly is avoided. Furthermore, silicone is also flexible and may adapt to the shape and surface structure of the intermediate assembly to further avoid or reduce bubbles in the meltable layer.

The contact layer may be antistatic. Thereby the attraction between the intermediate assembly and the contact layer is reduced, such that the intermediate assembly (or pre-consolidated assembly) is not displaced when static charges build on the contact layer and the contact layer is approached to the intermediate assembly. For example, the contact layer may comprise a metallic charge; the contact layer may be a silicone layer comprising a metallic powder. Alternatively or in combination, the apparatus according to the invention may comprise a static charge removal device adapted to discharge the electric charges that built up on the contact layer.

The bladder may be configured to be heated up. For example, the bladder may be heated up by at least one embedded heating wire. This allows to transfer heat to the intermediate assembly in a rather direct way without much dissipation of heat.

The method may further comprise a third consolidation step during which pressure and heat at a third temperature, higher than the second temperature, are applied to the intermediate assembly, wherein the third consolidation step is performed after the second consolidation step. Thus, in the third consolidation step, the meltable layer may be finally softened or molten to such an extent that it finally firmly adheres to the base layer. Thanks to the two previous consolidation steps, the amount of bubbles in the meltable layer is reduced to a minimum, such that the bond between the thin component and the base layer is very strong. Indeed the first consolidation step ensures the removal of air bubbles, the second consolidation step ensures a good sealing of the component on the base layer to avoid any reappearance of bubbles, then the third consolidation step ensures the firm bonding of the thin component to the base layer.

At least one contact layer may be applied to the intermediate assembly during the third consolidation step, and the pressure, third temperature and duration of the third consolidation step may be adapted so that a surface texturing of the thin component is modified by application of the contact layer. Thus, the thin component may be provided with a certain surface texturing, for example a texturing providing grip or specific visual effect. The texturing may in particular be provided by a corresponding texturing of the surface of the contact layer that comes in contact with the thin component.

The thin component may comprise a variety of materials such as synthetic or natural polymers, leather, textile, carbon fibers, glass fibers, etc.

The thin component may comprise a polymeric component. In particular, the thin component may comprise or be made of a thin layer of polymer. More particularly, the thin component may comprise or be made of a thin layer of thermoplastic polymer. Polymer is often the base material of components applied to sporting goods. However, such polymer materials do not always easily bond to e.g., textile base layers. Thus, the present invention provides an improved method of firmly bonding such polymer components to a base layer in particular to textile base layer such as knit.

The thin component may be temporarily fixed to the base layer before the first consolidation step. In particular, the meltable layer may be exposed to a certain temperature in order to temporarily fix the component to the base layer before the first and second consolidation steps are performed. It is also possible to temporarily fix the component by sewing (e.g., with a dissolvable yarn), welding (e.g., ultrasonic welding), and the like. Such prior step allows for example to place a component on the base layer and avoid it to move relatively to the base layer when the base layer and the component are brought to the consolidation station. In the same way, such prior step also allows to place a plurality of thin components on the base layer, without any risk of the components to move relatively to each other or to the base layer while other thin components are placed on the base layer or during a subsequent transfer to another manufacturing station, such as a consolidation station.

The thin component may have such a shape that at least a portion of the surface of the base layer is not covered by the thin component. Thus, the thin component may be applied to a targeted location of the base layer. For example, a heel counter may be attached to a heel portion of an upper.

In some embodiments, the thin component has a surface at least 2 times smaller than the surface of the shoe upper. More particularly the thin component has a surface at least 10 times smaller than the surface of the shoe upper.

The intermediate assembly may comprise at least two thin components, each component comprising at least an overlap portion with each other. Thus, the thin components may not only bond to the base layer, but also to each other.

In some embodiments, the intermediate assembly may comprise at least two thin components, one of the thin components being entirely on top of one or more other thin components. Such thin component would then not be in direct contact with the base layer.

In some embodiments, at least one first thin component comprising a meltable layer on a first face opposite a second face of the first thin component may be placed on the base layer with its second face in contact with the base layer. Thereby the first face of the first thin component is placed on the outward surface of the intermediate assembly. An additional step may comprise to place a second thin component at least partially overlapping the meltable layer of the first thin component. Such embodiments allow a better bonding between the first thin component and second thin component. In some embodiments at least a portion of a meltable layer of the second thin component may be placed in contact with at least a portion of the outwardly oriented meltable layer of the first component.

In some embodiments, an intermediate component may be at least partially placed between the thin component and the base layer. The thin component may ensure attachment of the intermediate component to the base layer.

Such intermediate component may have different functions such as padding, reinforcement, waterproofing, moisture absorption, manufacturing purpose, etc. Therefore the intermediate component may be of different natures such as foam, plastic film, non-woven, silicone, etc.

In some embodiments, the intermediate component may be at least partially placed between the thin component and the base layer before the second consolidation step. In some embodiments the intermediate component may be at least partially placed between the thin component and the base layer before the first consolidation step. In some embodiments the intermediate component may be placed on the base layer before applying at least a part of the thin component on at least part of the base layer so as to form an intermediate assembly.

In some embodiments, the melting layer of the thin component may be applied to at least a portion of the intermediate component and at least a portion of the base layer so as to be bonded to both the intermediate component and the base layer after the consolidation steps. In other embodiments, the melting layer of the thin component may be arranged so as to be applied around the intermediate component without being applied to the intermediate component. Alternatively, the consolidation steps according to the invention may be performed only to predetermined areas of the thin component. Thereby the intermediate component may be enclosed between the base layer and the thin component. For example the thin component and the base layer may form, after the consolidation steps, a pocket in which an intermediate component may be inserted and extracted by a user. As another example the intermediate component may be encapsulated between the base layer and the thin component such that it cannot escape or move in the pocket thus formed.

In some embodiments, a method according to this further aspect of the inventive idea of the present invention may comprise a step of removing the intermediate component. A thin component comprising a melting layer may be placed on the base layer, with an intermediate component placed between a portion of the thin component and the base layer. Subsequent steps of consolidation according to the invention allow bonding between the portion of the thin component directly in contact with the base layer and the base layer. The remaining portion of the thin component is thus bonded to the intermediate component. If the intermediate component is then being removed, a portion of the thin component is not bonded to the base layer, thus creating a pocket-like structure between the base layer and the thin component.

In particular an intermediate component with a very low adhesion when coupled to the melting layer of the thin component may be chosen such as a component with a silicone layer for example. Such intermediate component facilitates detaching the thin component from the intermediate component after the consolidation steps. The intermediate component therefore acts as a mask avoiding the bonding of the thin component and the base layer in a portion of the surface of the thin component. Thereby a sporting goods may be created in which a thin component is attached to the base layer by one portion, but another portion of the thin component is not bonded to the base layer. Such thin component may for example be used as a lateral reinforcement and eyelet, the portion housing the eyelet being not bonded to the base layer.

The intermediate assembly may comprise at least a first thin component at least partially in contact with a first face of the base layer, and at least a second thin component at least partially in contact with a second face of the base layer. The second surface of the base layer is opposite the first face of the base layer. In such embodiments of the invention, thin components may be placed and then consolidated on each face of the base layer. For example, non-aesthetic components may be placed on a face that is not seen on the final product, while aesthetic components may be placed on a visible portion of the final product. Nonetheless, thin components placed on the first face and on the second face of the base layer are consolidated simultaneously, thereby limiting the number of steps in a method according to the invention.

The base layer may be a textile. Textiles are often used for the manufacture of sporting goods. For example, shoe uppers are often made from woven fabrics or knit. Thus, the base layer may be a knit textile. The method according to the invention is particularly suited for applying a thin component to such kinds of textiles.

The duration of the first consolidation step may be comprised between 1 second and 100 seconds, in particular at least 5 seconds, for example about 15 seconds.

The duration of the second consolidation step may be comprised between 9 seconds and 300 seconds, in particular about at least 60 seconds, for example about 160 seconds.

According to this further aspect of the inventive idea of the present invention, the duration of a consolidation step may be set and same for every sporting good manufactured. Alternatively, the duration and/or temperature applied during any consolidation step may be varied to each component based on a temperature measurement. Such temperature measurement may happen before the first step is performed on the intermediate assembly, or may be measured during one or more, in particular during each, of the consolidation steps. The temperatures may be measured in many different ways such as laser thermometer, embedded sensor(s) in the supporting surface, etc. Also the duration and/or temperature applied during any consolidation step may be varied depending on the thickness of and/or number of thin components on the intermediate assembly. Duration and/or temperature may also be varied depending on the material of the base layer or of the thin components applied to the base layer. The duration and/or temperature to be applied may be calculated based on the criteria selected (e.g., temperature, thickness, material, etc.) and/or may be selected based on the value(s) of the criteria (criterion) based on a table associating intervals of values for the criteria (criterion) to a duration and a temperature.

A further aspect of the inventive idea of the present invention relates to a sporting good manufactured according to a method as described herein. Thus, the sporting good comprises a thin component applied to a base layer, wherein the bond between the thin component and the base layer is advantageously very strong and durable.

A further aspect of the inventive idea of the present invention relates to an apparatus for manufacturing sporting goods, comprising: (a.) a supporting surface on which a component may be placed; (b.) a contact layer; (c.) a bladder adapted to be at least partially displaced toward the supporting surface and to be heated at a higher temperature than a temperature of the supporting surface, wherein (d.) the contact layer is movable in a first position in which the contact layer is arranged between the supporting surface and the bladder so that the bladder may transmit heat to the contact layer and may bring the contact layer in contact with the component on the supporting surface; and (e.) a cooling device adapted to cool down the contact layer.

The contact layer may cool down by passive heat conduction, heat convection or by active means. An example of passive cooling may be displacing the contact layer to a position where it cools down in contact with ambient atmosphere by passive convection. An example of active cooling may be to place the contact layer in contact with a refrigerated surface, and/or to circulate a refrigerating fluid in canals of the contact layer and/or active convection (ambient air flow).

The cooling device may be adapted to cool down the contact layer in between two subsequent steps of being placed in the said first position. Thus, the contact layer is sufficiently cool before it is brought into contact either with the same component (e.g., at a different location) or with a new component.

The cooling device may be adapted to place the contact layer in an area where it may cool down. In particular, the contact layer may cool down from a temperature applied by a hot bladder. The contact layer may cool down to room temperature. Cooling down may allow to use the contact layer for a further pre-consolidation step on an intermediate assembly.

The contact layer may be mounted on a belt so as to be displaced. Such an arrangement on a belt is mechanically rather simple as the contact layer may be displaced by simple rotational movement rolls.

In one embodiment, the apparatus comprises a second contact layer, and the first contact layer and the second contact layer may be movable between a first position in which the first contact, but not the second contact layer is arranged between the supporting surface and the bladder and a second position in which the second contact layer, but not the first contact layer is arranged between the supporting surface and the bladder.

This arrangement has the advantage that the first contact layer may be used to consolidate or pre-consolidate a first intermediate assembly, and the second contact layer may subsequently be used to consolidate or pre-consolidate a second intermediate assembly while the first contact layer cools down. The second layer would also cool down while the first layer is used to consolidate or pre-consolidate an intermediate assembly. Thus, at least one contact layer is cooling down while another one is used to consolidate or pre-consolidate an intermediate assemble, such that process time is reduced and more intermediate assemblies may be consolidated or pre-consolidated per time unit.

The second contact layer may be placed in an area where it may cool down when in the first position. In particular, the second contact layer may cool down from a pre-consolidation temperature or a consolidation temperature applied by a heating device such as a hot bladder. The second contact layer may cool down to room temperature. Cooling down may allow to use the second layer for another pre-consolidation step with another base layer and thin component. Thereby, a method according to this further aspect of the inventive idea of the present invention may be performed in which pressure is applied first to the intermediate assembly at a temperature similar to room temperature by the contact layer, and pressure is then applied at a higher temperature by the rising temperature of the contact layer.

The first contact layer may be placed in an area where it may cool down when in the second position. In particular, the first contact layer may cool down from a temperature applied by a hot bladder. The first contact layer may cool down to room temperature. Cooling down may allow to use the first layer for a further pre-consolidation step on an intermediate assembly.

The first contact layer and/or the second contact layer may cool down by passive heat conduction, heat convection or by active means. For example, the first contact layer and/or the second contact layer could be brought into contact with a cold surface, and/or a cold or room temperature air stream.

The first contact layer and the second contact layer may be mounted on a belt so as to be displaced between the first position and the second position. More specifically the first contact layer and the second contact layer may be mounted on the same belt at different locations along the belt. Such an arrangement on a belt is mechanically rather simple as the first contact layer may be exchanged with the second contact layer by a simple rotational movement rolls.

Besides, an apparatus according to the invention may as well comprise more than two contact layers, thereby permitting:

- a longer time of cooling of each contact layer, for example in a configuration in which one contact layer is used at a time to perform a consolidation while the other contact layers are cooling down, and/or
- a higher manufacturing output, for example in a configuration in which two contact layers are used in the consolidation of two assembly, while another two contact layers are cooling down.

The bladder may comprise a heating device. Thus, the heat may be directly transferred to the first and second contact layers. The heating device may for example be hot air which is used to inflate the bladder, an infrared lamp and/or electrical wires integrated in the bladder.

The bladder may be attached to a fixed body and may be adapted to be inflated to be brought into contact with the first contact layer and/or the second contact layer. Thus, via the first and/or second contact layer, the bladder may exert pressure and/or heat to the assembly arranged under the first contact layer and/or the second contact layer.

The bladder may be attached to a movable body that can be displaced between a first position and at least one second position, wherein in the first position the bladder is closer to the supporting surface than in the second position. Thus, a variation in the height of the components may be accounted for. For example, the bladder may be closer to the supporting surface in case of a rather thin component, whereas it may be farther away in case of a rather thick component. Thus, in both cases the bladder may be inflated with the same amount of air or gas to exert the same pressure to the first and/or second contact layer and, thus, to the component. In particular, the movable body may be displaced by translation or rotation.

Alternatively, or in addition, the supporting surface may be movable or attached to a movable body that can be displaced toward the bladder.

The first contact layer and/or the second contact layer may be textured on at least a part of its/their surface(s) which is/are adapted to contact the thin component. Thus, the outer surface of the thin component may be textured. For example, a component on a soccer shoe may be provided with a texturing, such as lines or dots, providing grip to allow for a better control of a ball.

A further aspect of the inventive idea of the present invention is directed to an apparatus for manufacturing sporting goods, comprising: (a.) a first station comprising at least a first contact layer and at least a first bladder; (b.) a second station comprising at least a second contact layer and at least a second bladder; (c.) a supporting surface movable from said first station to said second station.

The first station and/or the second station may be an apparatus as described above.

An apparatus comprising two stations may allow setting a constant temperature of the heating device (for example of the hot bladder) in each of the stations. Such feature is particularly advantageous when a method according to the invention in used in which a third consolidation step is performed. Thereby the manufacturing time can be reduced as there is no need to wait for the heating device to heat up from the second temperature to the third temperature and to cool down from the third temperature to the second temperature.

Such apparatus may comprise a set of at least two contact layers alternating independently on each station, or a set of at least three contact layers rotating between the two stations such that each contact layer is first used in the first consolidation station and subsequently in the second consolidation station, for a same given assembly.

The supporting surface may be adapted, such that a component comprising an at least partially meltable layer placed on top of a base layer may be arranged on the supporting surface.

The supporting structure may be thermally insulated in order to ensure that the temperature of the assembly doesn't drop too quickly when transferred from one manufacturing station to another.

The supporting structure may be adapted to be heated up. For example, it may comprise embedded heating wires adapted to heat up the supporting structure. Such supporting structure may help the consolidation of the thin components on the base layer.

The supporting surface may generally be flat. Thus, any type of generally flat component may be consolidated with the apparatus. However, according to some embodiments of the invention in which a flexible contact layer and/or an inflatable bladder are used to perform the manufacturing steps according to the invention, the component do not need to be flat and may have different thicknesses in different areas, while still obtaining a good bonding of a thin component on the base layer—whatever the area of the base layer in which the thin component is placed.

The supporting surface may comprise at least one convex surface and/or at least one concave surface. Thus, two-dimensional with local embossing sporting goods or three-dimensional sporting goods or parts thereof may be manufactured with the apparatus.

The supporting surface may be at least partially textured. In particular, the area of the supporting surface on which a component may be placed may be at least partially textured. Indeed, in some embodiments of the invention, the intermediate assembly may comprise at least one thin component on a face of the base layer that is placed in contact with the supporting surface. Thus, the outer surface of a thin component placed in contact with the supporting surface may be textured. For example, a component on a soccer shoe may be provided with a texturing, such as lines or dots, providing grip to allow for a better control of a ball, or to provide better grip with a foot.

BRIEF DESCRIPTION OF THE DRAWINGS

Currently preferred examples and embodiments of the present invention are described in the following detailed description, with reference to the following figures.

DETAILED DESCRIPTION OF PREFERRED EMBODIMENTS

Currently preferred embodiments of the invention are described in the following detailed description with regard to sporting goods. In particular, the invention may be particularly useful in the creation of shoes as described herein. However, as already mentioned above, the present invention is not limited to the embodiments described herein. Rather, the present invention may also be advantageously used in the manufacture of other types of sporting goods, for example, sportswear, such as shirts, bras, tights, sports pants, gloves, etc., as well as sports equipment, for example, balls, ice hockey helmets and protective gear, sunglasses, goggles, glasses for alpine sports and/or rackets.

A "carrier surface" as referred to herein is any material used as the foundation layer for the patches. For example, a carrier surface might be a last, a tray, a plate, a base material, such as a textile, knit, woven, non-woven structure, and/or combinations thereof.

A "patch" as referred to herein is a piece of material which may be placed and/or positioned to form a structure. Patches may have any shape including, but not limited to regular shapes such as polygons, for example, rectangles, circles, triangles, pentagons, hexagons, etc., and irregular shapes, strips, and/or bands.

Figure 1:
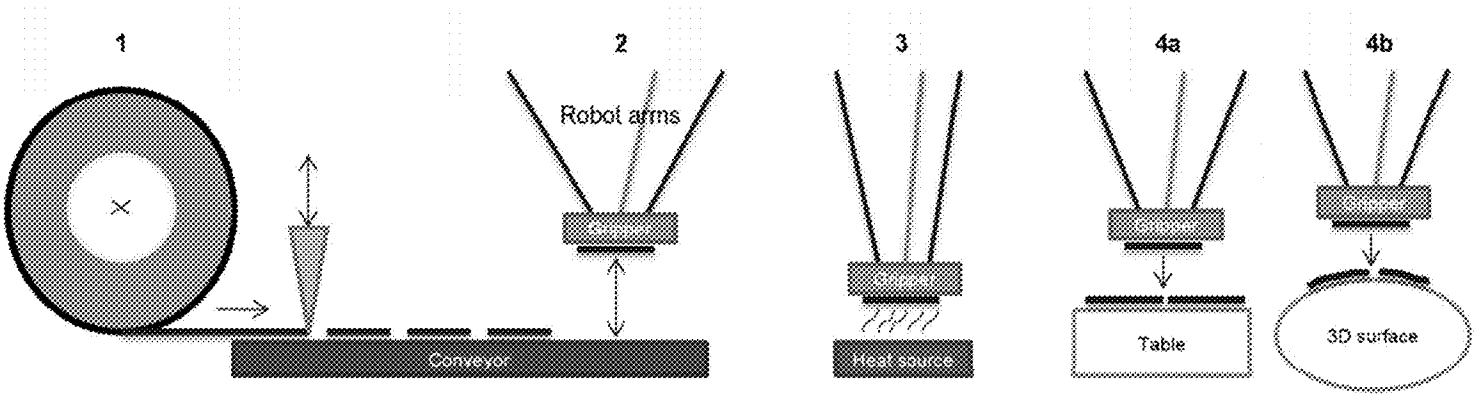
Fig. 1 PRIOR ART
FIG. 1 shows a process for patch placement manufacture.
Figure 2A:
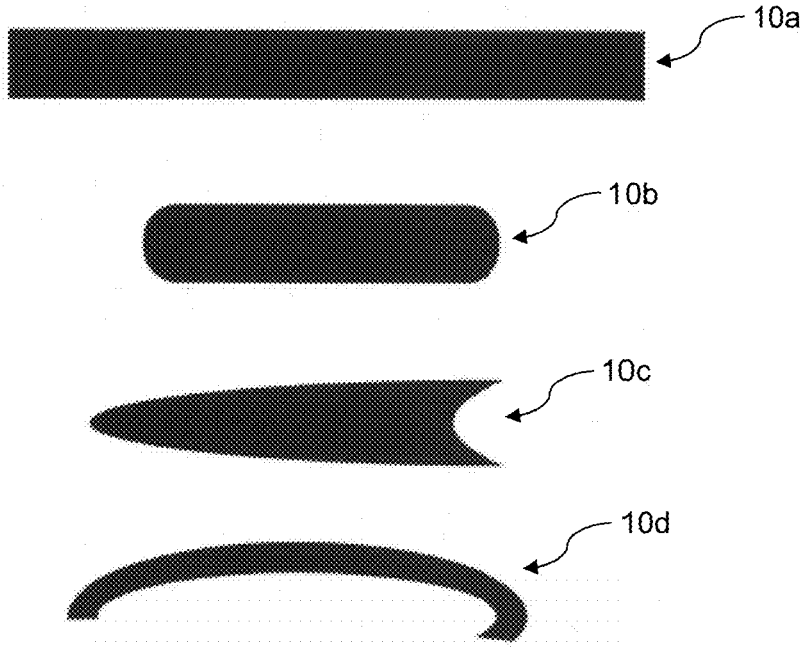
FIGS. 2*a-f* show various shapes usable for patches in accordance with some embodiments.
Figure 2B:
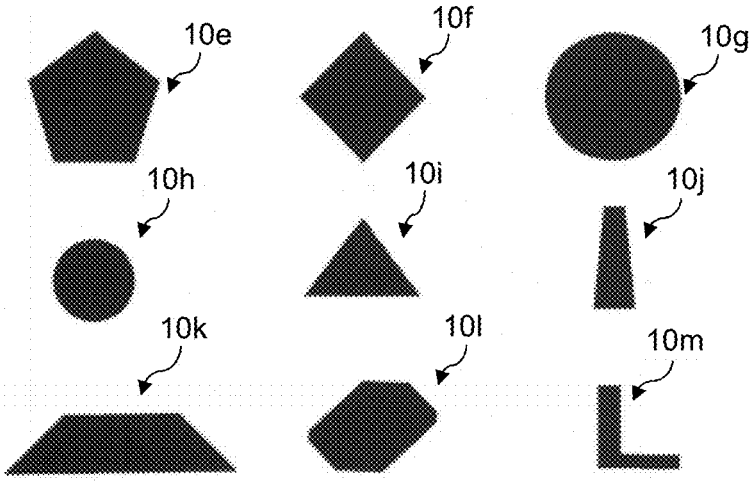

FIGS. 2*a-e* depict various shapes which may be used for patches 10. As shown in FIG. 2*a*, rectangle elements may be used as patches 10*a*. Further, patch 10*b* may have rounded edges as shown. Patches 10*c, d* may have irregular shapes used either for design purposes or functional purposes based on the requirements for the patch to meet predetermined properties. FIG. 2*b* depicts further regular shapes which may be used as patches 10*e-m*.

Figure 2C:
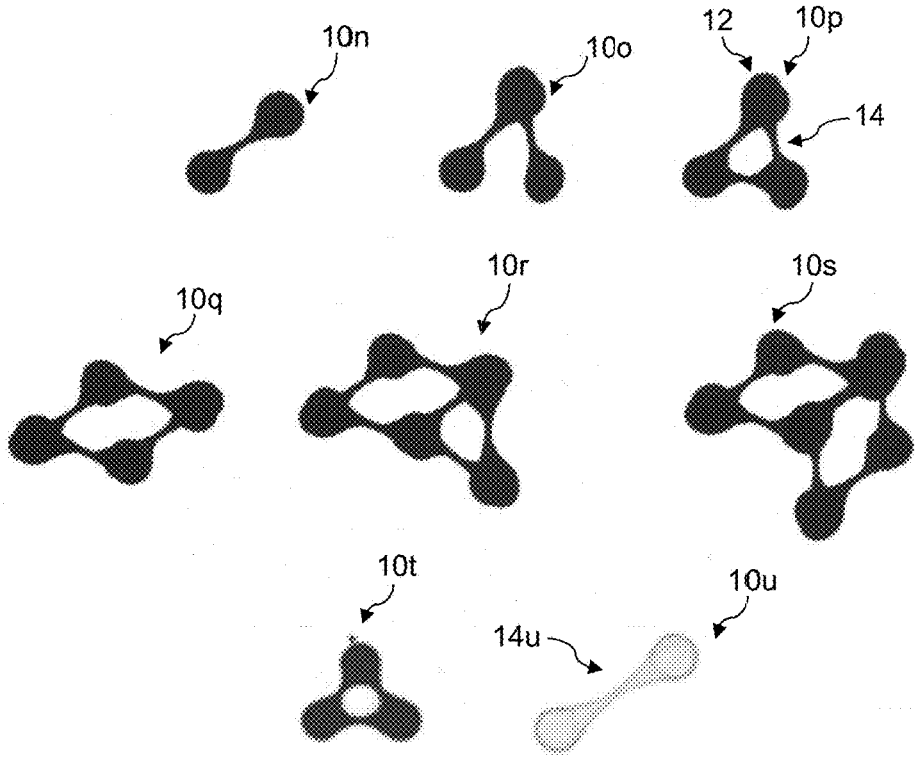

In addition, FIG. 2*c* depicts irregular shapes which may be used having nodes 12 and elongated elements 14 used as patches 10*n-u*. High concentrations of nodes 12 in an area may increase the strength property of the patches 10*q-t*. Increasing lengths of the elongated elements as shown in elongated element 14*u* of FIG. 2*c* may increase the stretchability of the resulting patch in particular areas. Thus, geometries of the nodes 12 and elongated elements 14 may be designed to impart specific predetermined properties to the patch 10 based on the materials used.

Figure 2D:
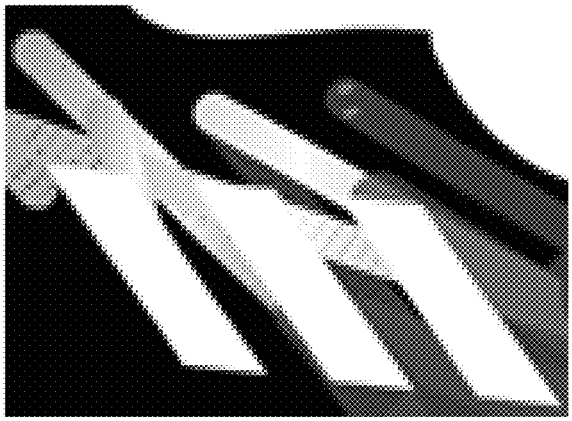

Thus, the effect of a patch 10 on an upper of a shoe may be affected by the geometry of the patch 10 in combination with the materials used to construct the patch 10. As shown in FIG. 2*d*, use of multiple patches in an area may impart specific properties to an area of an upper or shoe that are predetermined by the design or application for which the shoe will be used.

Figure 2E:
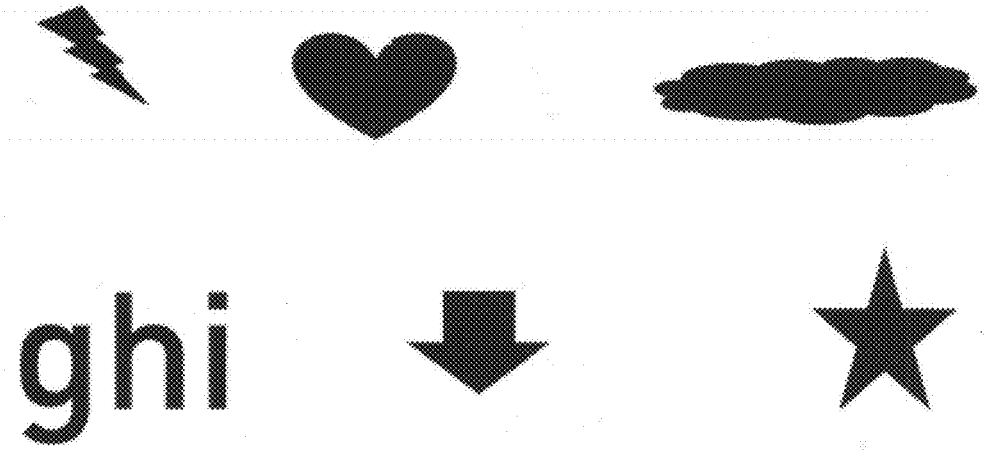

Patches 10 may also serve a design function. As an illustrative example, patches 10 may be constructed to show specific designs as illustrated in FIG. 2*e*. Patches 10 may be used for decorative and/or personalization purposes. Thus, it may be possible for a person to select patches 10 and place them on a shoe based on personal preferences of a user.

Figure 2F:
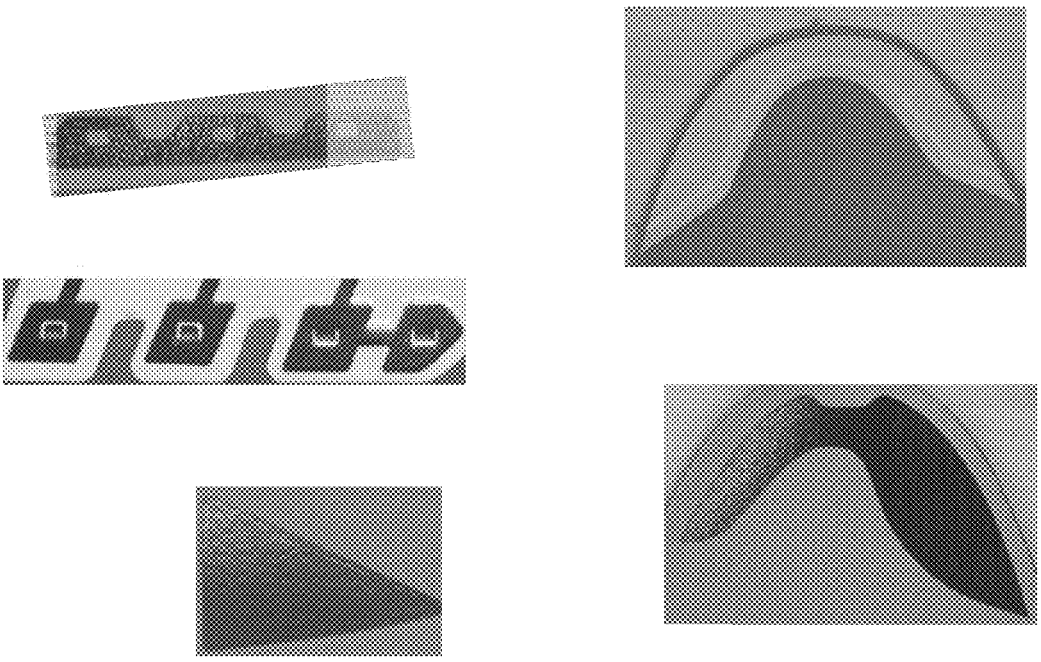

FIG. 2*f* depicts illustrative examples of patches 10 useful for articles of clothing and shoes in particular. As shown, patches 10 may provide a geometry conducive for reinforcing holes for lace elements. For example, patches may be cut (either pre-cut or during the cutting process) to correspond to openings in a base material, such as lace holes as shown in FIG. 2*f*. In this construction, multiple patches may be placed on the base material such that holes in the layers align to create a reinforced lace opening. Using the process described herein, such a construction may be formed using a base material and patches placed during the process. In some instances, placement of the patches may provide a finished construction without requiring additional processing after the fact to create the openings. Other types of patches 10 might be a useful construction for providing stability near a heel on a shoe. Still other patches 10 might provide additional stability, as well as protection, to a toe box of a shoe.

The patches depicted in FIGS. 2*a-f* are illustrative examples of patches 10 that may be used. Patch design may vary due to requirements for the patch 10, requirements for the article, such as a sporting good, an article of clothing, bra, pants, shirt, top, shoe, or the like, as a well as materials used.

The patch materials may comprise metal (e.g., aluminum, titanium, etc.), thermoset (e.g., polyepoxides, epoxy resins), thermoplastic polymers, such as polyurethane, polypropylene, polystyrene, polyester (e.g., polyethylene terephthalate ("PET")), polyamides, such as nylon, or other polymers known in the art, thermoplastic elastomers, for example thermoplastic polyurethane ("TPU"), polyether block amide ("PEBA"), etc., foam, such as expanded foams (e.g., ethyl vinyl acetate foam, polyurethane foam), particle foams, for example, expanded particle foams such as expanded thermoplastic polyurethane ("eTPU"), expanded polyether block amide ("ePEBA"), etc., membranes (e.g., expanded polytetrafluoroethylene or the like), textile materials, for example, knits, non-wovens, wovens, or the like, hook and loop materials, fibers, such as carbon or glass fibers (e.g., uni-direction carbon) composites, (such as sheet molding composite (e.g., glass fiber or carbon fibers in resin), carbon fiber-reinforced polymer, carbon fiber-reinforced plastic, carbon fiber-reinforced thermoplastic), tape, such as flocked tape, non-woven tape, partly transparent tape, colored tape, printed tape, structured tape, natural fiber, for example, silk, wool, hair such as camel hair, cashmere, mohair, or the like, cotton, flax, jute, kenaf, ramie, rattan, hemp, cork, wood, bamboo, sisal, coir, or the like, leather, suede, rubber, vulcanized rubber, a woven structure, or any combination thereof. The plurality of patches of material may be arranged in a manner to provide one or more characteristics to a given area of an article.

In some instances, additives may be added to materials used to create patches 10. In particular, additives may be added to patch materials in order to help differentiate patches 10 during the patching process. For example, vision systems may use a combination of different light sources (e.g., ultraviolet light sources, backlight sources), filters (e.g., ultraviolet transmitting filters), conveyors (e.g., transparent, translucent, or conveyors capable of transmitting light) and/or cameras (e.g., cameras having ultraviolet and infrared blocking filters removed) to determine the location of a particular patch. In particular, UV additives, such as pigments, may help differentiate patches that are translucent or have a color similar to other patches, material, and/or equipment, such as carriers, grippers or the like. Further, other additives may be used to help differentiate patch materials from one another. For example, additives which may affect a measurable property of a patch 10, a carrier, a substrate such as a textile or base material, and/or component may be used to help identify or move these elements.

For example, a backlight may be positioned under a conveyor which aids in the position determination for a carrier surface, for example, a base material, patches and/or components. In particular, backlights may be used in combination with a conveyor capable of transmitting light and a camera to identify the position of an upper part.

During placement patches 10 may be placed in a predetermined location. In some cases, placing patches 10 may include coupling the patches 10 in the predetermined location. Coupling of the patches 10 refers to placing the patches 10 in a predetermined location such that the movement from that location is reduced, and/or inhibited in some cases. Coupling may occur due to chemical or physical mechanisms. For example, coupling may be the result of friction, adhesion, bonding, magnetic fields (e.g., low frequency magnetic fields), static forces (e.g., electrostatic loading), hook and loop structures or the like, and/or combinations thereof.

Materials used in patches 10 may be selected or determined based on a physical property of the material. For example, a material may be selected for use in a patch based on properties including, but not limited to abrasion resistance, traction, strength, such as tensile strength, compressive strength, fatigue strength, impact strength, elasticity, plasticity, conductivity, breathability, strength to weigh ratio, fusibility, deformation, color, transparency, etc.

Patch materials may be supplied in the form of rolls having various thickness and/or widths. For example, patches 10 made from polymers may have a thickness in a range from about 10 μm to 5 mm.

Patches 10 may be constructed in a single layer. In some embodiments, multilayer patch materials may be used.

Patches 10 may be used in a multilayer construction. For example, multiple patches 10 having thicknesses of 40 um may be selectively patched in areas to impart stability to an upper of a shoe. Individual layers of a patch 10, for example, could be in a range from about 0.01 mm to about 10 cm.

Figure 3A:
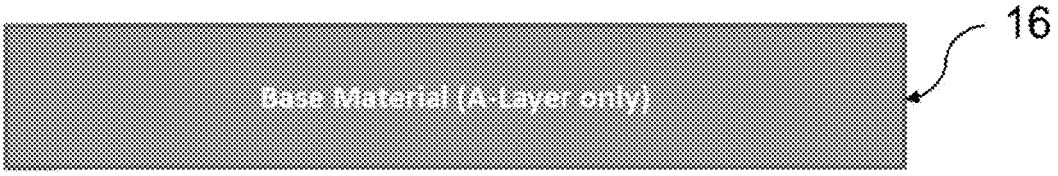
FIGS. 3*a-t* show various examples of patches in accordance with some embodiments.
Figure 3B:
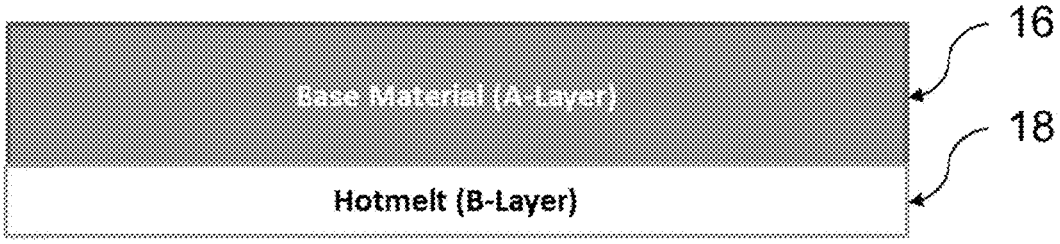
Figure 3C:
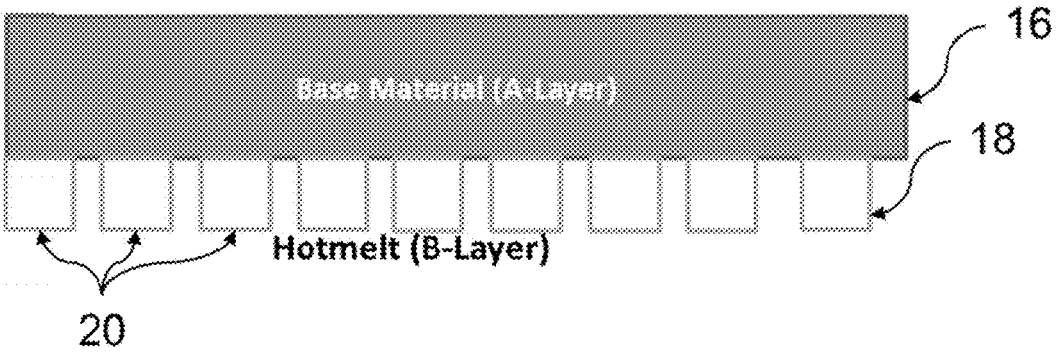
Figure 3D:
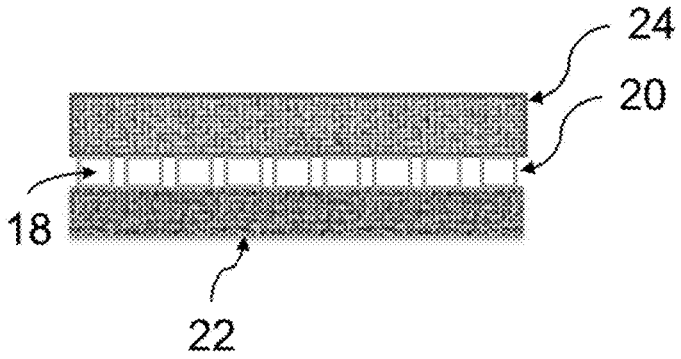
Figure 3E:
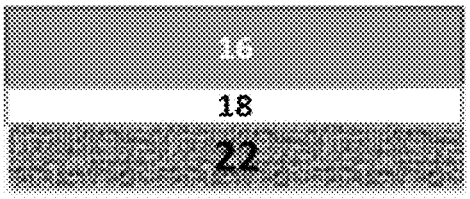
Figure 3F:
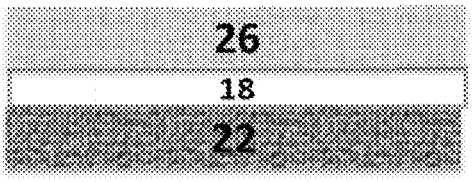
Figure 3G:
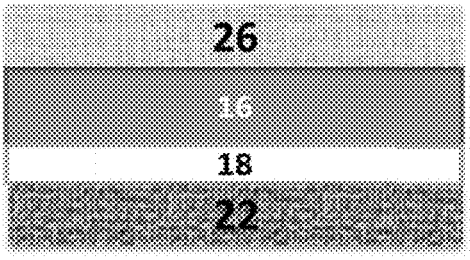
Figure 3H:
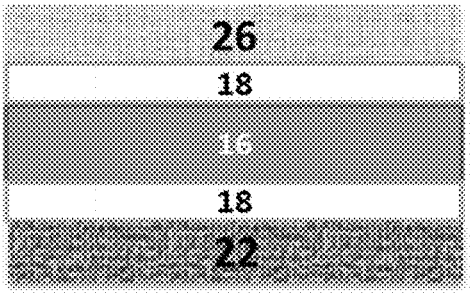
Figure 3I:
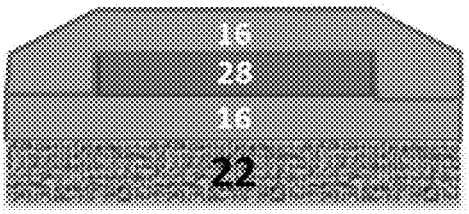
Figure 3J:
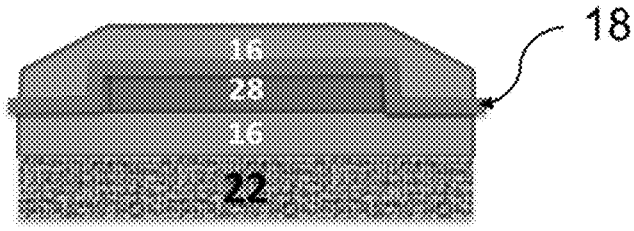
Figure 3K:
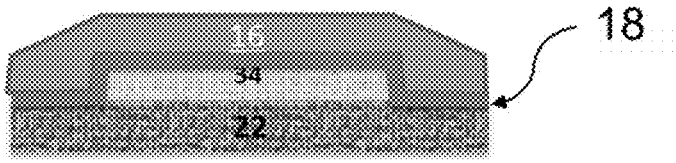
Figure 3L:
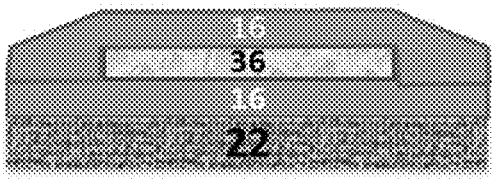
Figure 3M:
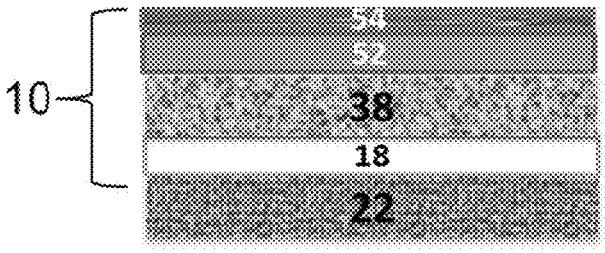
Figure 3N:
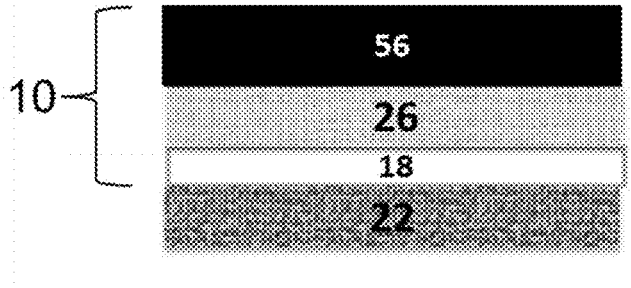
Figure 3O:
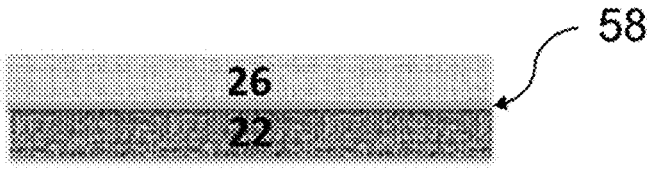
Figure 3P:
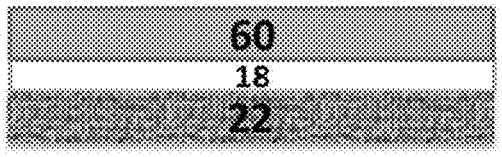
Figure 3Q:
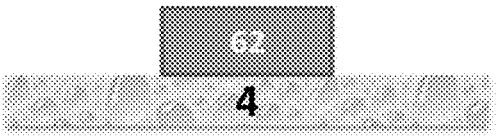
Figure 3R:
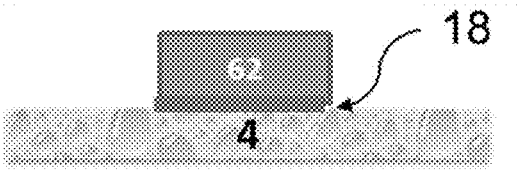
Figure 3S:
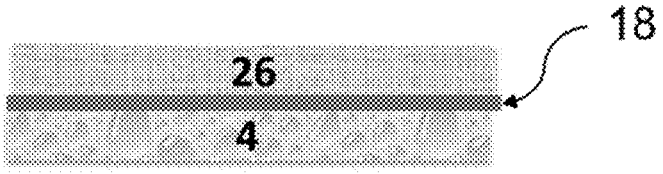
Figure 3T:
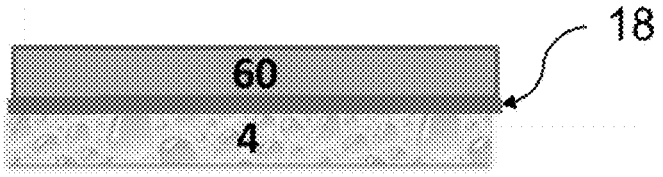

FIGS. 3*a*-3*t* depict various illustrative examples of patches 10 in accordance with embodiments of the invention. FIG. 3*a* depicts a single layer patch 10 constructed from a base layer 16. Materials used in patches 10 may have thicknesses in a range from about 0.01 mm to 5 mm.

Patch 10 may be thermoplastic, for example, constructed from TPU. Materials used for patching may be single layers or multiple layers of the same or differing materials. Patching materials may be selected based on the predetermined requirements for the patch 10. As an illustrative example, a patching material may include a TPU layer and a meltable layer having different melting temperatures. In some instances, the meltable layer may include thermoplastics, such as a hot melt layer constructed from TPU, polyamide and/or polyester. For example, a TPU with a low melting temperature may be used as a hot melt layer. Some examples may include meltable layers that have melting temperatures within the same range as the layers to which they are coupled. In some instances, the melting temperature of the meltable layer(s) may be within a range from about 20° C. to about 240° C. For example, the melting temperature of the meltable layer(s) may be within a range from about 40° C. to about 200° C. In particular, the melting temperature of the meltable layer(s) may be within a range from about 80° C. to about 180° C.

Patching materials may be provided having integrated hot melt layers in order to ease construction of the layers, increase accurate positioning of the patches 10, reduce movement of the patches 10, and/or increase likelihood that the layers are properly consolidated. For example, use of a multilayer patching material having at least one integral meltable layer is preferred when patching materials. In particular, use of a meltable layer, for example, a hot melt layer, with materials that are not meltable and/or are heat sensitive may be helpful to ensure that products are constructed in a manner that meets the specifications or predetermined characteristics required for the product.

FIGS. 3*b*-3*t* are illustrative examples of patches constructed from multiple layers. As shown in FIG. 3*b*, patch 10 may be constructed from base layer 16 and meltable layer 18. Meltable layer 18 may extend across the base layer 16. For example, a patch 10 may be constructed from a base layer 16 constructed from TPU and a hot melt layer 18. As an illustrative example, a patch 10 may include both a TPU and hot melt layer, each of the layers may have thickness of about 40 um. Thus, the patch 10 having this construction may have a thickness of about 0.08 mm.

In some designs, thickness of various layers of a patch 10 may vary. Patches 10 may be constructed to meet predetermined thickness specifications depending on the use of the patch 10 and the materials it is constructed from. For example, known properties of a material used in a layer may be used to determine the thickness of that layer, as well as determine the types of other materials with which it should be paired to create a patch 10 having the predetermined necessary properties.

In some instances, as depicted in FIG. 3*c*, meltable layer 18 may be discontinuous, in the form of elements 20. For example, the meltable layer 18 may be made from various geometries, for example, one or more dots, squares, a web, amorphous shapes (e.g., a spider-web), lines, or predetermined geometries specific to the use or design. As depicted in FIG. 3*c*, the meltable layer 18 may be a series of dots of hot melt layer. In some instances, the meltable layer 18 may be air permeable. For example, as shown in FIG. 3*d*, meltable layer 18 may comprise multiple elements 20 positioned between a carrier surface 22 and a membrane 24. The meltable layer 18 may be positioned to allow air flow through the patch 10.

Patch 10 may be positioned on carrier surface 22 and include base layer 16 and meltable layer 18 as illustrated in FIG. 3*e*. In an illustrative example, depicted in FIG. 3*f*, patches 10 may include meltable layer 18, and textile 26 positioned on carrier surface 22. The base layer 16 may be a TPU which may be used to change the physical properties of the patches 10, for example, provide stiffness, retention properties, provide and maintain a shape of the patch 10, reduce water uptake or the like. Textile 26 may be selected for various reasons, including but not limited to design, physical properties such as grip, haptic, conductivity, breathability, and/or design.

Further illustrative examples of multilayer patches 10 are depicted in FIGS. 3*g* and 3*h*. As depicted in FIG. 3*g*, a patch 10 may include: meltable layer 18, base layer 16 (e.g., TPU), and textile 26 positioned on the carrier surface 22. An alternate construction, depicted in FIG. 3*h*, includes meltable layer 18, base layer 16 (e.g., TPU), a second meltable layer 18' and textile 26 positioned on the carrier surface 22. The carrier surface may be a textile or base material, for example, a knit depending on the requirements for the upper.

Some patches 10 may include materials positioned within materials. As shown in FIG. 3*i*, thermoset material 28 may be positioned between two layers of base layer 16. A thermoset used in this manner may provide reinforcement to the patch 10. Thermoset materials may include, but are not limited to polyurethanes, such as polyurethane polymers, silicone elastomers, rubber, vulcanized rubber, melamine resins, diallyl-phthalate ("DAP"), epoxy resins, polyimides, cyanate esters or polycyanurates, polyester resins, vinyl ester resins, phenolics, etc.

As an illustrative example, a patch as shown in FIG. 3*j* may include base layers 16 constructed from TPU and a meltable layer 18 and thermoset material 28, positioned on a textile as the carrier surface 22.

In some instances, metals, such as steel, may be positioned on a textile carrier surface between layers of TPU.

FIG. 3*k*, depicts a further illustrative example shows an insulating material 34 positioned on a carrier surface 22. The insulating material 34 is held in place by meltable layer 18 and base layer 16. In some instances, the insulating material may impart cushioning and/or impact protection to the patch.

As shown in FIG. 3*l*, a further illustrative example depicts use of foam material 36 positioned between two base layers of thermoplastic material 16 and positioned on carrier surface 22. Foam may be used to impart cushioning benefits to predetermined areas on the shoe. Foam materials used may include, but are not limited to expanded foam materials, such as expanded polyurethanes, expanded particle foams, for example expanded thermoplastic polyurethane particle foams (i.e., "eTPU" particle foams), polyurethanes, ethylene-vinyl acetate foam ("EVA"), cork, etc.

A further illustrative example is shown in FIG. 3*m* which depicts a multilayer patch 10, positioned on carrier surface 22 including meltable layer 18, non-woven layer 38, topcoat layer 52, and printed layer 54. As shown, the topcoat layer 52 may include a polyurethane coating and the printed layer 54 may be formed by digital printing.

FIG. 3*n* depicts a patch 10 positioned on carrier surface 22 having meltable layer 18, textile 26, and rubber layer 56. As shown the rubber may be continuous across the textile 26. In some alternate illustrative examples, rubber 56 may be discontinuously placed on the textile 26.

In some instances, layers may be activated prior to assembly of the patches 10. For example, FIG. 3*o* depicts textile 26 and carrier surface 22 coupled together by a melted zone 58. The melted zone 58 may be formed by heating the textile 26 prior to placing the textile 26 on the carrier surface 22. For example, the textile 26 may be heated using infrared ("IR") welding prior to being placed on the carrier surface 22.

As shown in FIG. 3*p*, meltable layers 18 may be used to fix layers together. FIG. 3*p* depicts a meltable layer 18 positioned between a base carrier 22 and injected component 60.

In some instances, a multilayer patch construction may have layers having differing melting temperatures. For example, a patch 10 positioned on a carrier surface with a low melting thermoplastic polymer, followed by a textile, and having a top layer of TPU. The low melting thermoplastic polymer layer may be a TPU having a low melt temperature. In some instances, the meltable layer may be selected for having melting point greater than about 40° C. for washing purposes.

A further illustrative example of a patch material may include multiple layers of hot melt material surrounding a base layer such as TPU. It may be desired to use a TPU that is designed to stretch with good recovery properties having both an inner and outer layer of hot melt material. In some instances, such a construction may include a further outer textile layer.

Further illustrative examples on patches 10 positioned on midsoles are depicted in FIGS. 3*q-t*. FIG. 3*q* depicts an outsole element 62 fixed directly on a midsole 4. For example, a TPU outsole element 62 may be bonded directly to a midsole 4 created from an expanded particle foam, such as an expanded thermoplastic polyurethane particle foam.

As shown in the illustrative example depicted in FIGS. 3*r-t*, meltable layers 18, for example, hot melt layers may be used as an intermediate layer to couple outsole elements 62 to a midsole 4. For example, different materials may be coupled to each other using meltable layers 18, for example, cushioning materials such as expanded foams, for example, ethyl vinyl acetate ("EVA") foam, polyurethane ("PU") foam, etc., expanded particle foams, rubber, textiles, polymers, synthetics, and combinations thereof. For example, hot melt layers 18 may be used to couple outsole elements 62 to a midsole 4, in particular when the materials do not bond well.

FIG. 3*r* illustrates the use of a meltable layer 18 which may be used to couple outsole elements 62 to a midsole 4. As an illustrative example, a hot melt layer 18 may be used to bond a rubber outsole element 62 to a midsole 4 created from an expanded foam, such as ethyl vinyl acetate or a particle foam such as an expanded thermoplastic polyurethane particle foam.

In some instances, rubber elements or patches 10 may be coupled to foam materials using a meltable layer. As an illustrative example, a patch 10 shaped as a rubber outsole element may be coupled to an eTPU midsole using a hot melt layer. Further, meltable layers may be used to couple other materials to rubber. For example, a hot melt layer may be used to couple rubber patches 10 to a textile of an upper. In some instances, textile materials may be used as an outer layer on a patch 10. Alternately, rubber patches may be vulcanized directly to a portion of an upper, midsole and/or outsole.

FIG. 3*s* depicts the use of a meltable layer 18 to couple a textile 26 to a midsole 4. For example, a knit or woven patch 26 may be bonded using a hot melt layer 18 to a midsole 4 created from an expanded particle foam, such as an expanded thermoplastic polyurethane particle foam.

FIG. 3*t* depicts the use of a meltable layer 18 to couple an injected component 60 to an midsole 4. For example, an injected support element 60 may be bonded using a hot melt layer 18 to a midsole 4 created from an expanded particle foam, such as an expanded thermoplastic polyurethane particle foam.

Depending on properties of the materials to be connected hot melt layers may not be necessary for some constructions. For example, an outsole element made from TPU may be coupled directly to a midsole constructed from eTPU.

For example, textile material on the outside may provide better optic characteristics, in particular, digitally printed textiles, for example, printed bands such as are used in seat belts, printed elastic bands, etc.

Furthermore, patches 10 may be placed in order to form transition zones having a controlled stretch/stiffness.

Patches 10 and/or patch materials may be non-isotropic. In some instances, it may be beneficial for patches 10 and/or patch materials to have properties that vary along an axis of the patch 10 and/or patch material. For example, patches 10 may be constructed such that the behavior of the patch 10 varies along an axis.

Figure 4:
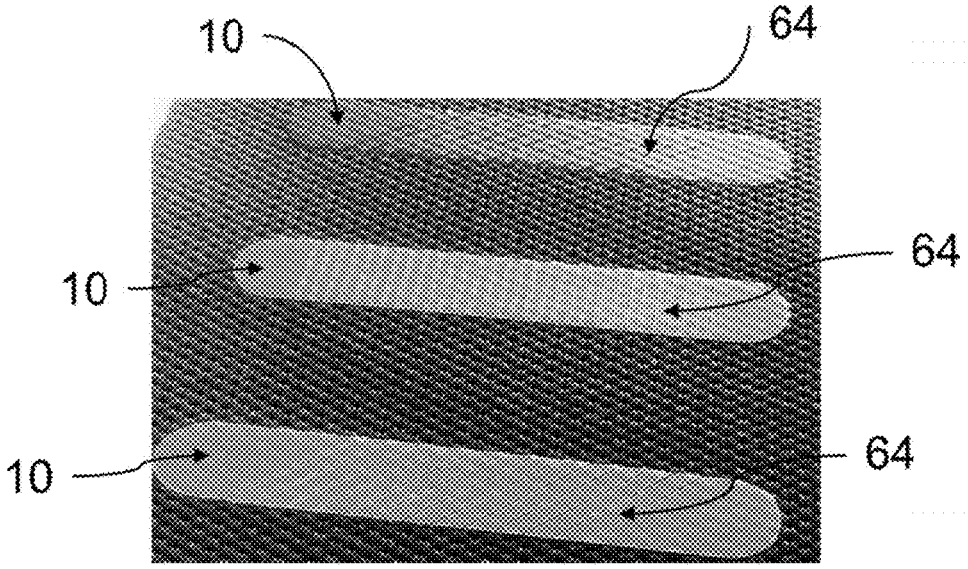
FIG. 4 shows an exemplary configuration of sipes engraved on a patch in accordance with some embodiments.
Figure 5:
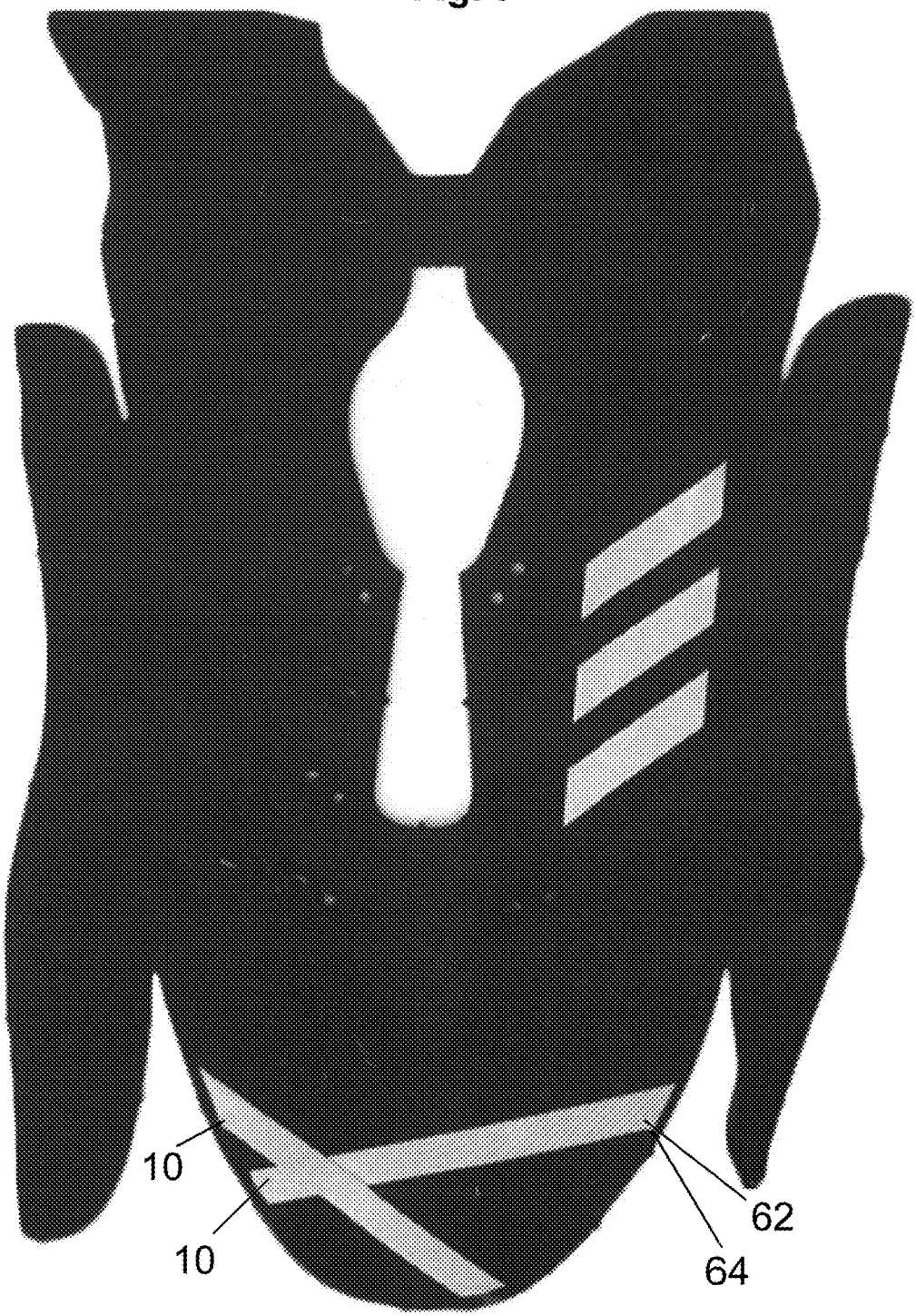
FIG. 5 shows an exemplary configuration of an engraving pattern on a patch in accordance with some embodiments.
Figure 41:
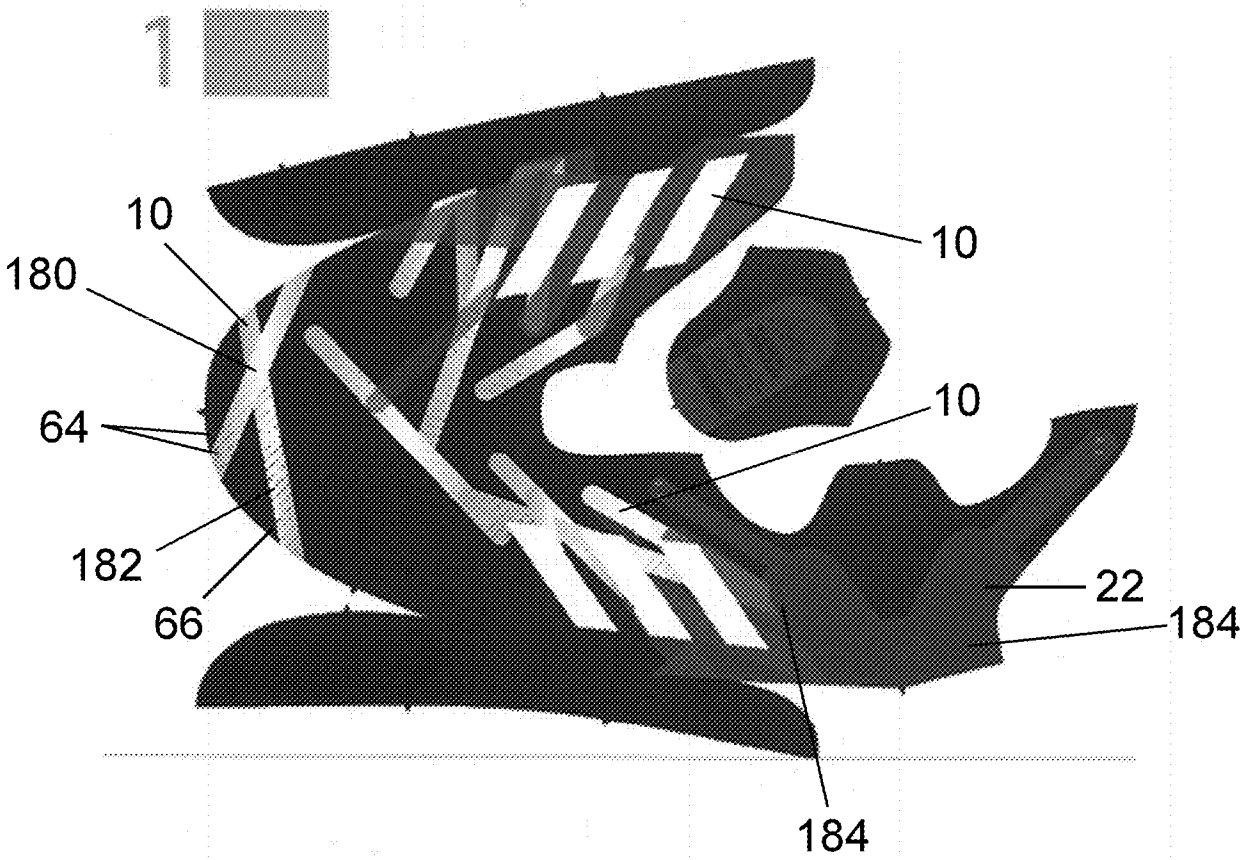
FIG. 41 shows an illustrative example of a shoe upper construction according to an embodiment.

Providing a pattern on patches 10 may be used to control properties of the patch 10, such as stretchability, stiffness, thickness, grip, etc. Patterns may be engraved on the patch 10 as shown in FIGS. 4, 5, and 41. Such patterns may vary in depth to alter the physical properties of the patch material across the patch. For example, an engraved patch 10 may be positioned at the transition from the forefoot to the midfoot to allow expansion.

In some instances, as shown in FIG. 4, sipes 64 may be positioned on a patch 10. Sipes 64 may affect the stretch of the patch 10, in particular, by allowing additional stretch perpendicular to the sipes 64. Further, in some instances sipes 64 or any other design engraved or cut into the patch may increase friction between the patch 10 and any opposing surface. For example, an engraved patch 10 on a football (i.e., soccer) shoe may have greater grip when in contact with a football (i.e., soccer ball) than a patch 10 with no structures on its surface.

In some instances, an engraving pattern 66 on patches 10 may be provided to control stiffness or flexibility, for example, near the toe area as shown in FIG. 5. As shown, sipes 62 are more prominent on the lateral side of the patch placed across the toe box. This may increase the flexibility of the patch 10 and upper on the lateral sided.

Further, other areas such as the heel region may include engraving on patches 10 in part to control the stiffness. In particular, a heel region may be benefit from the application of patches 10 in manner that allows the patch configuration to influence the stretchability of the heel region. For example, patches 10 may be positioned to allow or control stretch in predetermined areas of the heel. In particular, a heel region may have a stretch region having few patches 10 or stretchable patches 10 near the Achilles tendon to allow for stretch. In contrast, on either side of the Achilles tendon, patches 10 may be utilized to control stretch and provide stiffness.

Further, patches 10 used on or near the tongue of the shoe may be constructed with sipes or an engraving pattern such that stretch is controlled from the toe to the heel.

In some instances, patches may have additional materials placed on top to impart properties to the patch and/or the article. For example, elements may be printed on the patch. Alternatively, small rubber patches may be vulcanized to portions of an upper or patches thereon.

In some embodiments, a carrier surface may have portions that have been removed. In some embodiments, patches 10 may be added to reinforce portions of the carrier surface, for example, a base material.

In some instances, patches 10 may be applied and later shaped into the 3D form on the last.

Figure 6:
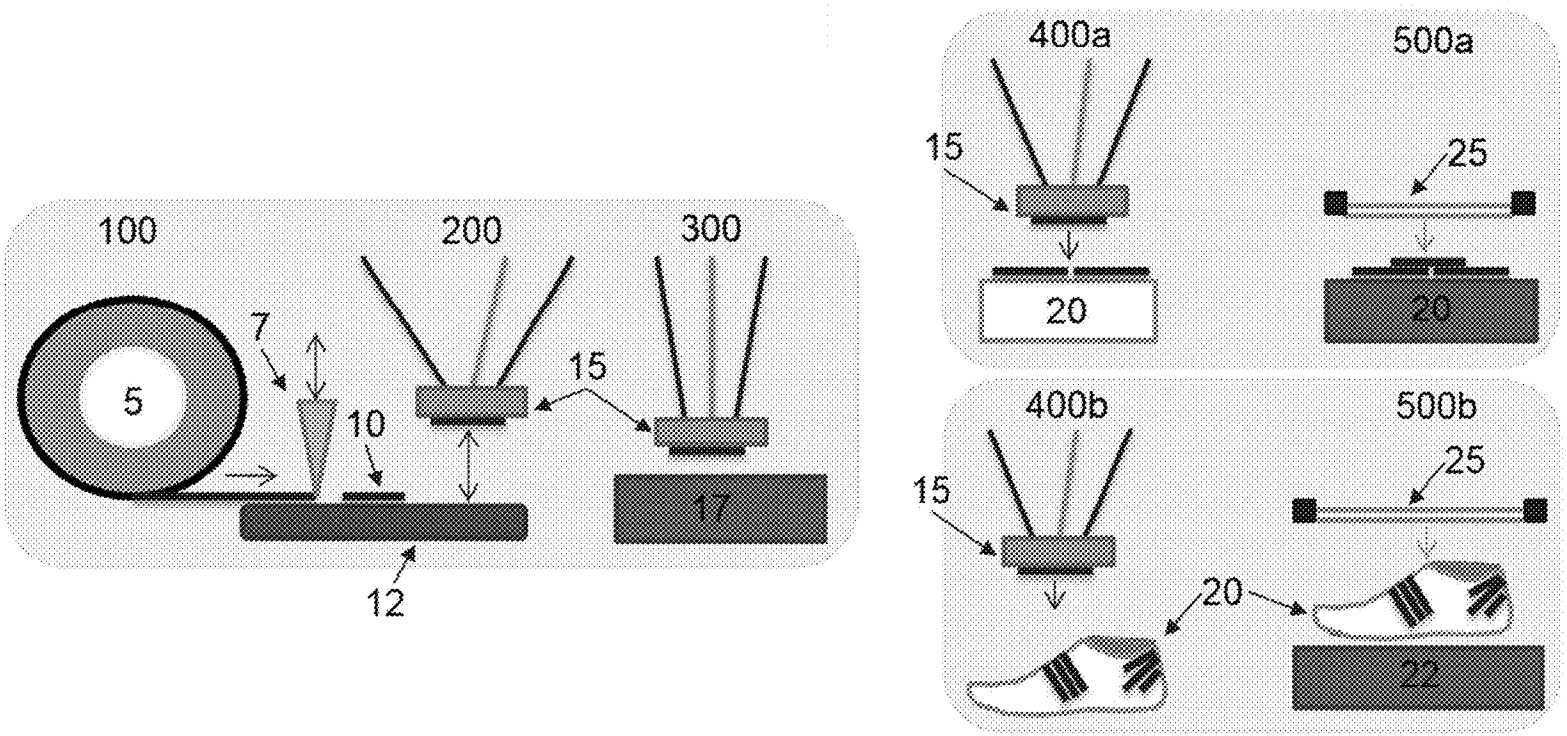
FIG. 6 shows a method according to the some embodiments for the manufacture of a sporting good.

FIG. 6 illustrates an embodiment of a manufacturing method according to the invention. Using the method, patches 10 and/or other components 10 may be produced for the essentially automated production of a shoe upper, ball housing/carcass, shoe sole, or the like.

As can be seen in FIG. 6, patches 10 are cut by a cutting device 7 from a spool 5 or sheet of material (not shown) and are placed onto a transportation device 12 in step 100. For example, the transportation device 12 may be a belt, such as a conveyor belt, a belt made from fabric, for example, a belt made from fabric used in a shoe upper, a tray, a plate, etc. Materials used in the transportation device may include, but are not limited to flexible materials, such as textiles, or rigid materials, such as metal, glass, ceramics, or the like.

In some instances, transportation devices may be constructed from materials having low thermal conductivity. It may be beneficial in some instances for materials used as transportation devices on which consolidation occurs to have a thermal conductivity of less than about 25 Watts per meter per Kelvin (W*m−1*K−1). For example, in some embodiments it may be desirable to use a material having a thermal conductivity of less than about 1 Watt per meter per Kelvin (W*m−1*K−1). For example, a thermoplastic last may be used during consolidation of a three dimensional upper.

In some instances, the transportation device may include release elements capable of causing the patches to release from the transportation device. This may reduce a force required to move the patches. Release elements may include coatings on the transportation device, ejector pins positioned on the transportation device, or other release elements known in the art. As an illustrative example, ejector pins may be positioned within the transportation device. The injector pins may be activated prior to gripping of the patches to allow the patches to be picked up using less force supplied by the gripping devices.

It is also conceivable that multiple spools of material 5 are provided in order to simultaneously provide different types of patches 10. The patches 10 are then individually picked up by a gripping device 15 in step 200 and an adhesive component of the patch 10 is activated. The adhesive component may be activated using energy. Energy used to activate the adhesive component and/or the patch 10 may include, but is not limited to electromagnetic energy, such as infrared, radio frequency, ultraviolet, microwave, heat, sound energy such as ultrasonic energy, etc. and combinations thereof.

For example, heat is provided by an infrared "IR" lamp 17 or a similar energy source 17 in step 300. Activation of the adhesive component of the patch 10 may be controlled such that only a portion of the adhesive component is activated to couple the patch 10 to the carrier surface.

A patch 10 or component 10 with an adhesive component may be positioned proximate an energy source and/or energy from a source may be controlled such that only a portion of the adhesive component is activated. As an illustrative example, the energy from an IR lamp may be controlled such that the adhesive component of the patch 10 is selectively heated to activate only a portion of the adhesive component.

In a particular example, the energy from the IR lamp may be controlled such that only the portion of adhesive component corresponding to the centerline of the patch 10 is activated. In some instances, an area corresponding to the centerline of the patch 10 may be activated, as well as approximately 2.5 mm on either side of the centerline, such that the width of the activated area is about 5.0 mm. Activation of the patch may also occur over a width of about 20 mm. For example, in an illustrative example an activation area on either side of the center line may extend for 10 mm in both directions.

Based on geometry, materials selected and/or the functionality of the patch and/or component the activated area may vary, in position, width, length, and/or shape. In particular, some patches and/or components may have an activated area that corresponds to the full area of the patch. In alternate examples, the activated area may be part of the patch and/or component. In some instances, the activated area of the patch and/or component may correspond to less than about fifty percent of the surface of the patch available for bonding. In some instances, the activated areas may correspond to an area of less than about twenty-five percent of the surface area of the patch and/or component available for bonding. In a particular example, the activated area may be less than about 10% of the surface area of the patch and/or component available for bonding with the carrier surface.

For example, the activated area may have a width of less than about 25 mm along the length of the patch. The width of the activated area may be less than about 15 mm. In particular, the activated area may have a width of less than about 10 mm. In some instances, the activated area of the patch may have a width of less than about 5 mm.

The area of activation of the adhesive component of the patch may be controlled based on the geometry of the patch.

In some instances, the area of activation may correspond to the first point of contact with a carrier surface for the component, in particular a patch. For example, an activation area may correspond to the center line and/or center point of a patch, which may then be used as the first point of contact with the carrier surface.

In some instances, positioning of the patches 10 proximate an energy source may be controlled such that only an outer layer of an adhesive component is activated to couple the patch 10 or component to the carrier surface.

The patch 10 may then be placed onto a two-dimensional or three-dimensional carrier surface 20. In step 400*a*, a two-dimensional carrier surface 20 in the form of a flat surface (e.g., a work top), a flat base material (e.g., a knit material or midsole) is illustrated. Step 400*b* illustrates a three-dimensional carrier surface 20, such as a 3D form (e.g., a last). The process of patch placing may be repeated as desired for a plurality of patches 10.

After the patches 10 have been placed onto the carrier surface 20, an optional consolidation takes place in steps 500*a* and 500*b*, through the use of a flexible membrane 25, for example, a stretchable silicone skin. The flexible membrane 25 may be shaped to follow the profile of the carrier surface 20, e.g., the shoe upper. For example, for a 3D shoe upper formed on a last 20 the flexible membrane 25 may substantially follow the contour of the last 20. It is important to note that the process of the invention does not require the use of a rigid overmold, rigid female mold component, or rigid upper part.

Figure 7:
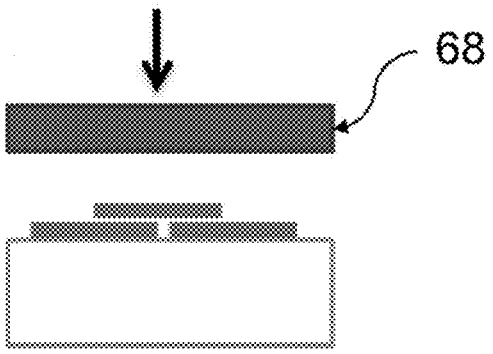
FIG. 7 shows an exemplary use of a rigid plate to provide heat and pressure to patches in accordance with some embodiments.

In some instances, a rigid upper part may be used to secure patches on flat or 2D articles, such as shoe uppers, pants, shorts, shirts, bras, and/or sweatshirts. As an illustrative example, a rigid plate 68 may be used to provide heat and pressure to patches 10 on an upper during the consolidation process as shown in FIG. 7.

Figure 8A:
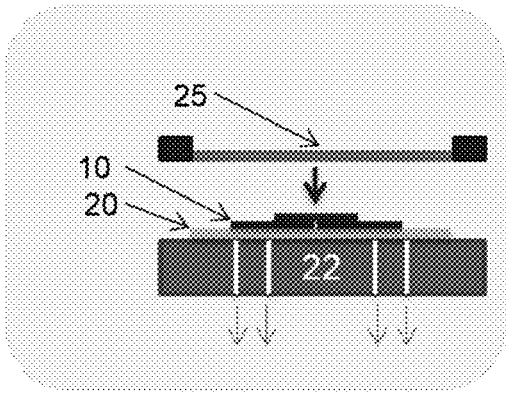
FIGS. 8*a-c* show alternatives for utilizing a flexible member in accordance with some embodiments.
Figure 8B:
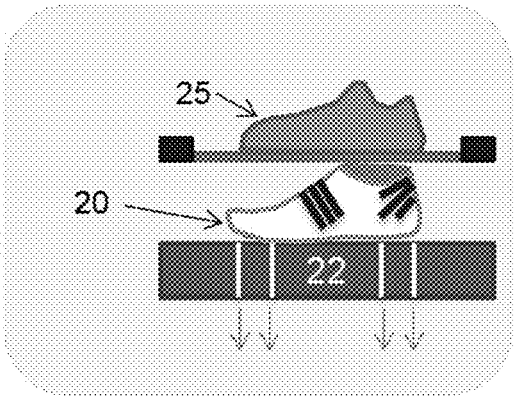
Figure 8C:
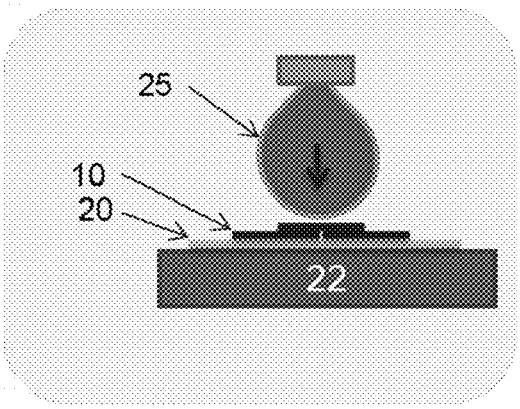

FIGS. 8*a-c* illustrate three options for the consolidation step 500*a*/500*b*. In FIG. 8*a*, a substantially planar silicone skin 25 on a frame is used as a flexible membrane. The flexible membrane 25 is placed on top of a plurality of pre-arranged patches 10, which are in turn arranged on top of an upper 20 forming a two-dimensional carrier surface. In FIG. 8*b*, a pre-formed silicone skin 25 as described above is used and placed on top of a patched upper 20, i.e., a shoe upper with pre-arranged patches 10.

FIG. 8*c* illustrates a further option, namely the use of a heated oil bladder 25 which is placed on top of the patches 10 to act in a manner similar to the flexible membrane.

FIGS. 8*a-c* also illustrate an optional heating of the consolidated patches 10 and flexible membrane 25 by means of a hot table 22 onto which the components are arranged. Using a hot melt layer on the patches 10 is one option in this scenario, since is allows fast cycle times, an easy application without overspill and a homogeneous hot melt distribution. Other sources of heat are possible as well. To further improve the consolidation, a vacuum may be created by withdrawing air from the consolidated material through the table 22, as indicated by means of the arrows pointing downwards from the table 22 in FIGS. 8*a-b*.

Figure 9:
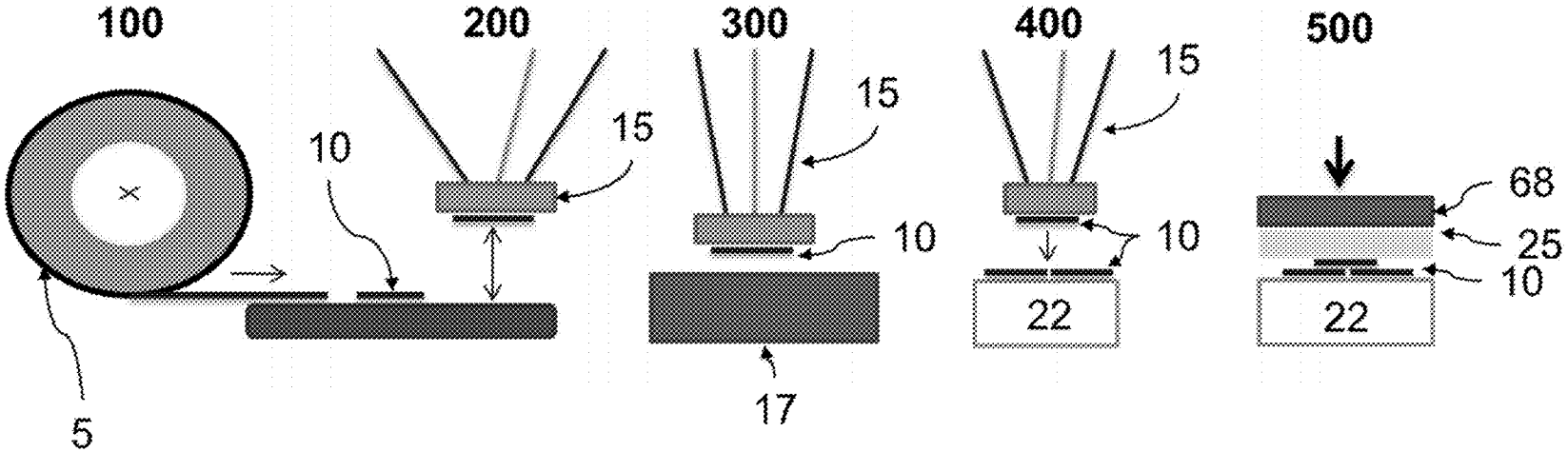
FIGS. 9-12 show additional exemplary methods in accordance with some embodiments.

As shown in FIG. 9, an illustrative example of a patching process is depicted. As can be seen in FIG. 9, patches 10 are cut by a cutting device (not shown) from a spool 5 or sheet of material (not shown) and are placed onto a carrier surface 22 in step 400. For example, the carrier surface 22 may be a belt made from fabric, for example, a belt made from fabric used in a shoe upper, a shoe upper, a textile element, a midsole, a last, etc.

It is also conceivable that multiple spools of material 5, multiple sheets of materials, and/or patches 10 are provided in order to simultaneously provide different types of patches 10. The patches 10 are then individually picked up by a gripping device 15 in step 200 and an adhesive component of the patch 10 is activated in step 300. The adhesive component may be activated using energy. Energy used to activate the adhesive component and/or the patch 10 may include, but is not limited to electromagnetic energy, such as infrared, radio frequency, ultraviolet, microwave, heat, sound energy such as ultrasonic energy, etc. and combinations thereof.

For example, heat is provided by an infrared "IR" lamp 17 or a similar energy source 17 in step 300 shown in FIG. 9. The adhesive component could also be separately provided. The patch 10 may then be placed onto a two-dimensional carrier surface 22. In step 400, a two-dimensional carrier surface 22 in the form of a flat surface (e.g., a work top), a flat base material (e.g., a knit material or midsole) is illustrated.

After the patches 10 have been placed onto the carrier surface 22, an optional consolidation takes place in step 500, through the use of a flexible membrane 25, for example, a stretchable silicone skin. As shown in FIG. 9, flexible member 25 may be coupled to the rigid member 68. Rigid member 68 may be used to move flexible member 25 so that consolidation may occur.

In some instances, the application of pressure and/or heat during consolidation may be controlled both in quantity and the time frame for application of the heat and/or pressure based on the materials selected, number of patches, thickness of materials, position of the patches on the article, and/or use of the article.

Consolidation may be performed at a temperature in a range from 40° C. to 240° C. Further, some constructions may be consolidated at temperatures in a range from 55° C. to 200° C. In addition, there may be constructions where consolidation is performed at temperatures ranging from 80° C. to 180° C. Temperatures described herein may be the initial membrane temperature.

Pressure during consolidation may be controlled such that pressure is in range from 1 bar to 10 bar. In some instances, pressure during consolidation may be controlled in a range between 1.1 bar and 4 bar. Further, pressure during consolidation may be controlled in a range from about 1.5 bar to about 2 bar. For example, particularly thin patches, for example, made of tape, less time and pressure may be applied, such as 180° C. at 1.5-2 bar for 60-90 seconds.

A number of layers consolidated may also affect the time required for bonding. For example, in an illustrative example four layers of patches were joined using a membrane having an initial temperature of about 180° C. Further, in another example bonding of five layers of patches at 180° C. was complete after about 90 seconds of consolidation.

Figure 10:
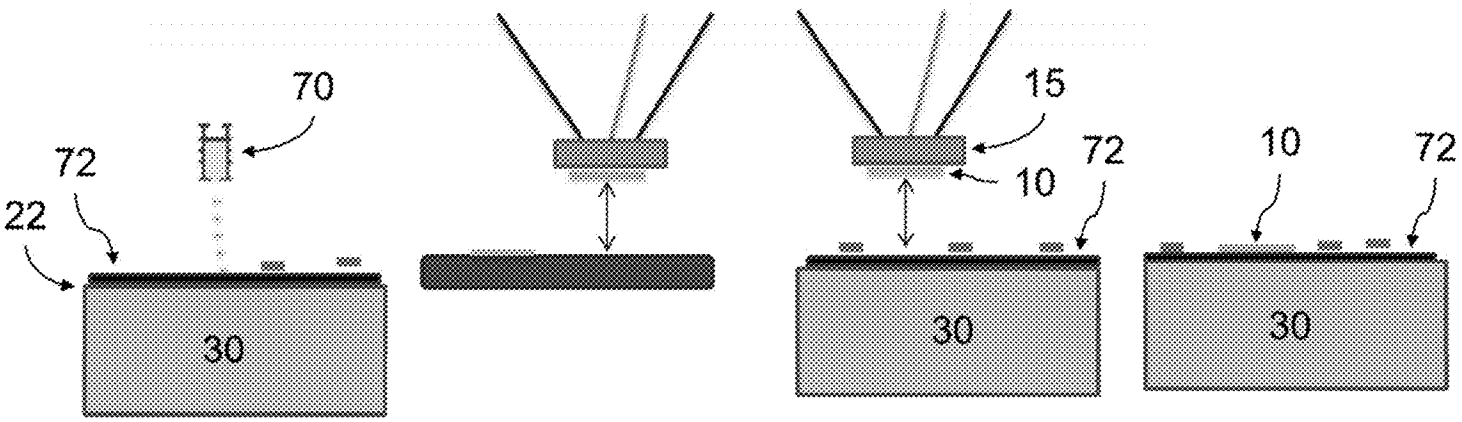

Patching of materials on a carrier surface or an article may also involve other methods of coupling the patches to the surface of interest, be that the carrier surface, another patch, and/or component. As shown in FIG. 10, an illustrative example of a portion of a patching process is depicted, in which a carrier surface 22 may be selected and placed on a transportation device 30. Patch materials may be supplied as described above on a spool and cut, be precut, or provide on a flat sheet and cut out. As shown, the carrier surface 22, in this case a base material, and/or the transportation device 30 may be electrostatically loaded using a charging device 70. Patches 10 may be placed on the base material 72. Due to the electrostatic charge of the base material 72, the patch 10 may be "coupled" to the base material 72. This electrostatic coupling may allow the base material and patches to be moved without altering the position of the patches on the base material. In some instances, the patched construction may be consolidated using the methods described herein.

In some instances, the electrostatic loading is delivered using a static charging system which includes a high voltage generator which supplies voltage needed to create a static charge, and an electrode. Charging electrodes may be designed in a manner that allows configurations and/or shapes to be optimized for a specific application. As shown in FIG. 10, electrode 70 may be placed above or opposite a grounded transportation device 30. After application of the electrostatic field the base material will be temporarily fixed or bonded to the grounded surface of the carrier. Further, additional pieces may be positioned on the base material and fixed using the electrostatic charge. As shown in FIG. 10, a patch 10 may be placed on the base material 72 and thereby coupled to the base material. Thus, the patch will not slip or change position. In some cases, an anti-static foam material may be used that allows for full contact with the base material and helps to distribute the electrostatic charge.

Figure 11:
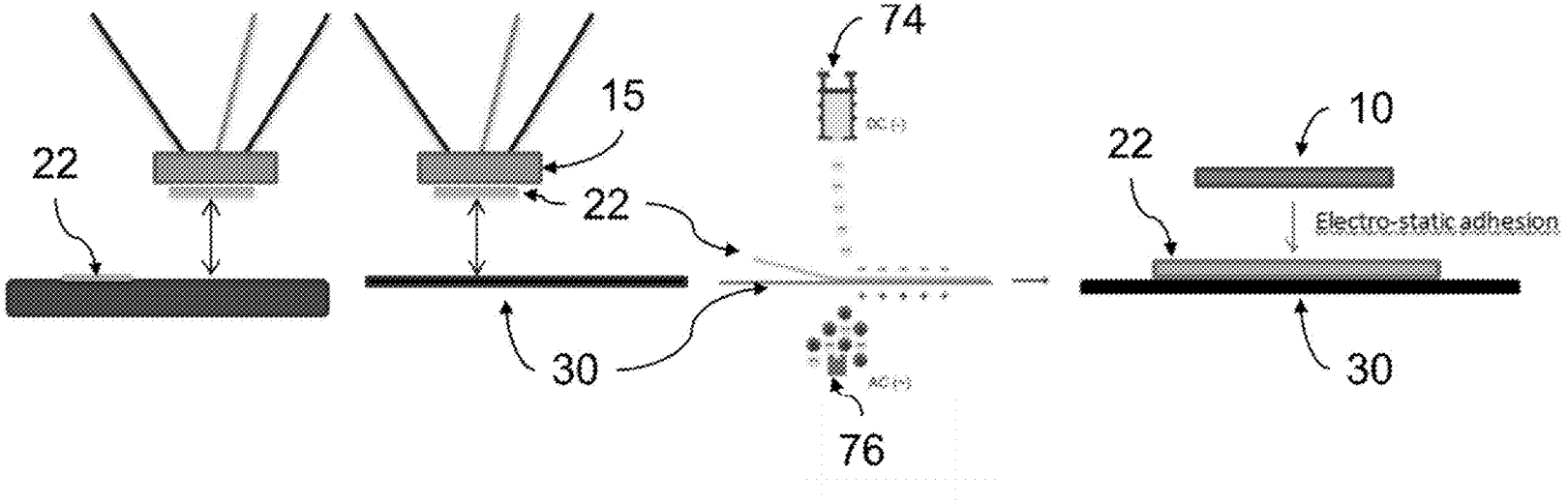

FIG. 11 depicts a further illustrative example of patching materials using electrostatic forces. In particular, a carrier surface 22 is placed on the transportation device 30. As depicted, carrier surface 22 may be a base material 72. Using a charging device which includes electrode 74 and artificial ground 76 (e.g., virtual ground, antistatic bar) the carrier surface 22 and transportation device 30 is loaded. This allows for positioning and coupling of patches 10 placed on the carrier surface 22. In some cases, multiple patches may be placed and coupled using electrostatic adhesion. The antistatic bar acts as a ground in this case. Final fixation may occur using the consolidation process described herein.

In some instances, it may be necessary to discharge the final article prior, during, or after the consolidation process.

Figure 12:
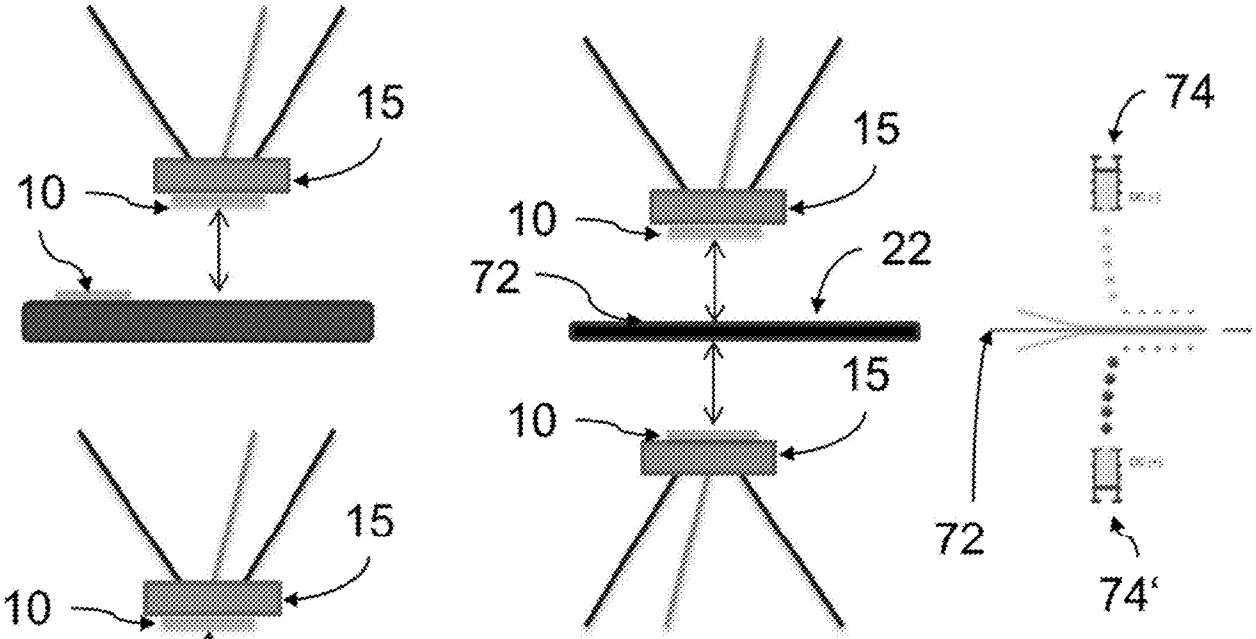

FIG. 12 shows grippers 15 retrieving patches 10. In this instance, the carrier surface 22 may be material acting as both a base material 72 and a transportation device. Grippers may be used to select and position patches 10. Further, patches 10 may be placed on the base material 72 while a charge is being delivered by electrodes 74, 74' Thus, patches can be placed, for example, on both an external or internal surface of a carrier surface, for example a base material 72 of an upper.

Using electrostatic adhesion to position and couple the patches to the base material and/or carrier surface may reduce cycle time for construction of articles by eliminating a step in the process. Further, it allows flexibility in some instances to position patches on both surfaces of an upper.

Patching an article may involve combining one or more of the methods described herein for positioning and coupling patches to a carrier surface or base material. In some instances, it may be desirable to combine patching using electrostatic loading with a patching process involving use of activated patches. For example, a base material may be electrostatically loaded and patches placed using electrostatic loading. Additional patches may be placed using activation of an adhesive component of the patches. Such a configuration may be useful, for example, when the base material is a textile belt that is acting as both the carrier surface and the transportation device. Such a configuration might allow for placing and coupling patches on both sides of the base material. Further, such a configuration may be of interest where some materials and/or constructions utilized are not conducive to coupling to the carrier surface or another surface using electrostatic loading.

After positioning patches 10 on a carrier, for example a base material or 3D form, the patches 10 may be bonded or fixed using a consolidation process.

Figure 13:
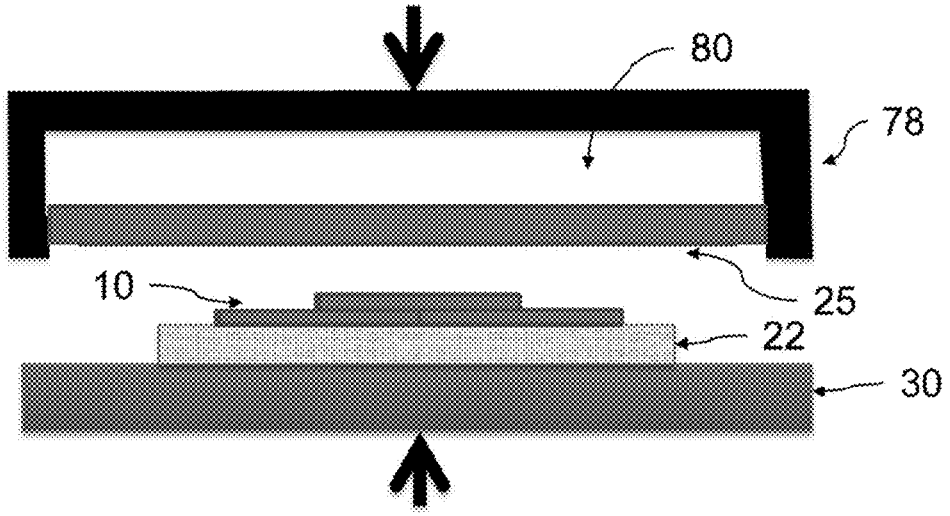
FIGS. 13-16 show exemplary consolidation processes in accordance with some embodiments.

After the patches 10 have been placed onto the base material, an optional consolidation step may be conducted, through the use of a flexible membrane, for example, a stretchable silicone skin. As shown in FIG. 13, flexible member 25 may be coupled to the rigid member 78. Rigid member 78 may be used to move flexible member 25 so that consolidation may occur. Zone 80 may be pressurized such that the flexible member 25 substantially forms to the shape of the materials for consolidation. Further, the pressure in the zone 80 may be controlled such that a predetermined pressure is applied to the patches during the consolidation process for a predetermined length of time based on the materials selected. In some instances heat may be provided to the patches 10 using the flexible member 25. In other instances, the rigid member 78 may provide heat to the patches to consolidate them. Further, in some instances heat may be provided through and/or by the carrier surface.

Patch materials may be supplied as described above on a spool and cut, be precut, or provide on a flat sheet and cut out.

Figure 14:
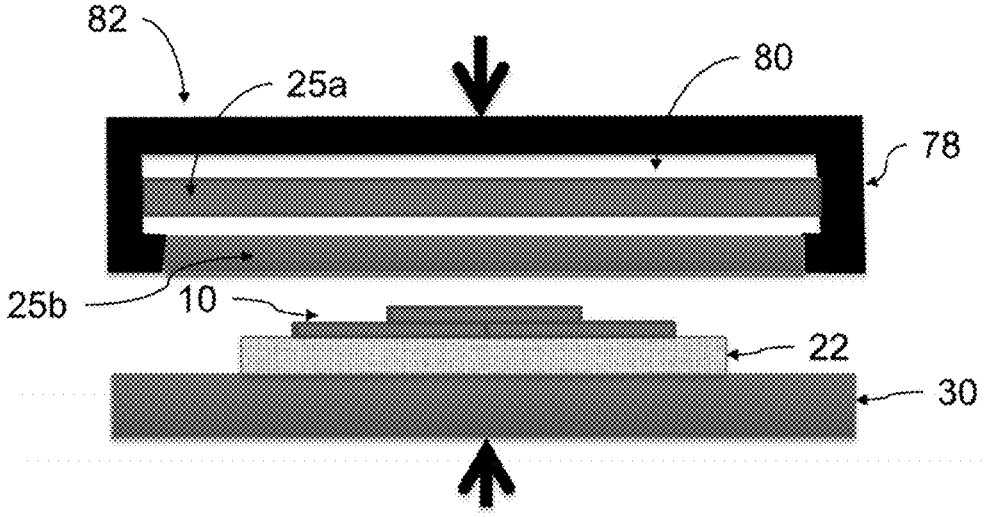

FIG. 14 depicts an illustrative example of a further consolidation method 500 that may be used to consolidate patches. In particular, multiple flexible members 25*a*, 25*b*, may be used. Flexible member 25*b* may be positioned such that it contacts the patches 10. In some instances flexible member 25*b* may provide texture to the patches 10 when it is applied using heat and/or pressure. Consolidating structure 82 may be constructed such that the flexible member 25*b* is exchangeable. This would allow various configurations for a textured pattern on different flexible members 25*b* which can be exchanged. Flexible member 25*a* may provide heat and/or pressure to the flexible member 25*b*, the patches 10, and carrier surface 22, which is shown as a textile. Alternately, pressure may be applied using the flexible member 25*a* by pressurizing zone 80 and heat may be provided by carrier 17.

Figure 15:
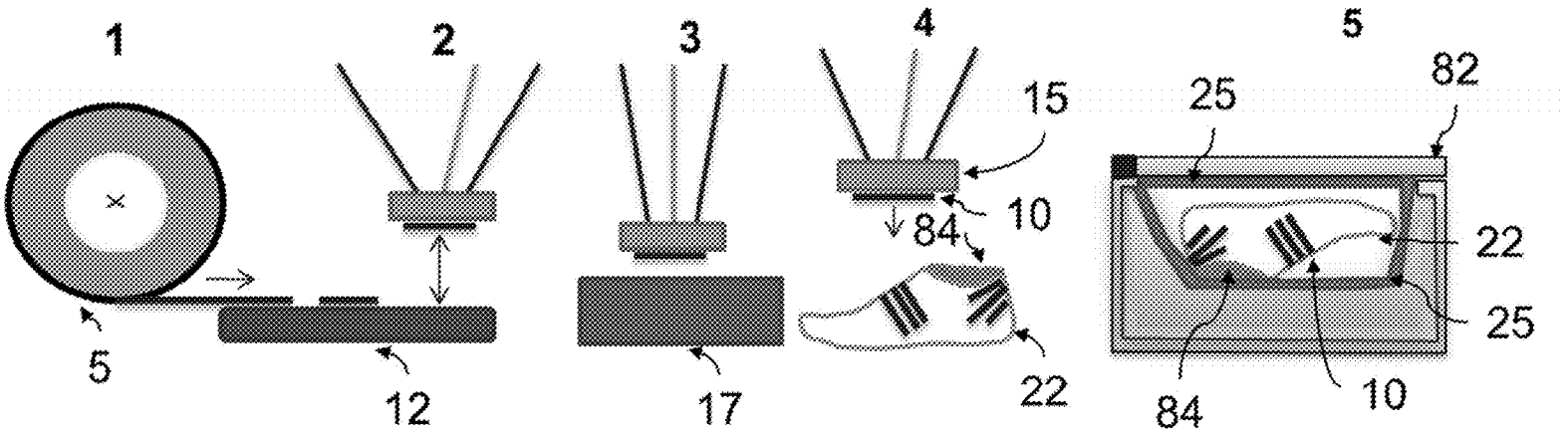

FIG. 15 depicts a patching process comprising cutting, placing, and consolidating patches or elements on a carrier surface 22, in particular, on a upper 102 positioned on a 3D form. In FIG. 15, a shoe last 84 is shown as the 3D form. The process for steps 100, 200, and 300 are substantially similar to that of the 2D process as is depicted in FIG. 6. In some instances, grippers may be adapted for positioning materials on a 3D form. As an illustrative example, gripper 15 used for positioning materials on a 3d form, such as a shoe, may have a foam element having a greater thickness to allow the foam element to deform when contacting the shoe last 84 without allowing other parts of the gripper 15 to contact the upper 102 and/or patches 10.

In the illustrative example described above, carrier surface 22, in particular a three-dimensional carrier surface, may comprise a work form, such as a last, a base material carried on a work form, or a combination thereof.

As shown, consolidation step 500 may include positioning a carrier surface 22 within consolidating structure 82.

Figure 16:
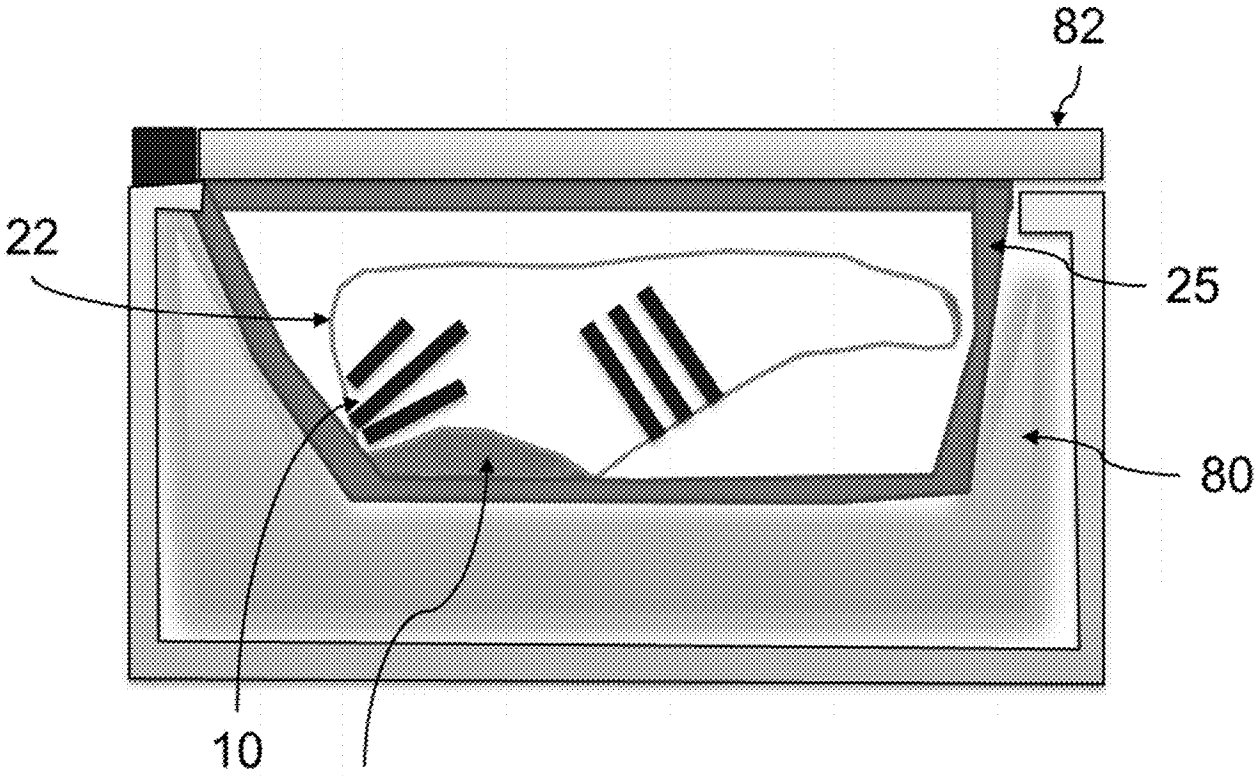

As depicted in FIG. 16 consolidating structure includes flexible member 25. Zone 80 may be pressurized to apply pressure to the flexible member 25. Flexible member 25 may be constructed from many individual parts or in some cases be a continual part. Pressure within the zone 80 may be controlled such that a predetermined pressure is applied to patches 10 and/or carrier surface 22 by the flexible member 25. Heat may be applied to the patches 10 and carrier surface 22 by application of heat in the zone 80. The application of heat and/or pressure over a specific time may be controlled such that temperature, pressure and time values correspond to predetermined values for materials and/or constructions. In alternate embodiments, heat may be applied to the patches and/or carrier using the flexible membrane. Any method of delivering energy or heat to the patches may be used to consolidate patches. For example, electromagnetic energy, radiant energy, for example, infrared energy, thermal energy, ultrasonic, convection, and combinations thereof may be used to provide heat and/or energy for consolidation.

Zone 80 may be pressurized such that the flexible member 25 substantially forms to the shape of the materials for consolidation. Further, the pressure in the zone 80 may be controlled such that a predetermined pressure is applied to the patches during the consolidation process for a predetermined length of time based on the materials selected. In some instances heat may be provided to the patches using the flexible member. In other instances, a portion of the consolidating structure 82 may provide heat to the patches to consolidate them. Further, in some instances heat may be provided through and/or by the carrier surface. For example, heat may be provided by a heated last to at least a portion of the plurality of patches.

Further, a flexible membrane may be provided as a belt on a conveyor. For example, the flexible membrane may be rotated between consolidation processes. Thus, each consolidation process may start with a "new" portion of the flexible membrane. In some instances, a flexible membrane on a conveyor may have different surface treatments on different parts of the flexible membrane allowing different surface treatments to be applied during the consolidation process.

Consolidation using any of the methods described herein may be a multistep process. As an illustrative example, a first consolidation process may occur at a temperature of 100 C at a pressure of 2 bar for sixty seconds. The second consolidation may occur at same pressure of 2 bar and time frame of sixty seconds, but at a higher temperature, for example at a temperature of about 180 C. Consolidation conditions, including time, pressure and temperature, as well as number of consolidation steps, are dependent on the constructions, as well as the materials used in the articles.

Figure 17:
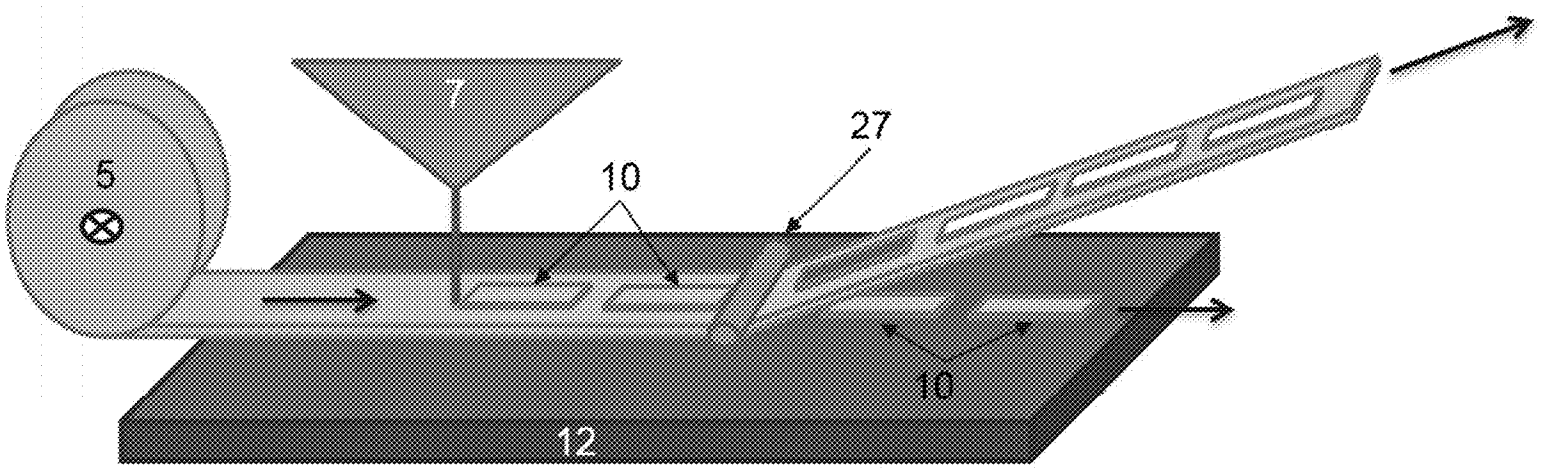
FIG. 17 shows a "spool to spool" process for automatically removing excess material in accordance with an embodiment.

FIG. 17 illustrates a method for cutting patches from materials. In particular, a process for removing excess material after the material has been cut into patches 10. As can be seen, the material is first unrolled from the first spool 5, cut into patches 10 using e.g., a laser 7, and the excess material 86 is removed from the conveyor belt 12 in an automated manner. Positioning device 27 is a moveable part which applies pressure to the material when it is being cut. After cutting has occurred positioning device 27 may move to allow excess material 86 to be separated from patches 10 and be removed. In some instances, the excess material may be wound on another spool (not shown) for additional process and/or recycling.

In a further aspect of the invention, the step of providing a plurality of components may comprise the steps of providing material from a spool, a belt, a tray, and/or a stack onto a transportation device, cutting the plurality of components out of the material using a cutting device, and removing excess material from the transportation device in an automated way. For example, materials may be processed by provide the material using a first spool, cutting the plurality of components out of the material using a cutting device, and removing excess material preferably by using a second spool. Such a "spool to spool" process which results in an automated removal of excess material after cutting can be fully or at least partly automated to provide considerable efficiency improvements. A spool process in accordance with embodiments of the invention may also feature a carrier layer to avoid adhesion between layers which can be automatically removed.

Figure 18:
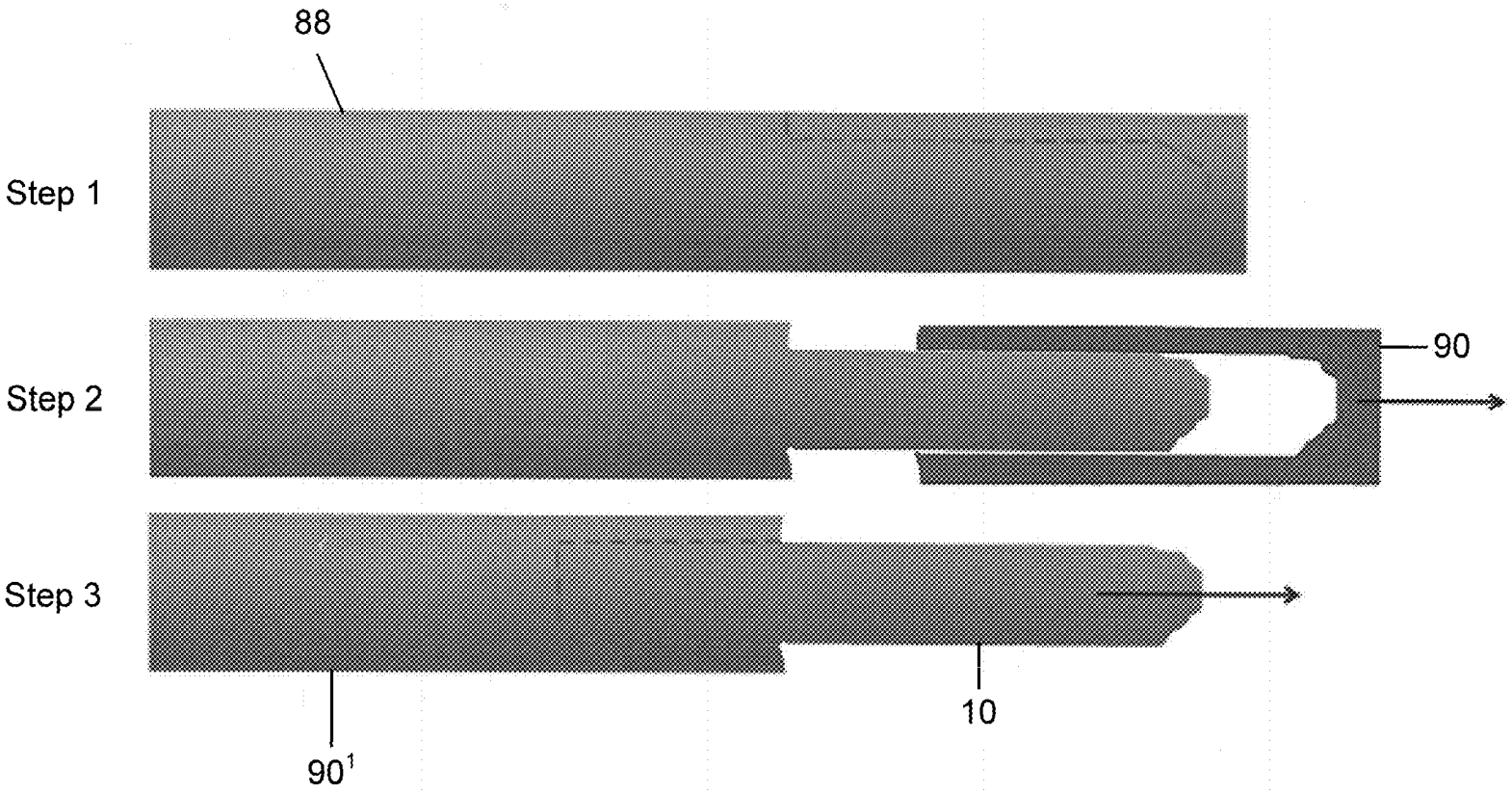
FIG. 18 shows an example of multistep patch cutting in accordance with an embodiment.

As shown in FIG. 18, a patch 10 may be cut using a multistep process. For example, a patch 10 be partially cut from the material 88 being processed. Excess material 90 may then be removed. Additional cuts may then be made to the form patch 10 from material 88. Excess material 90' may be removed. In some instances the excess material may be removed using a conveyor system, for example, a spool process. In some alternate embodiments, patches may be removed from the material and the excess material may remain on the transportation device after cutting, if present.

In some instances, the cutting device may be used to make cut-outs, engraving patterns (e.g., sipes, decorative designs, logos, trademarks) in patches. For example, the openings depicted in FIG. 2*f*, may be made during the cutting process using a laser source to remove material. Locations of the patches or components may be determined using a location system prior to being altered. Such a location system may be a vision system, a system which identifies position based on pressure, light transmittance, or any other positioning system known in the art.

Figure 19:
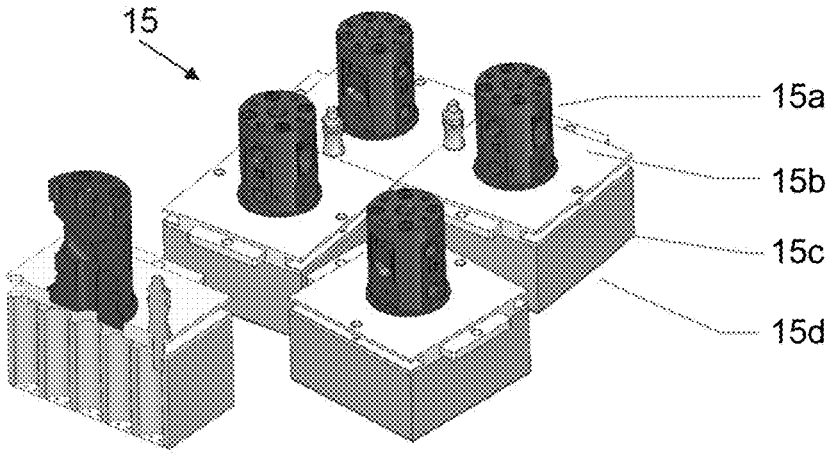
FIG. 19 shows a modular gripping device in accordance with an embodiment.

FIG. 19 illustrates a preferred gripping device 15 for use in embodiments of the invention. The gripping device 15 comprises a plurality of individual grippers 15*a* which can be arranged in a modular manner. This way, it is possible to easily and reliably process all kinds of patches 10, regardless of their composition, material and shape. In the embodiment of FIG. 19, so-called "Coanda grippers" known in the art are employed. Coanda grippers utilize the principle of the coanda effect, which is the phenomena in which a jet flow attaches itself to a nearby surface and remains attached even when the surface curves away from the initial jet direction. In free surroundings, a jet of fluid entrains and mixes with its surroundings as it flows away from a nozzle. By mounting each gripper 15*a* on an adapter plate 15*b*, it is possible to flexibly arrange multiple grippers 15*a* to form a desired gripping device 15. Preferably each gripper 15*a* is further equipped with a flexible foam element 15*c* to allow the device to pick up and place the patches 10. FIG. 19 also shows a silicone membrane 15*d* below the flexible foam element, which may be used to protect the foam from the heat. In addition, the silicone membrane may be perforated to distribute airflow.

In some instances, the flexible foam element of the gripping device provides a surface capable of transporting patches, as well as parts created from various materials. For example, a gripping device with a flexible foam element is capable of picking up parts and/or patches having an irregular shape and/or materials of varying breathability.

The flexible foam element may be shaped for a particular use. Configurations of the flexible foam element may vary depending on the geometry and/or material of the component, carrier surface, adhesive type, etc. For example, the foam element may be thicker near the point that the foam element engages a component (e.g., a patch, structural element, outsole component, midsole element, a closure mechanism, an electrical component, a sensor, a mechanical component, etc.) and/or near the point that the component that first contacts the carrier surface. For example, the foam element may be a substantially semicircular element constructed such that the apex point of the semicircular foam element corresponds to the engagement point for the component or patch such that when the patch is placed the point of first contact between the patch and the carrier surface corresponds to a centerline or center point of the patch.

Depending on the materials to be positioned, in some instances, it might be beneficial to use a rigid plate on the gripping device.

Grippers may also be selected based on various properties for different parts of the process. Materials to be moved as well as desired application pressures, provision of energy (e.g., heat), desired accuracy in positioning, etc., may all be factored in the selection of a gripper to deliver a material such as a patch or component to its position on an article.

Grippers may include, but are not limited to grippers utilizing friction, for example, clamp grippers, vacuum grippers, (e.g., flat vacuum grippers, Bernoulli grippers, Coanda grippers, or the like), utilizing electrostatic forces, for example, electro adhesion gripper, utilizing adhesion, for example, adhesive grippers such as those using adhesive film, cryogenic grippers, utilizing mechanical fit, for example, needle grippers, and/or combinations thereof.

As an illustrative example, an electro adhesion gripper may also be used. In particular, electro adhesion grippers may be used on 2D elements. Construction of a modified electro adhesion gripper which conforms to shape of a 3D carrier surface may allow for use of such a gripper for placing patches on 3D articles, and in particular shoes.

Figure 23A:
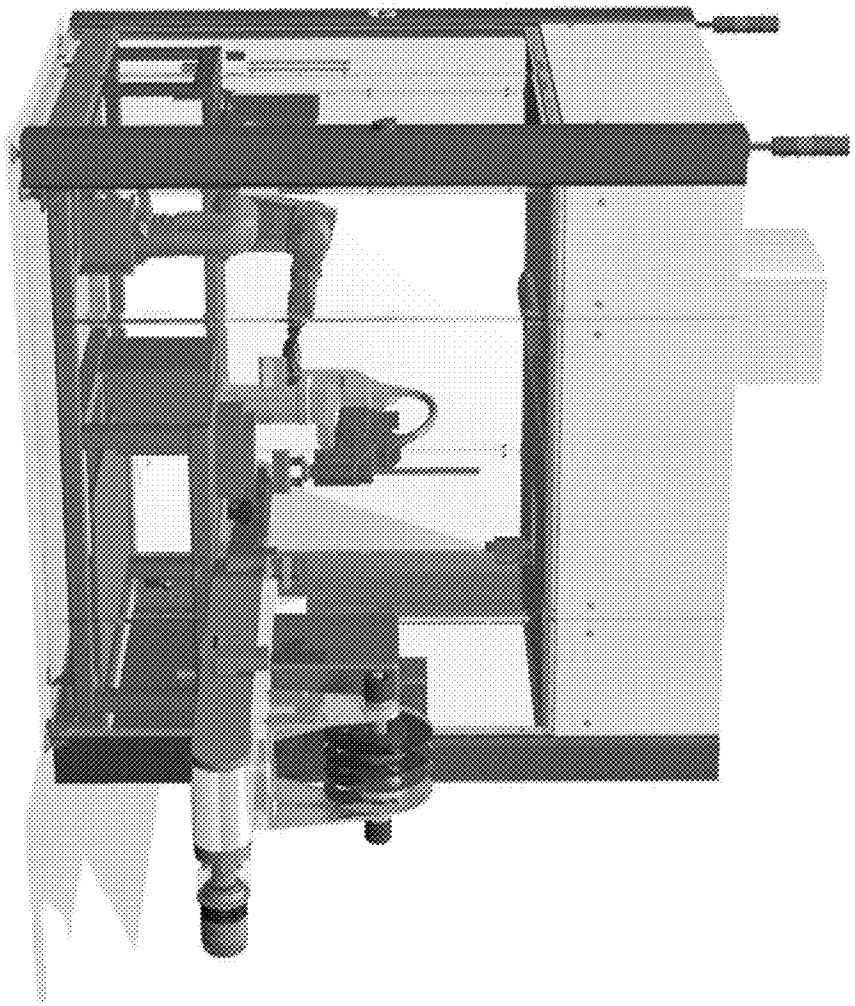
FIGS. 23*a-d* show exemplary production cells in accordance with an embodiment.
Figure 23B:
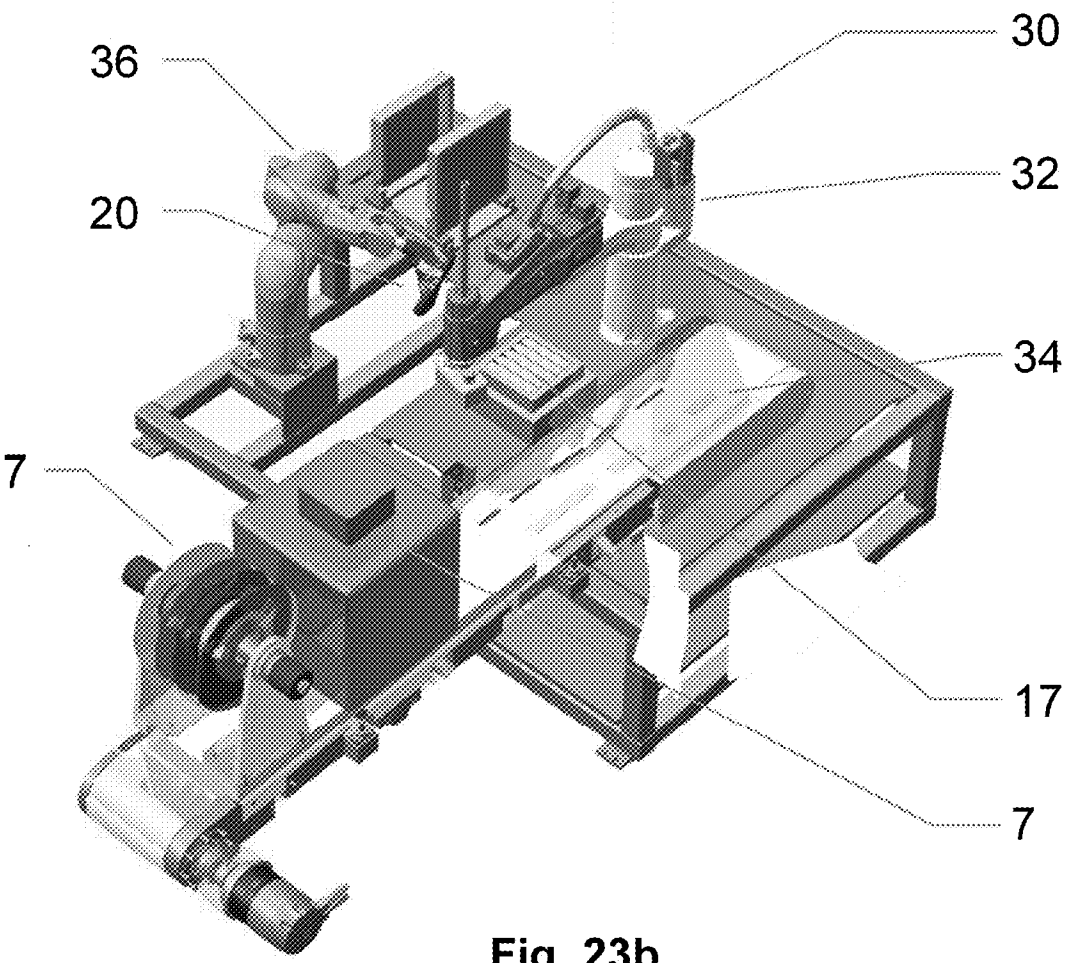

FIG. 23*a* illustrates an illustrative example of an apparatus capable of performing the above-described patch placement methods. FIG. 23*b* is a perspective view illustrating the various components of a so-called "3D cell", since it employs a three-dimensional carrier surface. As can be seen, the apparatus comprises a 6-axis robot 36 to which a last 20 with a pre-arranged base material is connected. Material is unwound from two spools 5 and cut into patches using a laser cutter 7 (see the patches indicated in the pick area 34 in FIG. 9*b*). During the picking portion of the process a vision system 30 may be used to identify components, patches or the like as shown in FIG. 23*a*.

Alternately, parts, for example, patches or components, may be identified and located during the pick process and/or patch process using vision systems, laser scanners, laser optic scanning systems, mechanical gauges, coordinate systems generated based on design files, any method known in the art and in combination with software such as computer aided design software ("CAD") and/or combinations thereof.

The apparatus further comprises a 4-axis robot 32 capable of picking up and positioning parts. Accordingly, the robot 32 picks individual patches 10 from the pick area 34, activates them using an IR lamp array 17, and places them onto the last 20.

Figure 76:
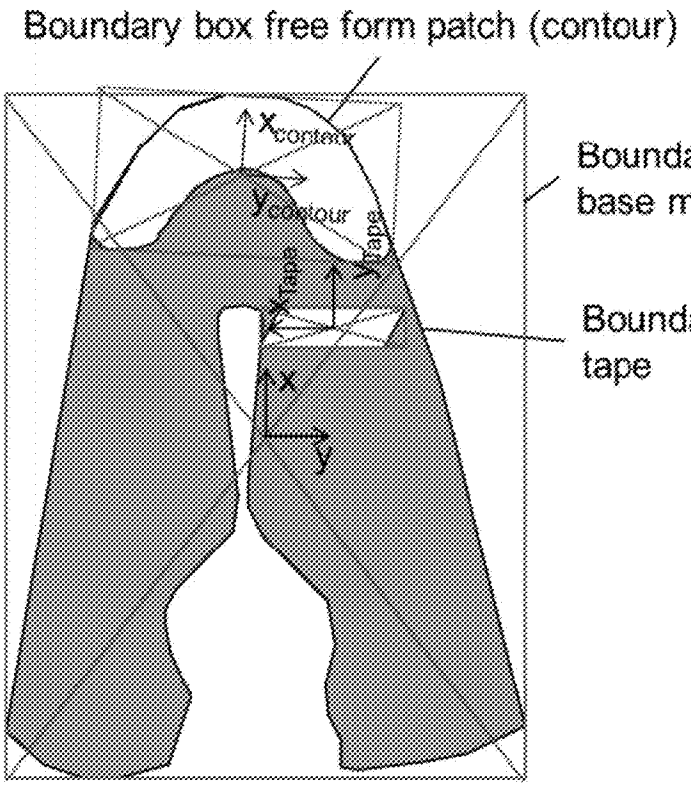
FIG. 76 shows an example of a coordinate system using boundary boxes.

In order to place the individual patches 10 a coordinate system based on the upper pattern generated from the design files may be used and described herein as shown in FIG. 76. The coordinate system is set for every layer of the construction. For example, in the case of an upper, for the base material, as well as all patch materials. A zero point XX may correspond to a center of the boundary box which may define the gripping point for the material. In some instances, the X-axis may be defined as the tape feeding direction. In some instances, this robot may be further equipped with a vision system which is capable to position parts, in particular patches or components.

Alternatively, any robot known in the art or a combination of multiple robots could be used to achieve the same results. For example, a seven axis robot could be used. In other scenarios, multiple robots having less degrees of freedom may be utilized in combination to achieve similar results.

Returning to FIG. 23*a*, an exemplary embodiment of an apparatus for performing an embodiment of a method according to the invention will be further described. As can be seen, the production cell which was already described further above is in one embodiment arranged within an at least partially transparent container, so that the operation of the apparatus can be observed from the outside. In the present embodiment, the walls of the container may comprise glass or Plexiglas or other transparent materials.

Figure 23C:
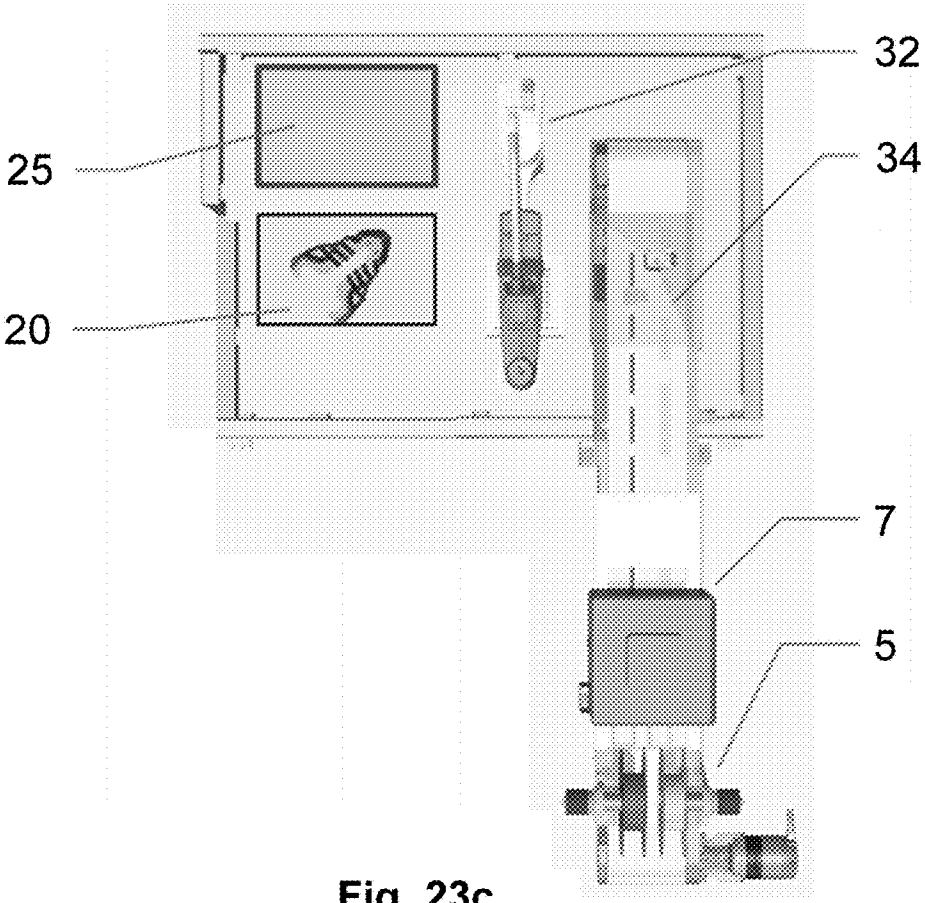

FIG. 23*c* is a top view of an apparatus performing an embodiment of a patch placement process on a two-dimensional carrier surface. As can be seen, similar to the apparatus described above, also the apparatus of FIG. 23*c* comprises spools 5 of material, a laser cutter 7, a pick area 34 and a 4-axis robot 32. Instead of a last 20, however, the apparatus of FIG. 23*c* places the patches 10 onto a flat carrier surface, namely a base textile 20. Also shown is the flexible membrane 25 mounted on a frame, which serves for consolidating the components, as described further above.

Figure 23D:
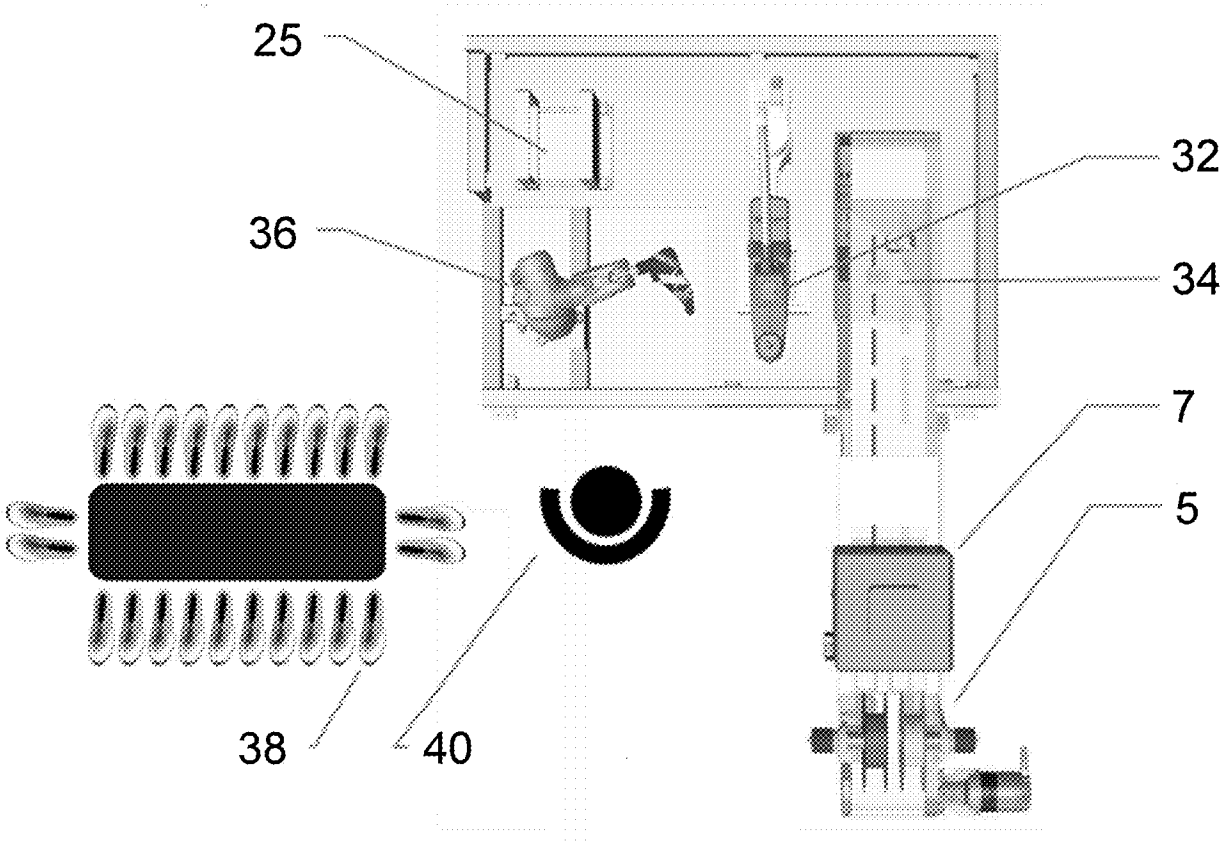

FIG. 23*d* is a top view of another apparatus performing an embodiment of a patch placement process on a three-dimensional carrier surface. Also here, the apparatus comprises spools 5 of material, a laser cutter 7, a pick area 34 and a 4-axis robot 32. Further, the apparatus comprises a 6-axis robot 36 which is capable to pick up a last 20 from a last magazine 38, which is then used as carrier surface 20. Also shown is a pre-shaped flexible membrane 25, as described further above, as well as a human operator 40.

Additional elements may be added to the "patched part" prior to and/or after consolidation. Such elements may include components which are produced on site, on the line and/or pre-constructed components. The elements may include components that are formed by molding (e.g., heel counters, cages, support structures), outsole components (e.g., stud, lug, outsole elements), eyelet reinforcements, closure mechanisms (e.g., laces, lacing structures), structural elements (e.g., tubes, bands) and/or other components useful for the "patched part".

Figure 20:
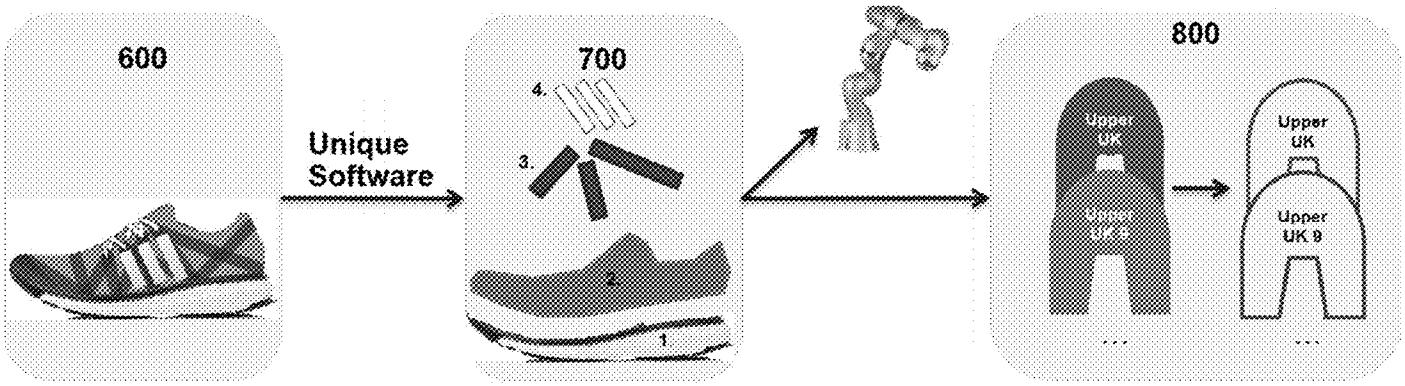
FIG. 20 shows an automated computer-aided "idea to production" process in accordance with an embodiment.

FIG. 20 illustrates an embodiment of an automated computer-aided manufacturing process according to the invention. As can be seen, a design specification of the sporting good to be manufactured is first provided in step 600 in the form of a design file, for example, a CAD file, in particular, in DXF, ASCII, or any other format known in the art.

A design file is created for each article model, for example, a shoe model. Design files in general will be created by the designer of a shoe. The design file sets out all possible combinations for a particular shoe design. For example, the design file may include specifications for shoes, such as shoe sizes, constructions, patch sizes, component sizes, coordinates for positioning parts such as patches, components, etc., or the like, and combinations thereof.

Figure 24:
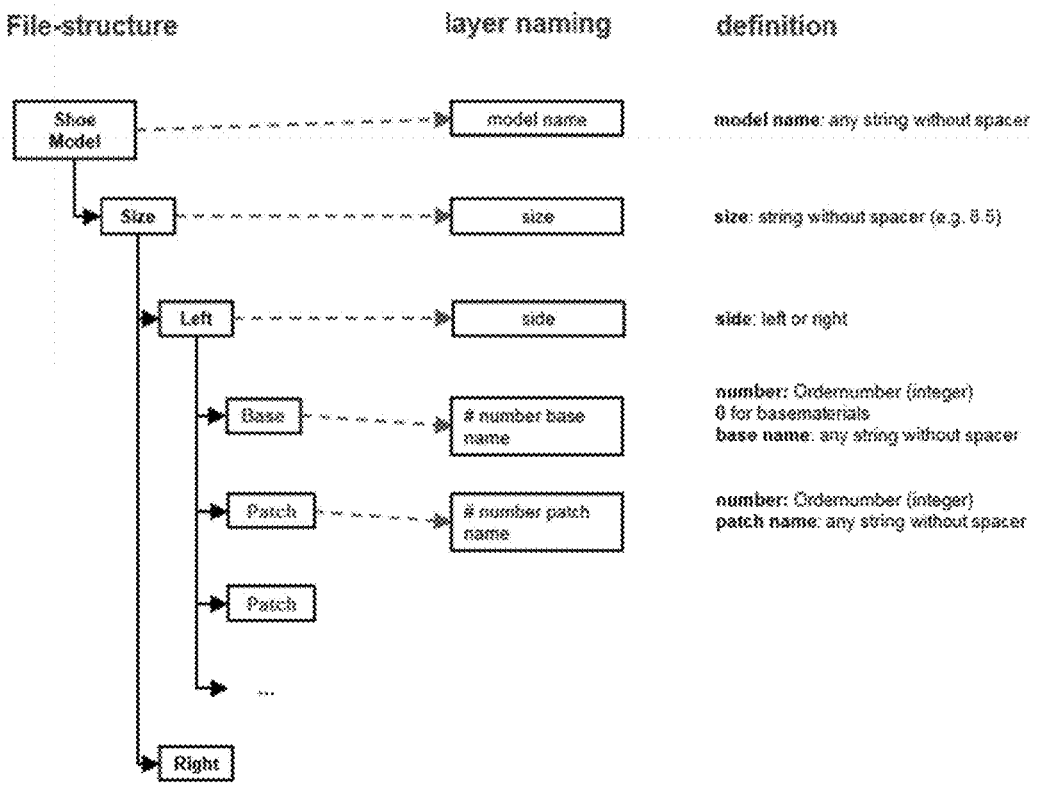
FIGS. 24-26 show exemplary design files in accordance with some embodiments.

A design file is preferably a multilayer file capable of defining many or all elements of the article to be constructed. As an illustrative example, FIG. 24 depicts a DXF file of a shoe. Each layer in the file defines the shoe with more specificity. The shoe may be defined as a model name, article number or the like. Size may be defined according to the dimensions of the standard sizes used in the art. Side may refer to which shoe it is, that is left or right.

Figure 25:
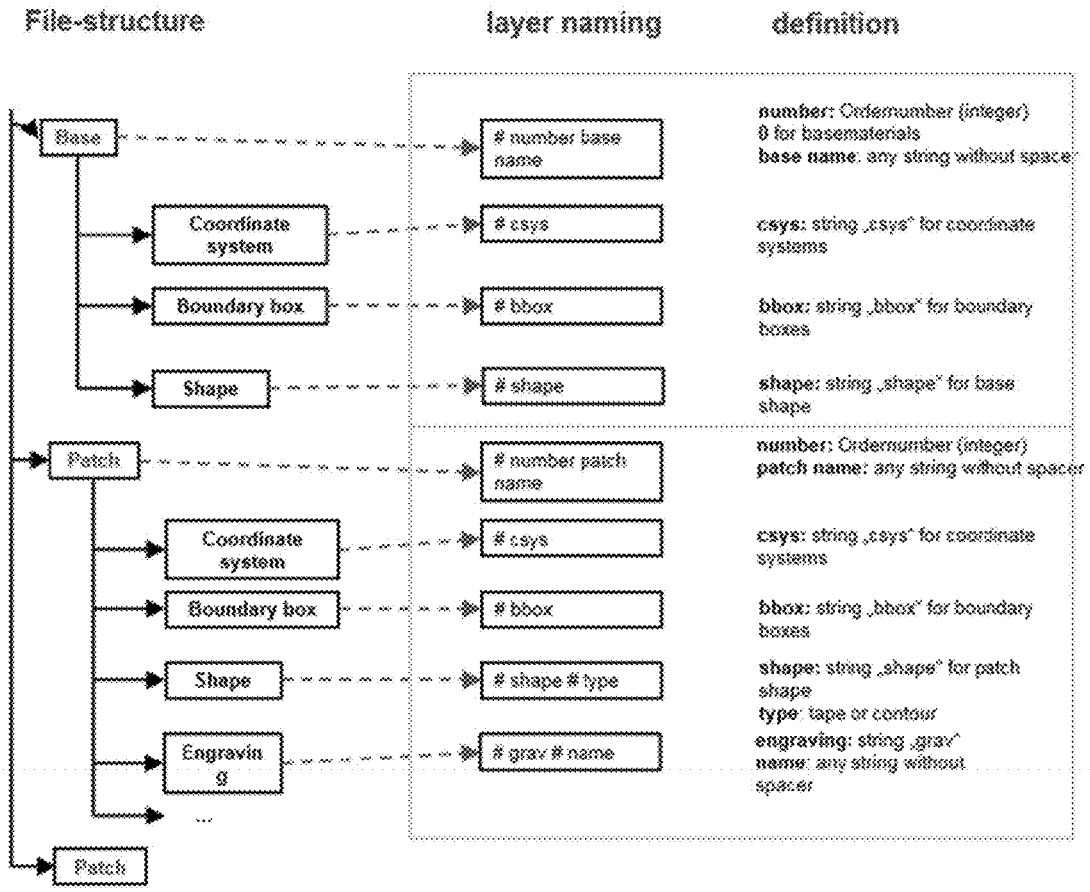
Figure 26:
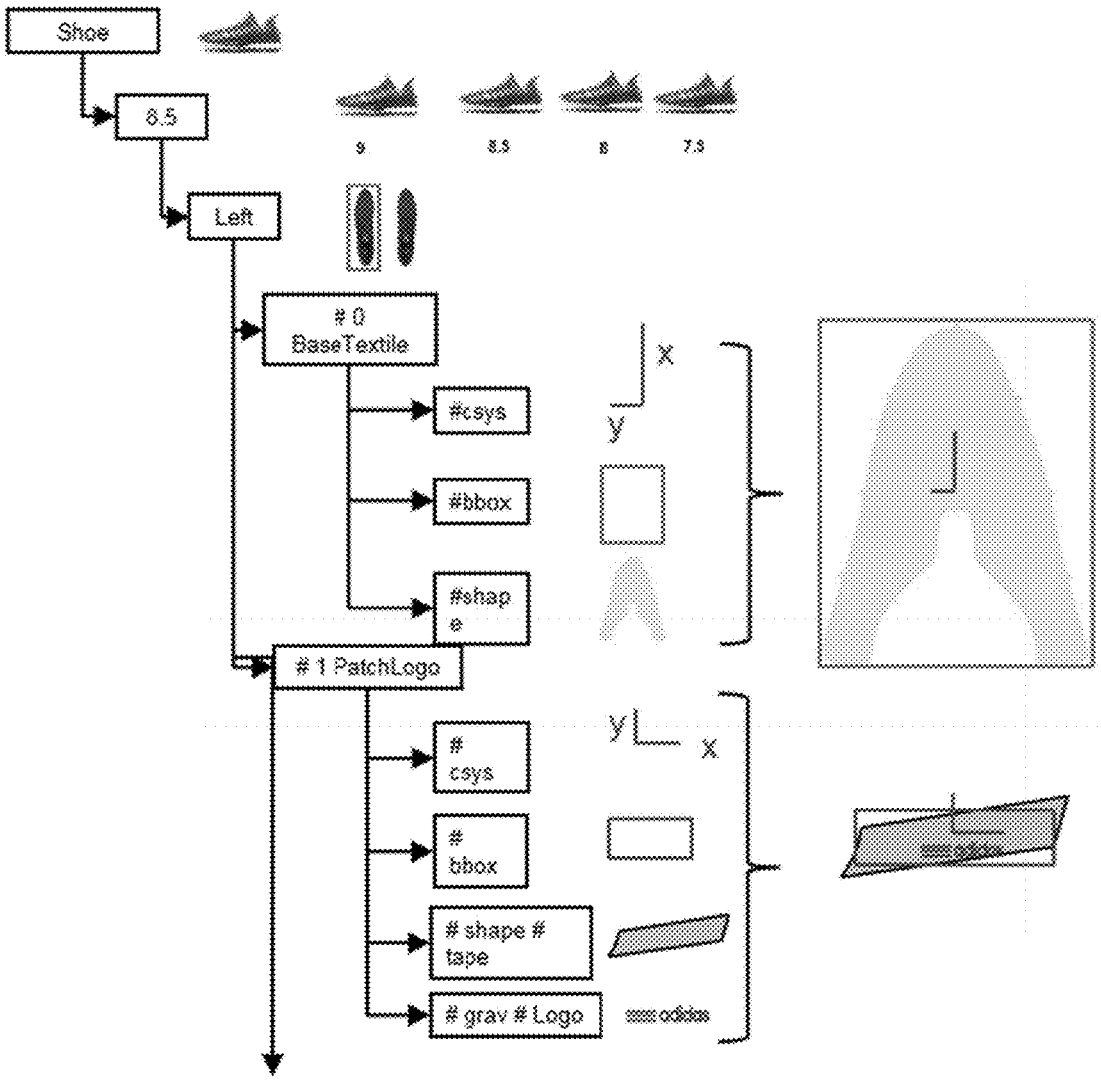

FIG. 25 depicts a more detailed view of the levels in the DXF file. Each shoe is defined by various levels or components, for example, a base material, patch 1, patch 2, etc. Each component part of the shoe may be assigned a coordinate system as well as a boundary box (as shown in FIG. 76), shape, and/or logo or the like which is shown in FIG. 26.

The design specification contained in the design file preferably comprises one component per design layer and a layer structure related to the chronological assembly order. A software program then translates the CAD file into a production plan in step 700. In FIG. 20, the production plan is reflected by the numbered individual shoe components to be assembled (i.e., the outsole, the upper, a first type of patches 10 and a second type of patches 10). In particular, the assembly order may be automatically defined by the software. The production plan may also be used in step 800 to automatically teach the robot(s), vision systems, etc. described further below.

For example, a designer may develop a design for a shoe using two and/or three dimensional design software such as Adobe Illustrator, Maya, Modo, Rhino, CAD or any other design software known in the art.

In some instances, a design file may be converted to a geometry file using a converter software. The converter software may determine patch length, orientation to ensure correct positioning. The converter software may help enable the use of vision and/or positioning systems. For example, as a converter software a vision software such as Halcon may be used. Software may be used to convert data from the DXF file into a usable format. For example, data stored in the DXF file may be used to create identify patterns and recreate them on the article to be patched. Geometry files may define the shoe in terms of the construction using patches and positioning.

Figure 27:
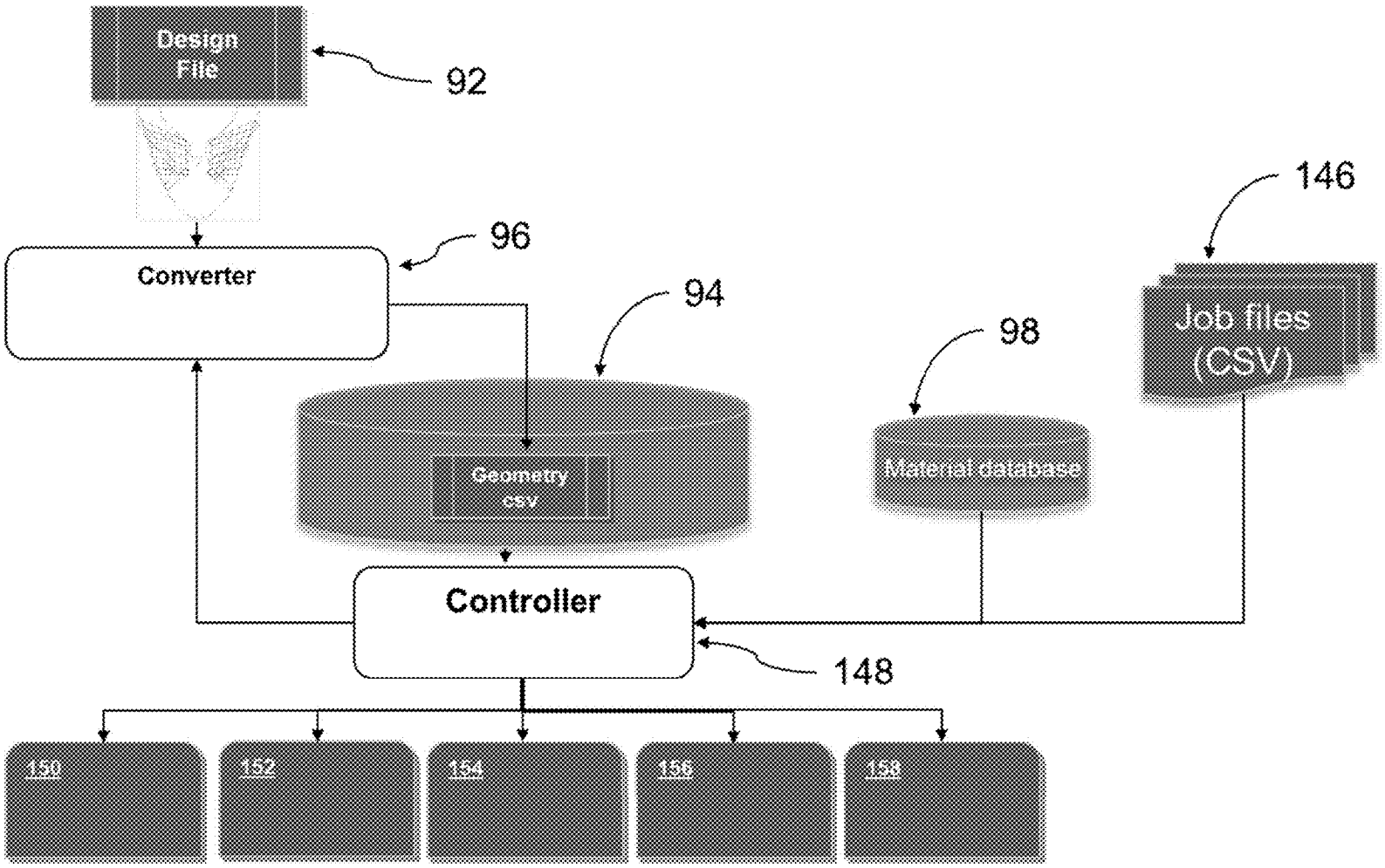
FIGS. 27-33 show illustrative examples of algorithms for producing an article in accordance with some embodiments.

An illustrative example of an algorithm for producing an article is shown in FIG. 27, in particular, for a shoe using a 2D placement of materials. Design file 92 may be a DXF file which includes the specifications for a shoe model across multiple sizes. The geometry file is converted with converter software 96 to a geometry file 94. Information derived from the geometry file, the material database 98, and the job file 146 is provided to a controller 148 (e.g., a machine controller). The controller 148 controls various systems necessary for the production of the article. For example, material acquisition 150 (e.g., where the material is stored), material delivery 152 (e.g., unwinding of materials, delivering materials from the storage location to the location needed), processing 154 (e.g., cutting), tracking 156 (e.g., vision systems), positioning systems 158 (e.g., robots), or other systems known in the art. In particular, the controller 148 may send information, instructions, and/or queries to any of the systems relating to the construction of the patched shoe.

In some instances the machine controller compares target information received from a job file (e.g., design data) with actual data. That kind of data will be collected by a sensor unit controlled by the machine controller, such as the camera system. Any sensor unit capable of determining position (e.g., visual, pressure, etc.) may be used to collect the actual data related to the position of the patches, components, carrier surfaces (e.g., lasts or uppers) or a combination of parts. The comparison will be used to modify the assembly procedure of the upper pattern periphery to allow for a more complete and accurate geometry file 94 to accommodate any distortions or deformations that may have been caused throughout the patching process to ensure all subsequent patches are accurately placed.

Figure 28:
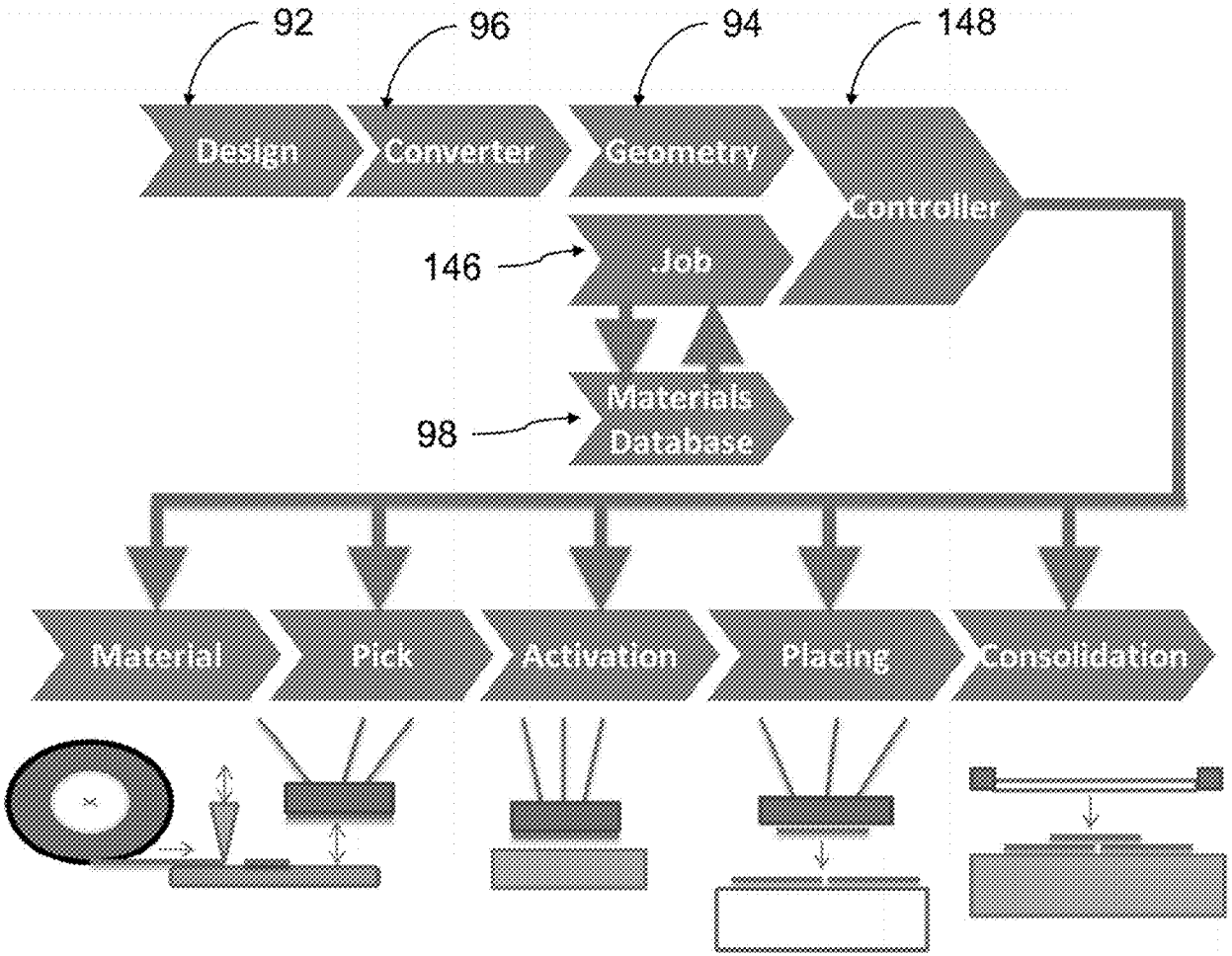

A further illustrative example, as shown in FIG. 28, shows job file 146 extracting data from material database 98 to provide information to controller 148. Further, the geometry file 94 and/or a job file 146 may provide information to the controller to fully define a shoe, for example, providing a complete description of the shoe including, geometry information, 3d information, and color and/or materials specifications such that the controller can direct the various elements of patch process. Information from the controller 148 may be provided to the various machine elements or controllers involved in the various steps of the patch process as depicted in FIG. 28, such as material (e.g., unwinding and cutting of material), pick (e.g., retrieving the patches), activation, placing, and consolidation.

Geometry files, job files, and/or the material database may be one or more files including but not limited to DXF-files, XML-files, text based such as text files, documents, spreadsheets, databases, or any system known in the art.

Job files may be created by any party, for example a designer, a customer, a user, a coach, or anyone having an interest in customizing an article such as a shoe. Job files may be created using user interfaces, such as text based interfaces, for example, text files, spreadsheets, word processing documents, graphical user interfaces, such as human interface devices computers, keyboards, pointing devices, mice, pointing sticks, touchpads, trackballs, joysticks, etc., projection technologies (e.g., virtual projectors, virtual keyboards, virtual screens, heads-up displays), virtual reality devices, and/or combinations thereof.

Choices for the user that are available when constructing the job file may be limited by the system used to create them, in particular, the design files available within the system, as well as the materials specified within the system, the design files and/or the material database used to create the job file.

During creation of the job file, users may be directed to select, for example, a specific model, size, materials, colors, labels, components, design elements, etc. For example, a user may utilize a computer interface at home, in a store, in a stadium, at a tailgate party, etc., to design a shoe based on their specifications.

Users may be able to select from styles, components such as stability elements, heel counters, toe boxes, outsoles, cleats, traction elements), stretchability elements, stiffness elements, cushioning elements, sizes, materials, colors, etc. to form a desired article.

Figure 29:
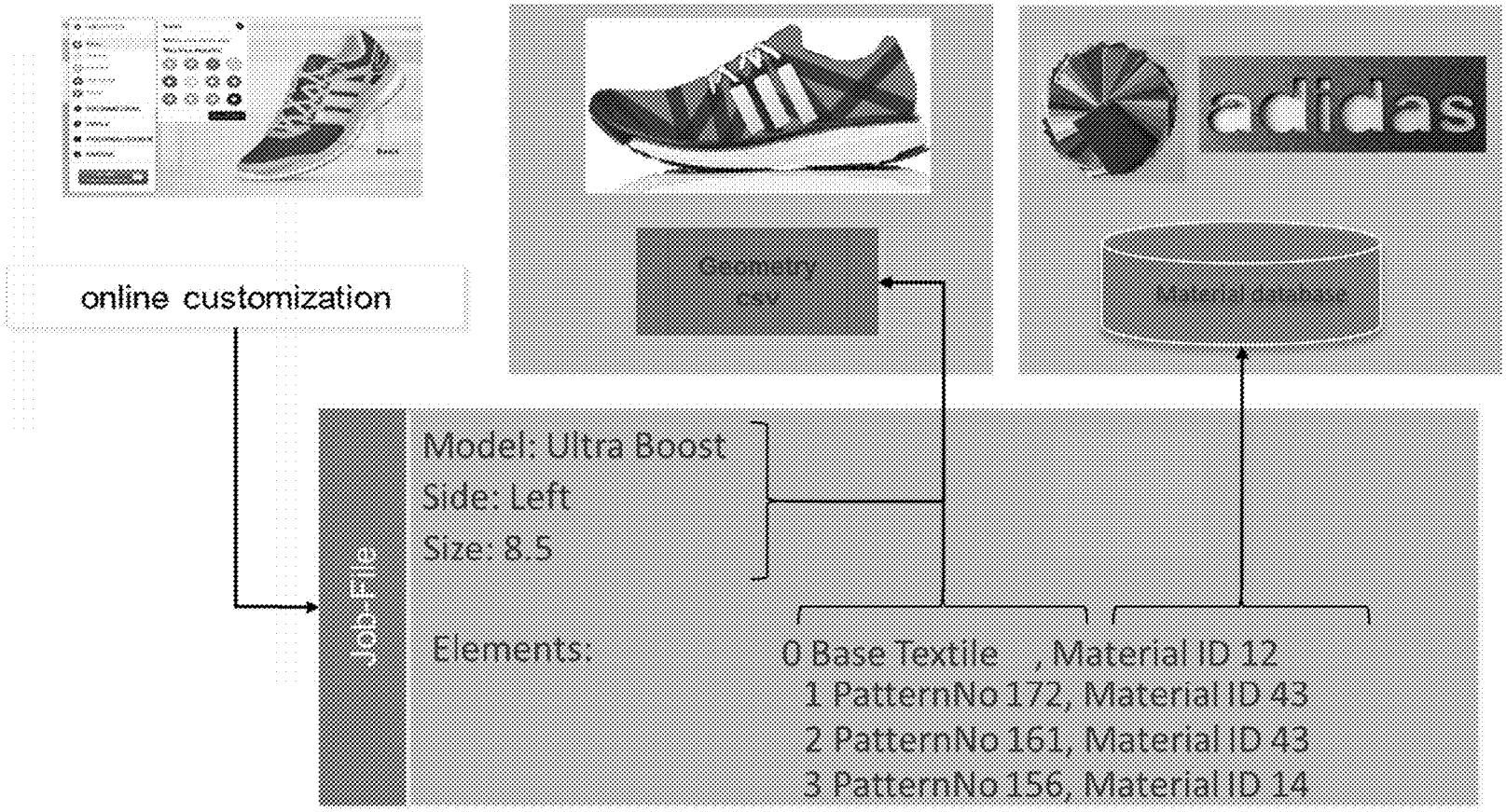
Figure 30:
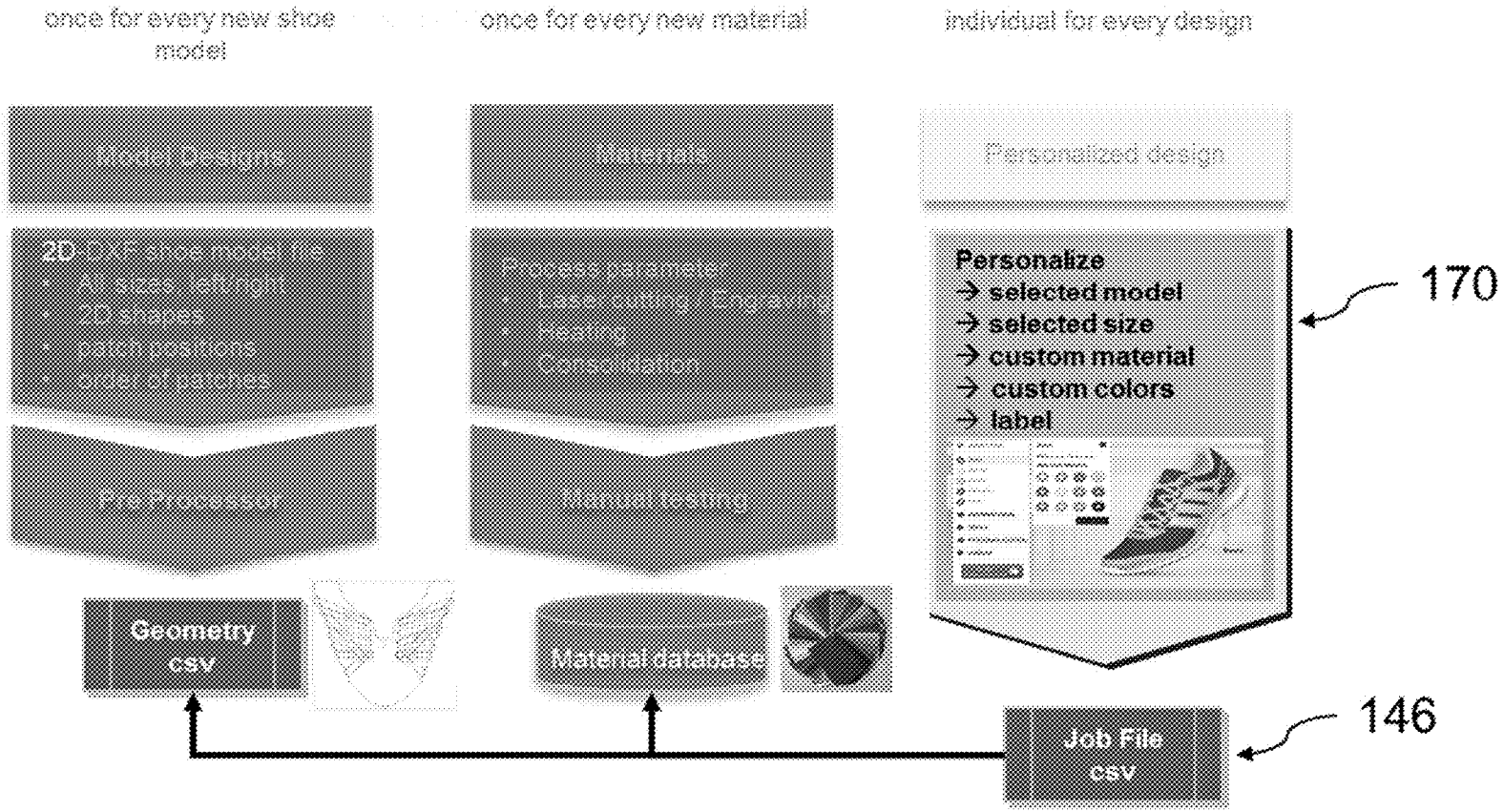

As depicted in FIGS. 29-30, user selections stored in the job file may be used to retrieve data from the geometry file and the material database that corresponds to the selections contained in the job file.

The material database includes various processing parameters for the various materials contemplated for use in one or more design or design files. The values found in the material database may be from specification sheets, however, in part may be manually tested and entered for each material. For example, a temperature and length of time based on a particular laser needed to laser-cut a patch material may be determined and entered into the material database for reference at a later point. Materials in the database may be identified by the shape they have (e.g., tape, foil, strand, etc.), the material type (e.g., a key code may be assigned), color, thickness, width, etc. Using this material ID will allow the respective processing conditions to be retrieved from the material database.

As shown in FIG. 29, materials used in an article may be assigned a material ID generated using both the job file as well as the geometry file. This material ID may include, for example, a shape, material, color, thickness, width, etc. This material ID may be provided to the material database shown in FIGS. 27-33 to determine the processing conditions for the material. For example, the material database 98 may include information on laser cutting (e.g., power, speed, cycles, focus position), infrared heating (e.g., power, duration, distance, etc.), consolidation (e.g., temperature, pressure, duration, etc.) and/or any other process needed to create the article.

The material database, for example, provides information relating to the process parameters for the various materials, for example, when unwinding materials, laser cutting materials, identifying materials using vision systems, placing materials using robots, as well as various other process parameters related to handling the selected materials during construction of an article. Information in the material database may in some cases be the result of manual testing of materials under conditions similar to those used in the construction of the shoe, for example, during welding, cutting, positioning, consolidation, etc.

Figure 31:
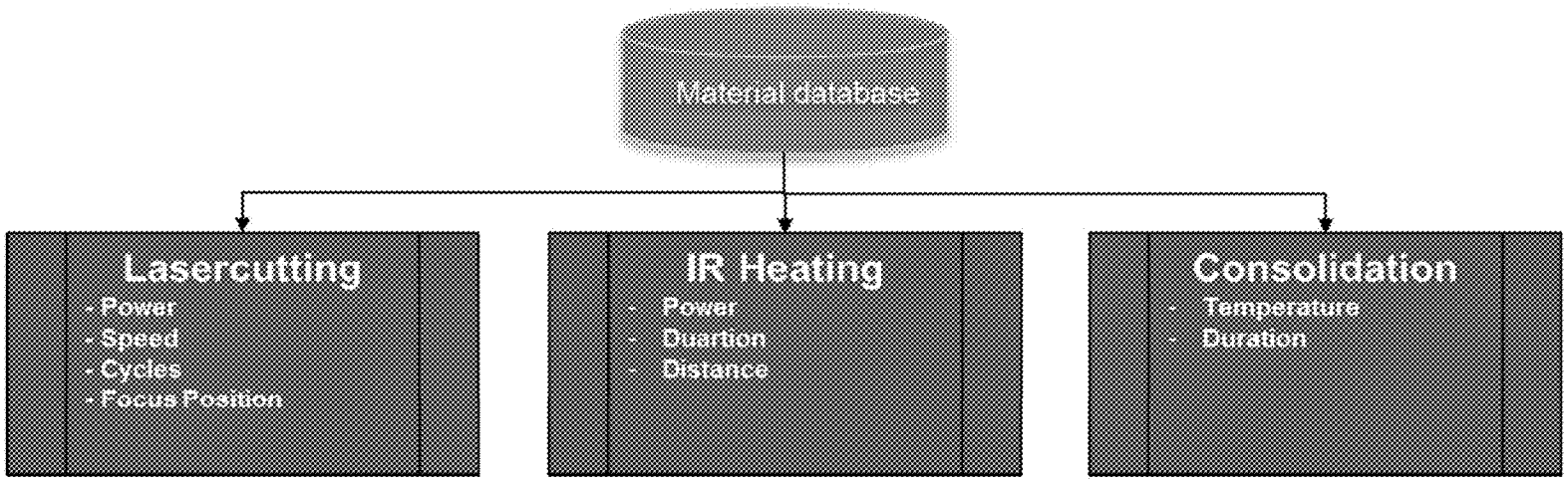

As illustrative examples, FIG. 31 lists processes such as laser cutting, infrared heating, and consolidation. For a process like laser cutting the material database would be able to provide information relating to power of the laser, speed of the laser, number of cycles, focal positions for the laser specific to the materials of interest, etc. For an application, such as infrared welding the material database would be able to provide processing conditions such as the power to be supplied by the infrared source, the duration for which that power should be supplied, a distance from which an infrared source should be placed from the material to be activated, number of cycles, an area of the material that should be activated, how focused the energy from the infrared source should be and/or other data relevant to IR heating. Further, the material database may outline temperatures, durations, pressures, number of cycles that may be necessary for consolidation of the specified materials to occur.

Figure 32:
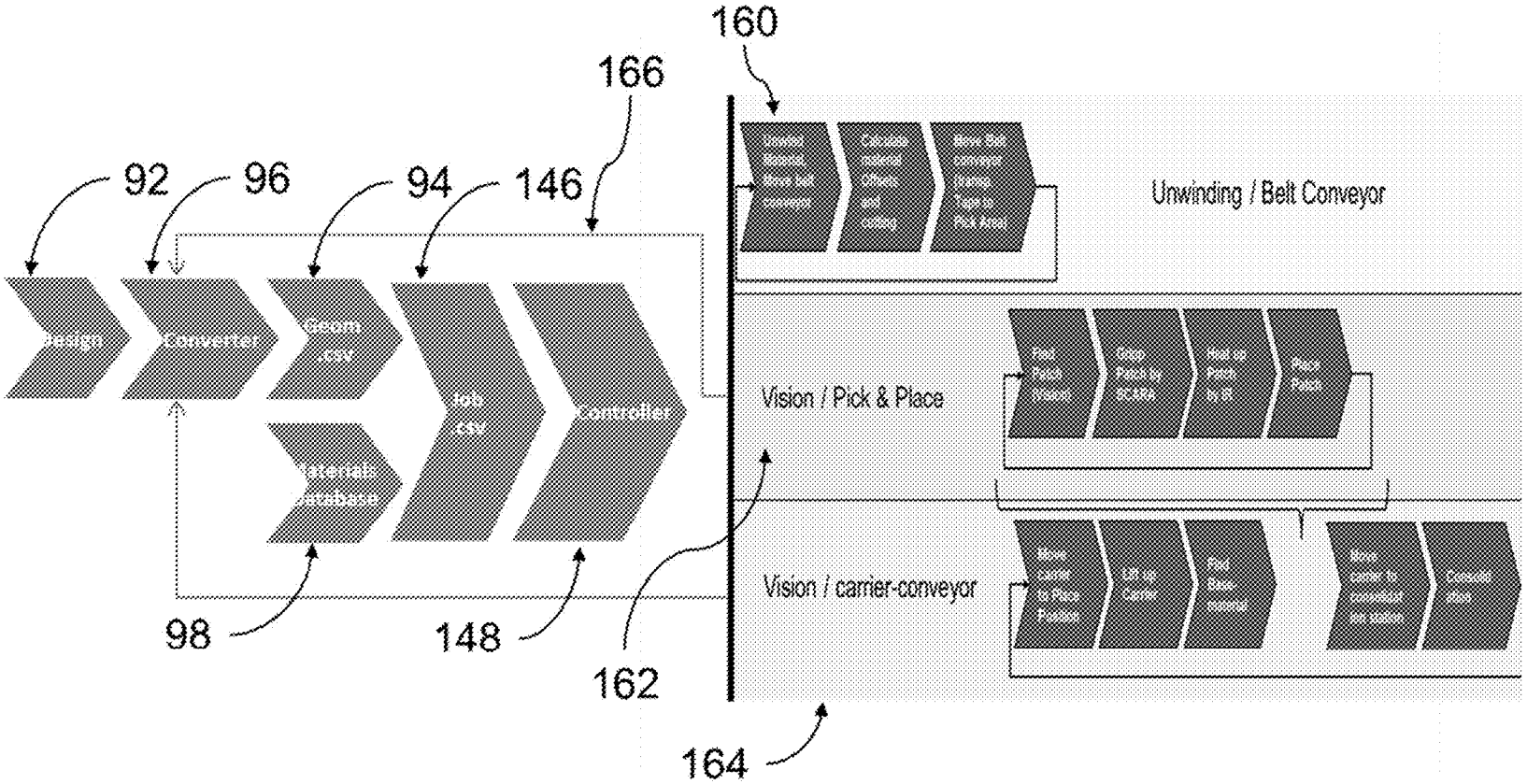

FIG. 32 depicts a more in depth view of the interaction between the files (e.g., design files 92, geometry file 94, job file 146, material database 98, the converter software 96, the controller 148, and the systems that are used to execute the patch placement process. As an illustrative example, individual instructions that the controller 148 might deliver are indicated arranged by the system which may receive such an instruction. For example, an unwinding unit and/or transportation device such as a belt conveyor may receive instructions 160 to unwind the material, move the belt conveyor, calculate material offsets, cut, move the belt conveyor, and transport tape to a predetermined location. Identification systems may include a vision system as shown for the picking of the patches and placing of the patches and receive instructions 162, including but not limited to instructions to find a patch, pick up a patch (e.g., grip). Information collected by the identification system or more specifically, a vision system for pick and place, may in part be provided to the converter software via a feedback loop as shown. This information may, in some instances, be routed and/or process by the controller prior to reaching the converter software as feedback 166. Further, instructions 164 to the carrier and/or conveyor may include, for example, instructions to move a carrier to a position, lift the carrier to a specific height, find the base material, etc. Feedback 166 may also be provided to the converter software relating to the results of the instructions 164.

Thus, customization of any article designed may be possible, including relating to construction. For example, a customer may be able to access a customization tool, such as an online tool, application ("App"), store based customization tool, and/or combinations thereof. Based on the design of the article, a customer interface may present multiple variables to be specified. In particular, FIG. 30 depicts a process for creation of a customized shoe for a user. A system user may use an online tool 170 to specify particular elements for the shoes and thus creating a job file. As shown in FIG. 30, a user may select a model, size, left or right and the elements that are needed in each shoe. Using the user specified data a job file 146 is created, for example, a file such as customer.csv.

As an illustrative example, if desired an individual, such as a coach, manager, and/or trainer may be able to enter data to a job file regarding multiple shoe orders for a team from, for example, a database or spreadsheet, to ensure that the design remains similar across the shoes, while allowing for adjusting the shoes for the individual needs of the players with respect to position played, orthopedic considerations, physical requirements, or the like and/or combinations thereof.

In this manner, a team may have a uniform look for example with respect sporting good articles, for example, shoes, uniforms, head gear, protective gear, while still accounting for the individual needs of a player, runner, swimmer, rider, skier, etc.

In some instances, in particular for shoes, selections may be made based on the conditions or problems a user has or experiences and/or scans of the user's foot. For example, for any given shoe there may be predefined solutions for common foot and/or orthopedic problems, for example, flat feet, metatarsalgia, over-pronation, under-pronation, hammer-toes, blisters, bunions, corns, calluses, heel spurs, claw and mallet toes, ingrown toenails, plantar fasciitis, etc.

Thus, in some instances scans of a body part, for example, a foot may be used to match components or designs to the user. Scans may be conducted on-site or provided by an external source.

In addition, in some instances conditions and/or limitations of an athlete may be used to determine components, constructions and/or patches for an article based on the input of doctors, physical therapists, occupational therapists, and/or trainers to best select materials, constructions, and/or designs for the athlete.

In particular for a shoe design, a designer may use a 3D design application to create the design utilizing a predefined 3D digital surface to define a digital last of the shoe. In some instances, lines drawn in this application may be used to direct cutting of materials, for example, patches, place materials and/or other parts. For example, the designer creates parts virtually using design lines. The 3D design software may create virtual representations of the shoe and/or materials used therein. Design files and/or job files may be automatically generated by the 3D design program. Job files may be used to instruct various robots, digital devices, mechanical devices, and/or combinations thereof to generate the shoe.

In some instances, sporting goods, such as a shoe and/or elements of the shoe may be constructed and then used to instruct the system to produce a patched object. For example, a base shoe shape may be supplied, as is usual, by a shoe designer maker or a stylist using conventional techniques, or be an otherwise classical shape in the industry. Data relating to the shoe and/or shoe elements may be collected in digital form about shape, size and/or configuration of the parts.

For instance, a surface of a base shoe shape is accurately 3-D scanned to obtain spatial coordinates xB, yB and zB of each point on its surface. These coordinates may be collected using vision systems, laser scanners, laser optic scanning systems, mechanical gauges or any method known in the art and in combination with software such as computer aided design software ("CAD").

For example, a mechanical gauge may be run across the true surface of a base shoe shape along paths that allow the shape of the shoe shape to be accurately re-constructed. The gauge is essentially a mechanical type of gauge controlled by a computer on which CAD simulation programs are run.

A base shoe shape is therefore digitized, or rather, reconstructed in a digital format using a 3D CAD data gathering technique. In all cases, the outcome of this data gathering step is a data file that can be analyzed in a 3D CAD setting. The surface of the base shoe shape, as re-constructed in digital form, can be retouched by means of the CAD program.

Further, shapes of sporting goods, such as a base shoe shape already available in a digital format for CAD processing could also be used. For example, the data about such a shoe shape could be retrieved from a storage unit connected to or associated with said computer means. Alternatively, the data could be retrieved from external or bulk memories, e.g., from a database.

Figure 33:
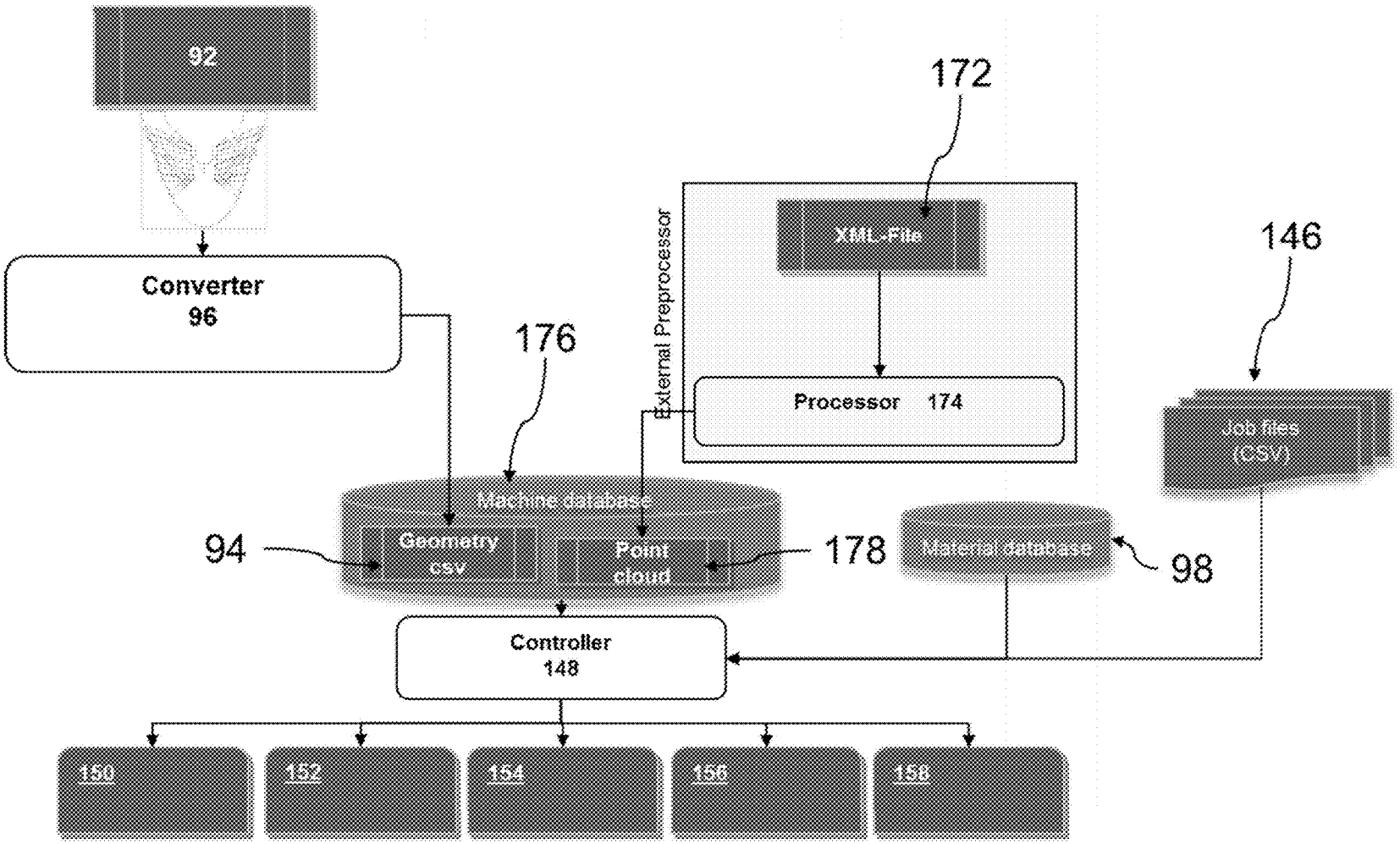

As shown in FIG. 33, information from the design files 92 may be combined with information from a material database 98 and/or a job file to fully define a shoe, for example, providing a complete description of the shoe including, geometry information, 3d information, and color and/or materials specifications.

FIG. 33 depicts an illustrative example of an algorithm for producing an article, in particular a shoe using a 3D placement of materials. In particular, FIG. 33 depicts a system that operates without a vision system for placing the materials. Design file 92 is a DXF file and may be used in combination with a control file 172, such as an XML file. The design file includes the specifications for a shoe model across multiple sizes. The design file may be converted using a converting software 96, such as Halcon to a geometry file. The control file (e.g., a XML file) may be converted using a processor 154 to generate a point cloud 178 using a simulation of the process of constructing the shoe as a confirmation of the calculations. The point cloud 178 identifies locations of the robots for positioning of the patches and/or components on an article, such as a shoe.

Information derived from the design file 92 and the control file 172, for example, the geometry file 94 and the point cloud 178 may be used to create a machine database 176. Information from the machine database 176, the material database 98 and the job file 146 is provided to a machine controller 148. The machine controller 148 controls various systems necessary for the production of the article. For example, material acquisition 150 (e.g., where the material is stored), material delivery 152, (e.g., unwinding of materials, delivering materials from the storage location to the location needed), processing 154 (e.g., cutting), tracking 156 (e.g., vision systems), positioning systems 158 (e.g., robots), and/or other systems known in the art.

As an illustrative example, the point cloud may specify locations at which two robots, in particular a 6-axis robot and a selective compliance assembly robot arm ("SCARA" robot) meet to enable patch placement. For example, a file generated may include the 3D target points. 2 points per patch (i.e., 1 target point for the SCARA robot and 1 target point for the 6-axis robot). In some instances, the target points may be recorded with respect to the coordinate system of one robot. For example, the target points for the SCARA robot may be written with respect to the co-ordinate system of the 6-axis robot. Simulations of each size, design and/or shoe may be conducted to ensure that the point cloud is accurate. The controller 148 controls how the robot move to the target points. The trajectories developed by the controller 148 may be confirmed using simulation software.

In some instances utilizing a processor connected to a vision system may be utilized to ensure proper cutting and/or placement of materials. For example, converting software on a processor may interpret geometry files, for example, a DXF file in order to create and/or place patches and/or components. Creation and/or placing of the patches may require additional information from both the job file and/or the material database.

For example, one or more robots may utilize the data from the converted files to determine what actions must be taken to construct an article. In particular, robots may derive information relating to what materials to cut to make patches, the geometry of the patches, where the gripper component should be moved, how much vacuum should be used to pick up a particular part, what materials should be picked up, locations of the materials, where the materials should be deposited, etc. Further, a cutting device for cutting patch materials and/or other components may be controlled using the data provided in the converter software. In some instances, the cutting device will be a laser cutter. Other examples of a cutting device include, but are not limited to laser cutting, cutting dies, plasma cutting, water jet cutting, knives, etc.

Identification systems may be used to locate, identify, and/or position parts. For example, identification systems may include vision systems, such as systems utilizing machine vision and/or computer vision, laser scanners, etc. Methods utilized to locate, identify and/or position parts may include, but are not limited to stitching (i.e., the combining of adjacent 2D or 3D images), filtering (e.g., morphological filtering), thresholding, pixel counting, segmentation (i.e., partitioning a digital image into multiple segments to simplify and/or change the representation of an image into something that is more meaningful and easier to analyze), in-painting, edge detection, color analysis, blob discovery & manipulation (i.e., inspecting an image for discrete blobs of connected pixels as image landmarks), neural net processing (weighted and self-training multi-variable decision making), pattern recognition including template matching, barcode reading, optical character recognition, gauging, or metrology (i.e., measurement of object dimensions (e.g., in pixels, geometric coordinates, inches, or millimeters)), comparison against target values to determine a "pass or fail" or "go/no go" result, any method known in the art and/or combinations thereof.

Figure 21:
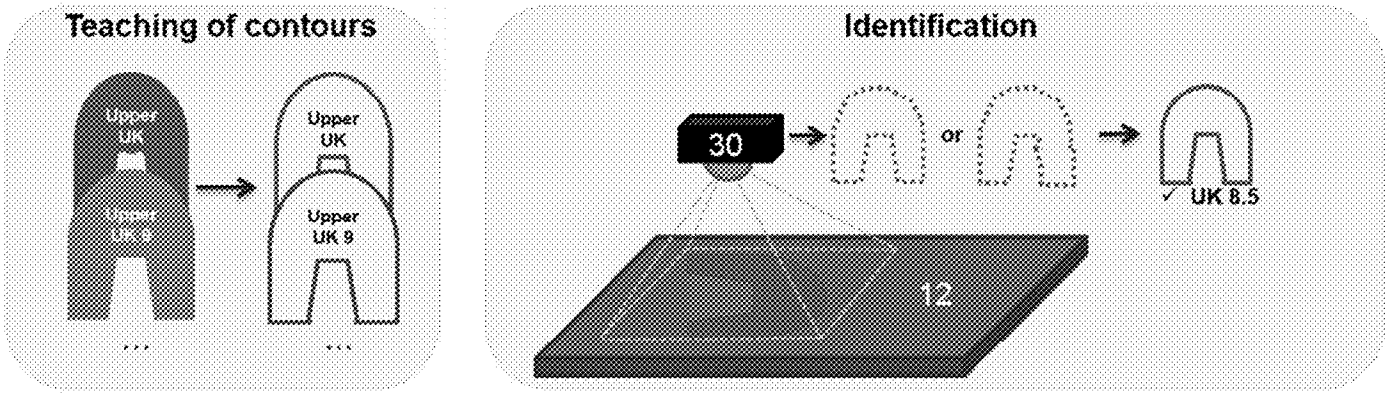
FIG. 21 shows examples of pattern recognition in accordance with an embodiment.
Figure 22A:
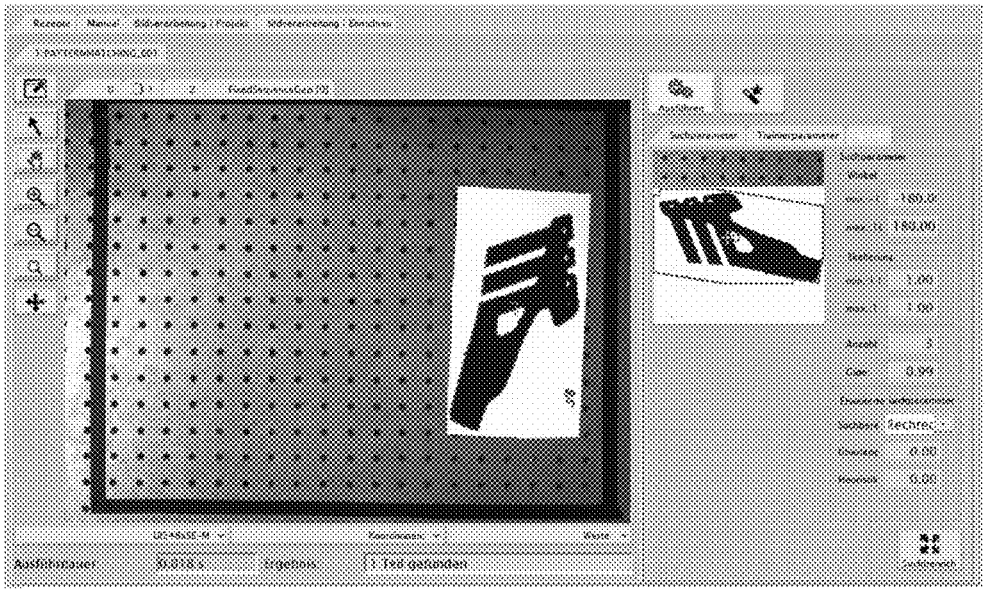
FIGS. 22*a-c* show exemplary graphical user interfaces for pattern recognition in accordance with an embodiment.

In certain embodiments, the software employs pattern recognition as schematically illustrated in FIG. 21. This enables an operator to teach the manufacturing system the contours of the patches 10 to be applied, as indicated in the left half of FIG. 21 (e.g., with a camera 30 and the physical parts 10, or by uploading the CAD file(s)). In addition, during production, even partly distorted parts/patches 10 can be recognized correctly by the system, as indicated in the right half of FIG. 21. As can be seen, a vision system 30 comprising one or more cameras which identifies patches 10 on the conveyor 12 can be used to this end. In this context, FIGS. 22*a-c* illustrate a graphical user interface used for pattern recognition of patches 10 of various sizes and shapes.

Figure 34:
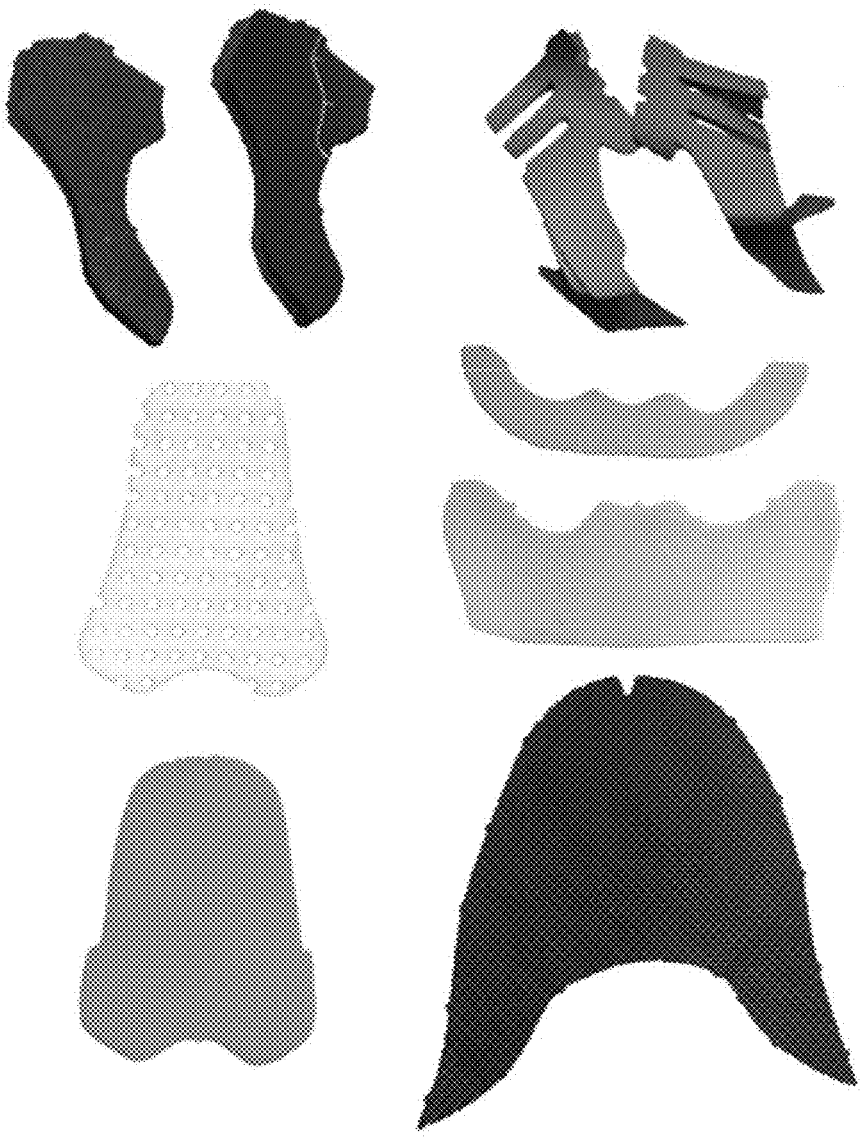
FIG. 34 shows examples of patches in accordance with an embodiment.

Generally, the patches 10 of the invention may be constructed in various shapes, as e.g., illustrated in FIG. 34. Also, various materials are conceivable which can be selected for various reasons including design, quality, utility (e.g., reinforcement, breathability, durability, ease of use), or combinations thereof, as defined herein.

Figure 22B:
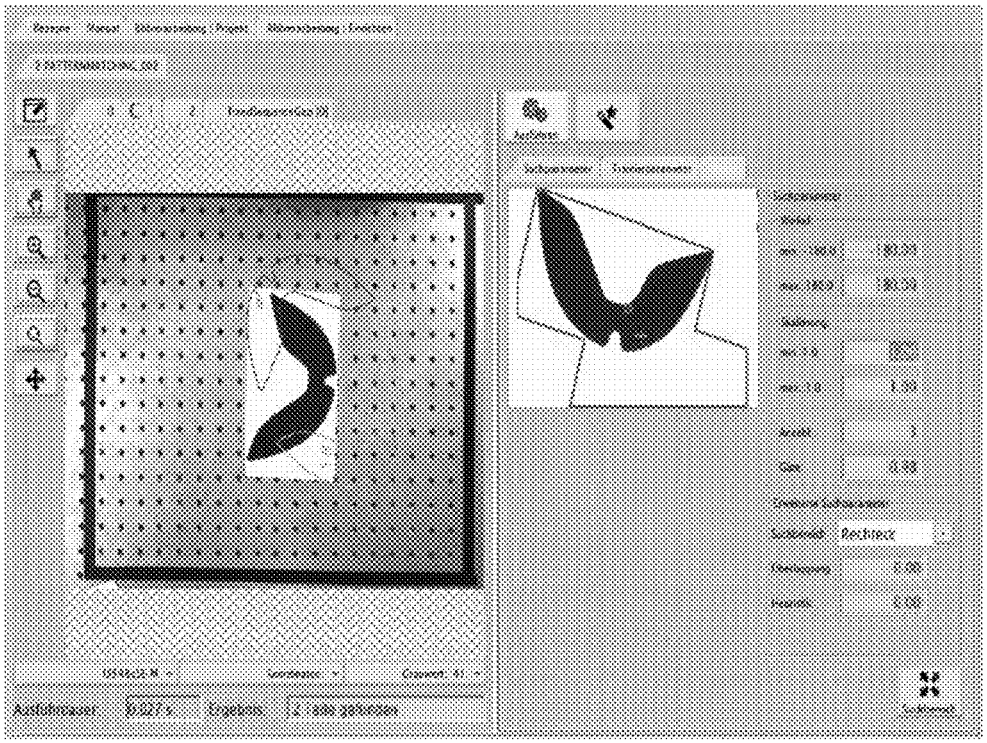
Figure 22C:
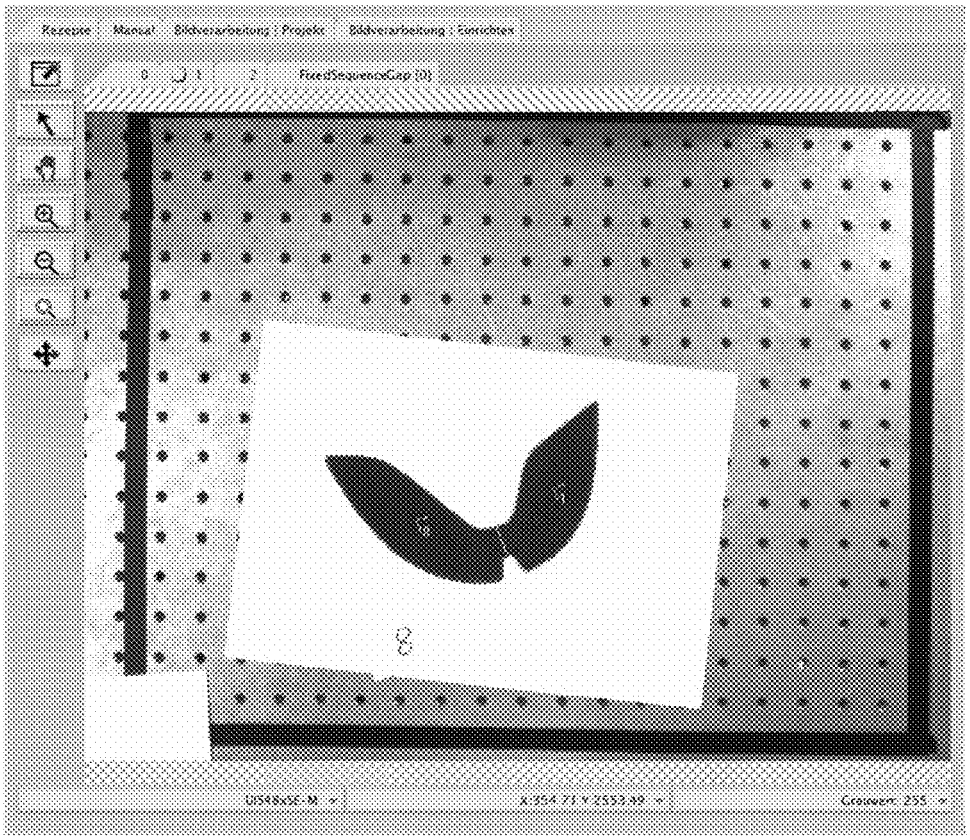

In some instances, large parts may be subdivided into smaller subgroups in order to improve identification as shown in FIGS. 22*b-c*. Thus, components may be subdivided into quadrants or sections for better identification. This may allow for easier identification despite variation in parts. Patches may then be placed relative the quadrant or section offset from reference points, quadrants, and/or sections. Identification of a part may be based, for example, on matching a contour or outline of a quadrant, section, and/or part to a predetermined value.

Using a certain combination of patches 10 may provide sporting goods with predetermined properties, such as decorative properties (unique look, simple, versatile, special effects tapes, visualization of automation, and/or presenting the next level of customization), reinforcement properties (local stiffening, flexible areas, property changes by layering, special reinforcement tapes, and/or performance customization), as well as assembly properties (true 3D upper, no "2D detour", cutting efficiency for textile patchwork uppers, and/or a hot melt tape on the bottom for tooling assembly). Examples are illustrated in FIG. 35.

Furthermore, zonal fine tuning may be accomplished using patches of varying sizes.

Figure 35:
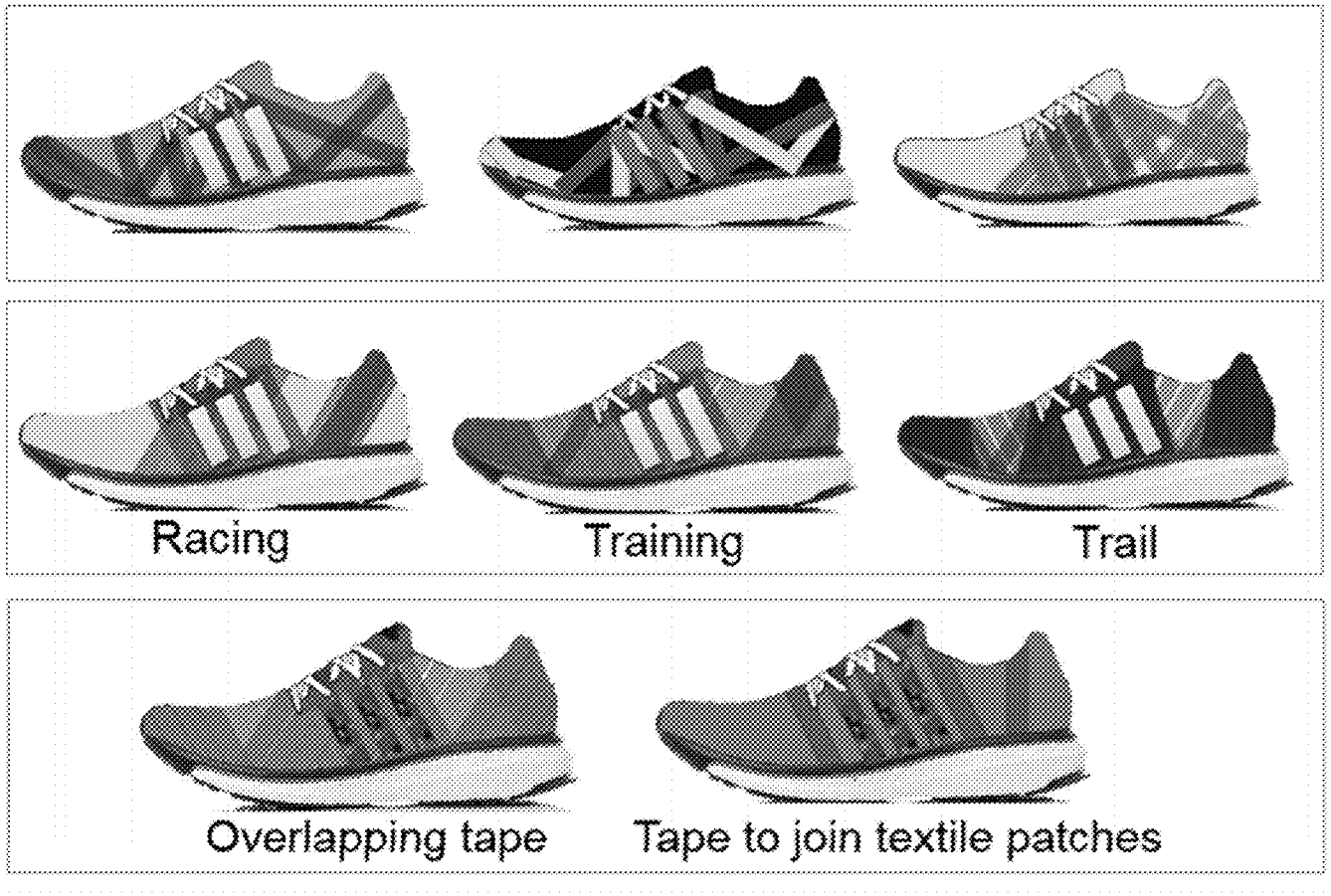
FIG. 35 shows an overview of sports shoes manufactured using a method in accordance with an embodiment.

For example, the shoes depicted in FIG. 35 show various configurations of patches to form a substantially unitary engineered upper. The materials used in and the geometry of the patches may be selected to meet predetermined requirements of the design. Some materials may be superior to other materials in terms of various properties including, but not limited to strength-to-weight ratio, strength in a particular direction, flexibility, grip, breathability, reflectivity, etc.

Thus, for some high performance sports and athletic footwear it may be useful to select materials having a high strength to weight ratio. For example, when designing lightweight track shoes, performance mountaineering boots, and/or other lightweight shoes, a predetermined requirement of the design may call for patch materials having a high strength to weight ratio. In contrast, shoes that require additional stability or protection of the foot may use such materials, but may also require the use of high strength materials.

Further, for example, scans of a user's foot may be used to adjust a design of an upper, midsole, and/or outsole of a shoe to create a shoe that is customized to both the foot of the user and the specific needs of the sport or use. Thus, patches may be placed in manner that reflects a geometry of the foot and/or corrects issues that user may have when using the shoe for sport.

Footwear designs, as shown in FIG. 35, give shoe designers a degree of design flexibility. For example, reducing weight features by use of the positioning of predetermined patches, engineered implementation of flexibility, the ability to make the material stiff or compliant in various different directions, engineered implementation of load paths, to manufacture the upper out of multiple two- or three-dimensional cut or shaped custom patches cut from materials meeting the predetermined specifications for the material. Further, the use of patches and the methods described herein reduce and in some cases eliminate sewing and/or piece work construction during the assembly of the shoe.

It may be possible to enhance performance by engineering in controlled stretch, breathability, orthopedics, and/or supporting structures, for example, ankle supports in the form of an isolating element, such as a brace or strap using various configurations of patches.

Figure 42:
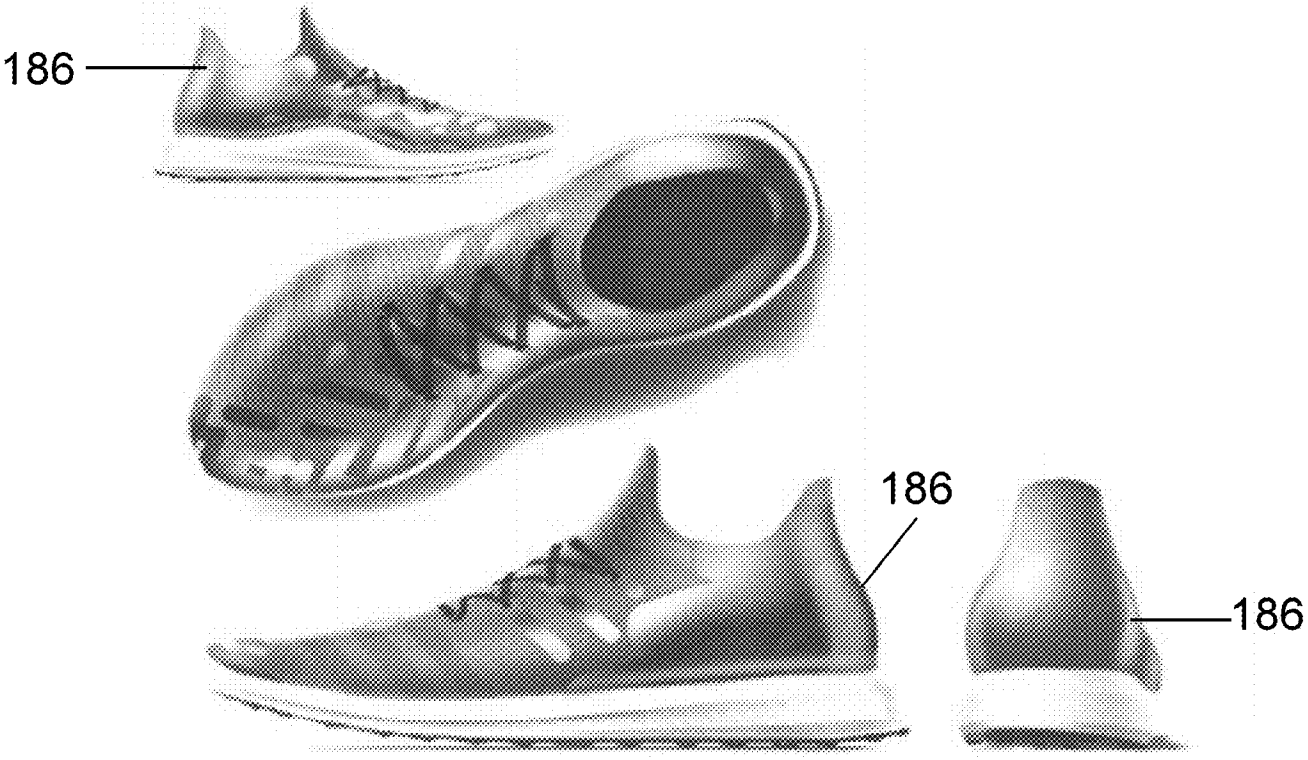
FIGS. 42-44*d* show additional examples of shoes in accordance with some embodiments.

For example, shoe upper constructions 102, 602, 702, 802, and 902 depicted in FIGS. 37, 38, 39, and 40 include patched heel zones counters 714, 814, and 914 having a functional zone in the heel area of the upper of the shoe 101, 601, 701, 801, and 901. The patched heel counter 714, 814, and 914 is configured to provide extra support and/or rigidity to the heel area of the user's foot. As is shown in FIG. 42, the patched heel counter may include multiple overlapping patches that form an overlapping structure in the heel area. The patches used may be selected to ensure that the patched heel counter has a specific predetermined properties, such as thickness and/or stability.

Figure 48:
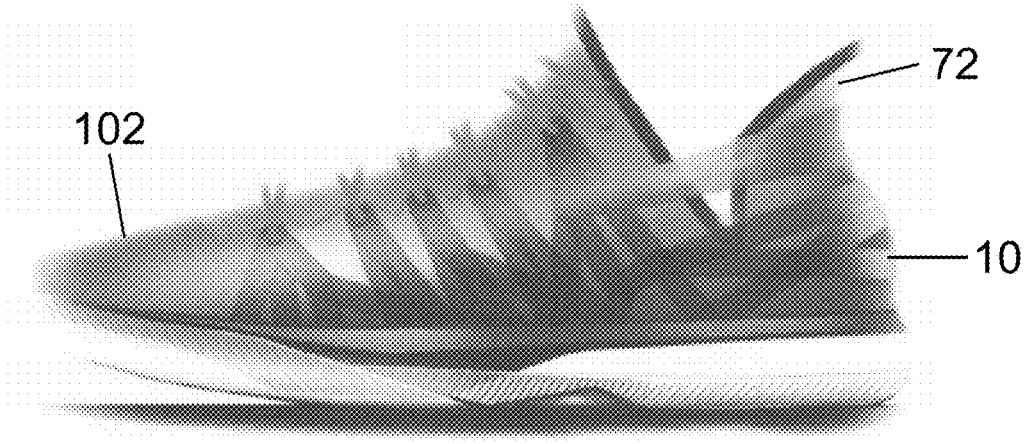

Another illustrative example of a patched heel construction is shown in FIG. 48. Patches 10 are placed around the heel and extend over areas without base material 72 creating additional breathability in the upper 102 while providing stability in critical areas around the heel.

Figure 43:
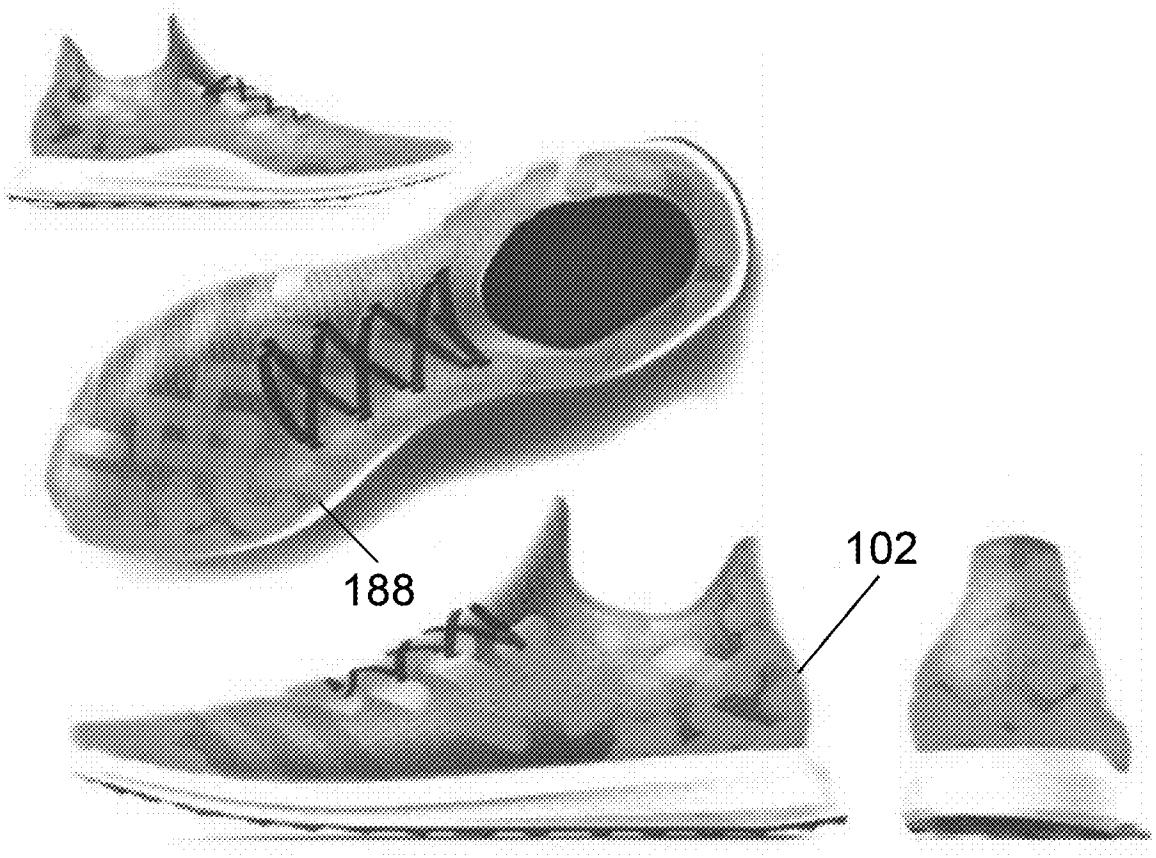
Figure 44A:
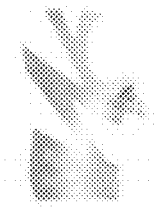
Figure 44B:
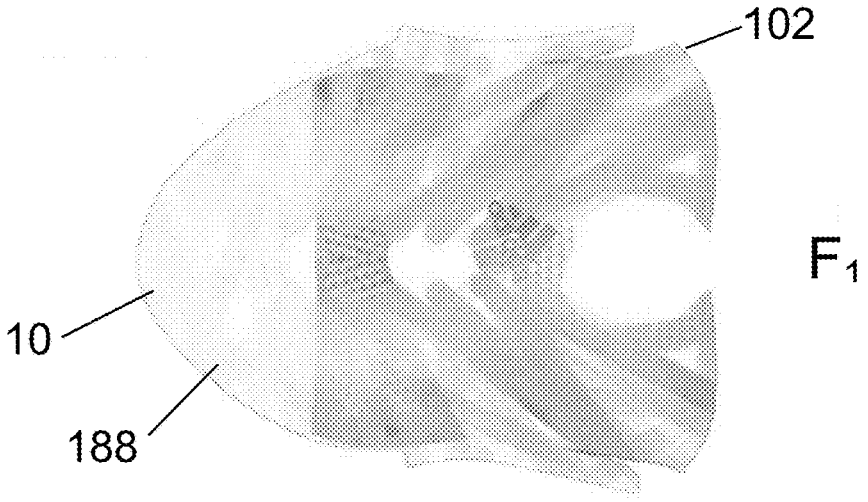
Figure 44C:
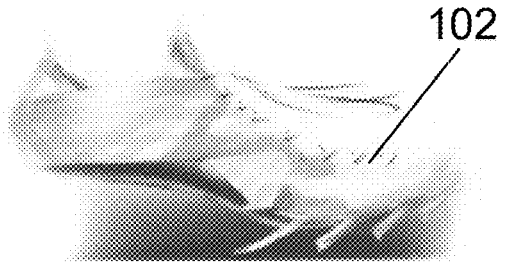
Figure 44D:
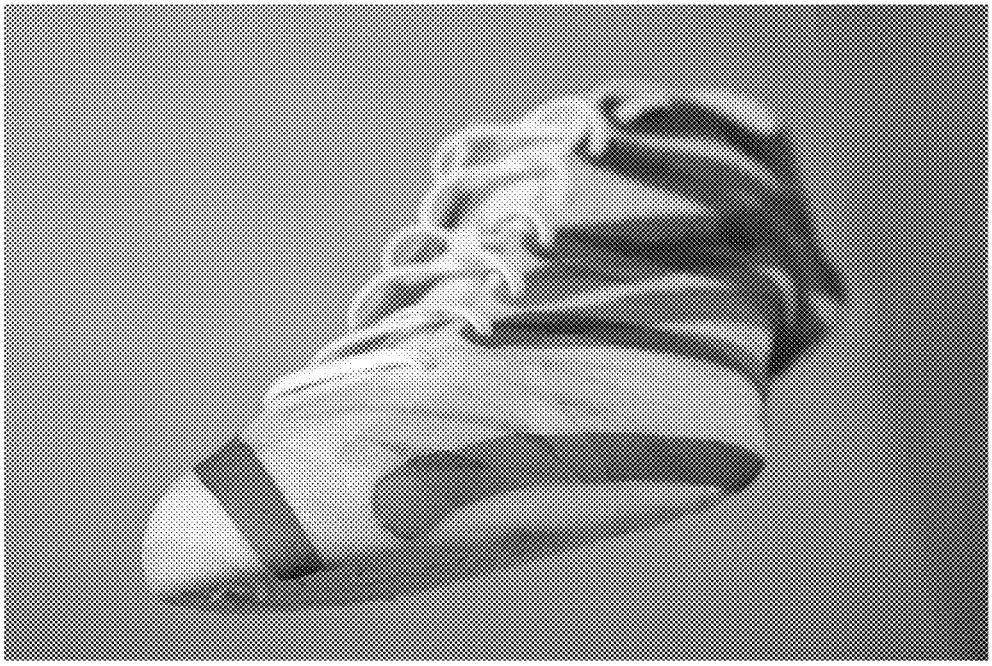

As shown in FIGS. 43-44, a breathability functional portion 188 may be created by positioning patches in grid-like structure on an upper. The grid-like structure may include partially overlapping patches, as well as open areas. Such a breathability construction may be used in specific areas on an upper or an article of clothing. For example, a breathability functional portion 188 may be positioned in a forefoot of an upper construction 102. Further, a breathability functional portion may overlay a fabric portion so that the fabric portion rests against the wearer's foot. The fabric portion, in turn, may be comprised of material that further increases the breathability aspects of the breathability functional portion 188.

FIG. 44 depicts various views in the development of a track and field shoe. Depicted in FIG. 44*a* is a design drawing showing where additional support structures should be based on the design of the shoe. FIG. 44*b* shows a 2D depiction of an upper 102 including only a partial base material in its construction. Thus, portions of the upper 102 are formed from patches 10 exclusively. For example, in the toe box depicted in FIG. 44*b* patches are positioned in such a manner as to create the upper. The position of the patches in the forefoot area creates a breathability functional portion 188 constructed solely from patches and without a base material in some areas. Finally, FIG. 44*d* depicts an alternate version of a shoe constructed using an upper similar to the upper 102 shown in FIG. 44*b*, however, having a full base material.

As shown in FIG. 35, a structural "chassis" of a shoe may be utilized across a broad range of shoes having different end uses and/or preselected features. For example, a particular "chassis" engineered for various applications can be combined with the outer "style," cosmetic, and surface engineering (for example, texture and surface grip). By this method, it is possible to produce shoes that look and have surface characteristics that are similar but have very different "chassis tuning" or structural layout, which can be used to maintain a branded cross platform look or style. For example, a surface of a football/soccer shoe may be engineered by the positioning of particular patches to enhance surface grip of zones on the shoe. As shown in FIG. 35, various embodiments of the present system are cross-compatible between applications; that is, a single upper design may be adapted to multiple end-use applications.

Load paths on a shoe can be identified using computer analysis (e.g., three-dimensional finite element analysis, and the like) and/or physical testing. Various embodiments of footwear uppers include the placement of patches along critical load paths of the component. These load paths may differ across the various sports and article types.

Thus, articles having multiple designs for the various sports in which they may be used may be developed. As an illustrative example, a base design might be used for both American football, rugby, and football (i.e., soccer), however, patches and/or components, as well as their positioning, may be varied to optimize the article for a sport.

Some regions of an upper are engineered to provide increased compliance, for example, to accommodate the articulation of the wearer's foot.

Figure 36A:
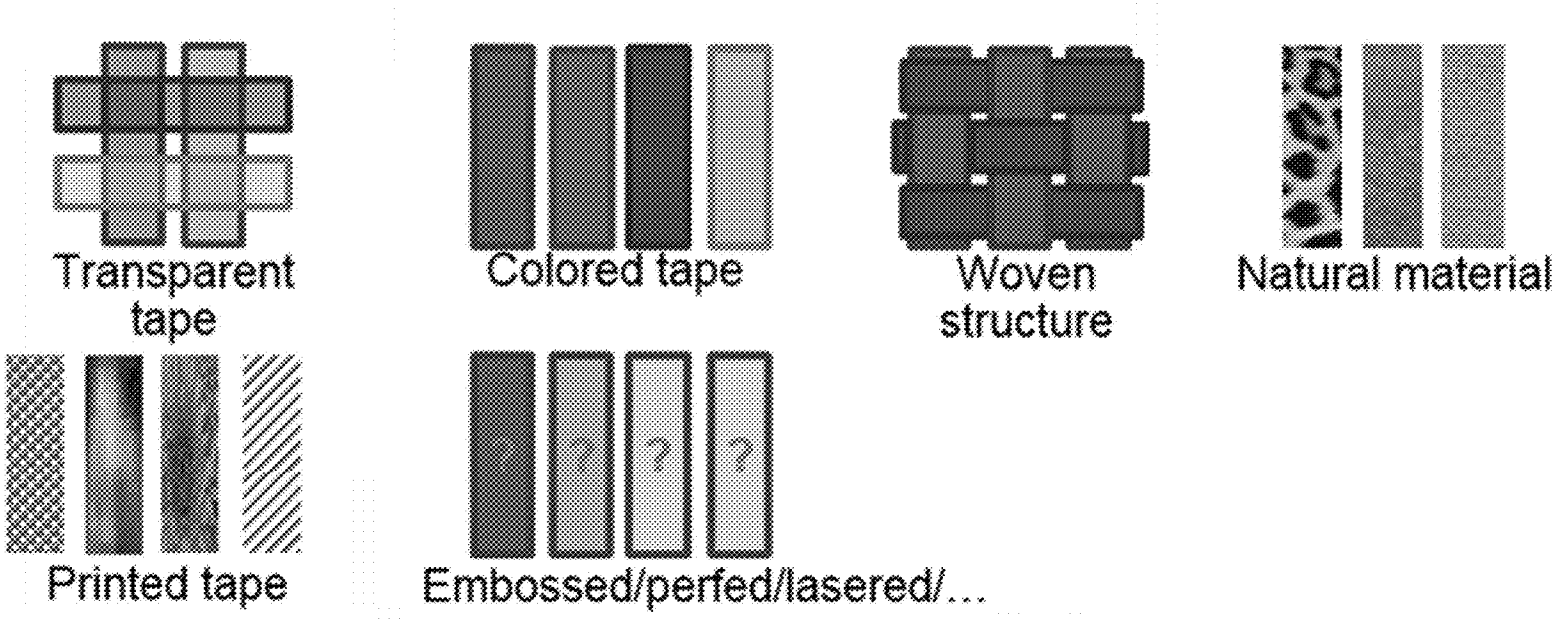
FIGS. 36*a-c* show examples of patch materials in accordance with some embodiments.

FIG. 36*a* illustrates various examples of patch compositions providing desired decorative properties. For example, patches can be selected from partly transparent tape, colored tape, a woven structure, natural materials, printed tape (e.g., using digital print, screen print, and/or sublimation print), structured tape (e.g., with perforations, embossed, and/or lasered), different cuts (e.g., round, straight), different widths, and/or multi-layer tape for laser etching.

Figure 36B:
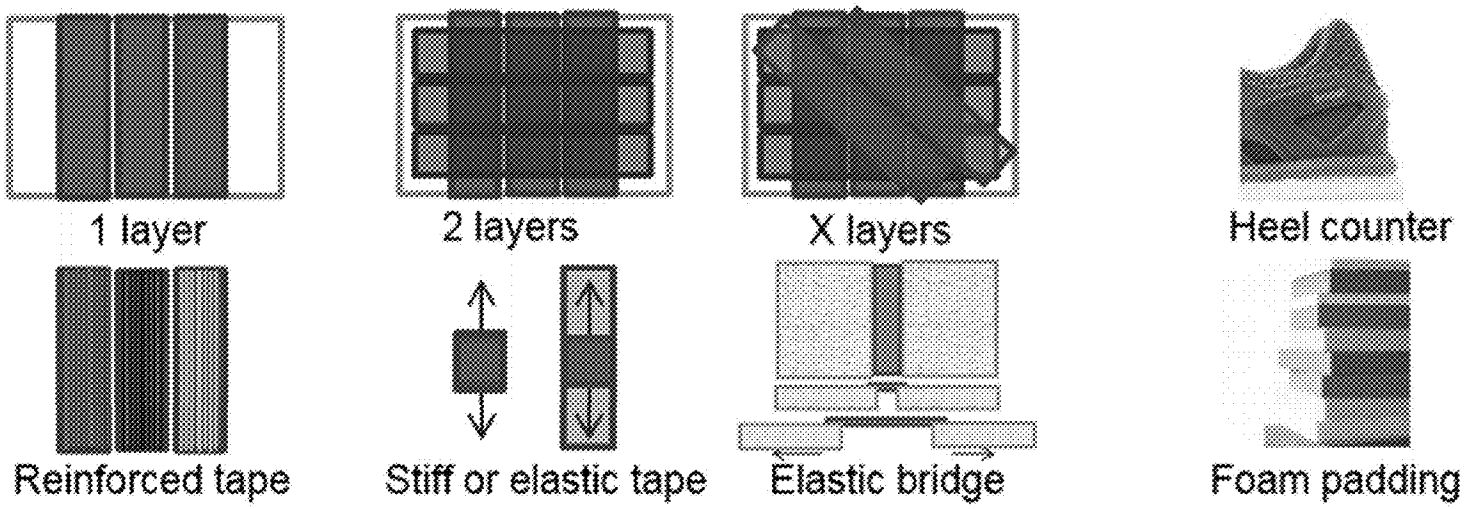

FIG. 36*b* illustrates various examples of patch compositions providing predetermined reinforcement properties. Conceivable are the adding of one or more tape layers, the change of the tape layer orientation, the use of a reinforcement tape (e.g., carbon fibers, glass fibers, and/or ultra-high molecular weight polyethylene ("UHMWPE"), e.g., Dyneema fibers, a stiff or elastic tape for form stability or stretchability, an elastic tape to bridge fabric cuts for compression, and/or a multi-layer tape with different stretch for laser etching. Also, e.g., heel counters or foam padding can be provided, as illustrated.

Various designs of flexible compositions for use on a sporting good may include multiple material layers, for example, continuous surface layers and/or fiber-reinforced layers, and/or engineered arrangements of individual patches. As depicted in FIG. 12*b*, multiple layers of patches may be configured to handle loads originating from various directions. For example, use of a multiple patches may impart a multi-directional load-handling capability to a sports article, such as a shoe.

Some patch placement configurations may include one or more design layers. Patches may provide texture and/or color to a surface layer of a sporting good. For example, as shown in FIGS. 35-36*b* patches may enhance the design of a shoe by providing color and/or texture to the shoe.

Figure 36C:
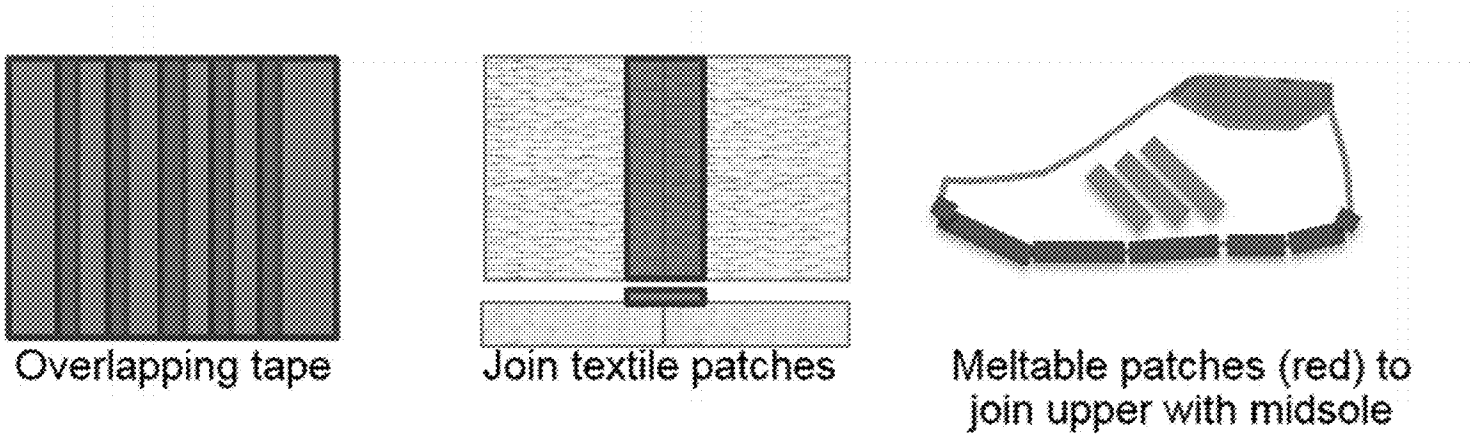

FIG. 36*c* illustrates various examples of patch compositions providing predetermined assembly properties. For example, an overlapping tape could be used to build an upper with no textile backing. Textile patches can be joined to one another to reduce waste and in some cases optimize cutting efficiency. Meltable patches can be placed on the bottom to allow joining to the midsole. Utilizing meltable patches may reduce a number of processing steps that are generally required during conventional construction of a shoe. For example, an upper may be connected to the midsole using a process which does not require additional step(s) of applying liquid glue.

In any case, usable materials may include e.g., polymers (e.g., TPU, nylon), textiles, flocked tape, non-woven tape, natural fibers and/or leather. The adhesion between the patches 10 may be provided by means of a meltable tape material, a hot melt backing layer, and/or a hot melt web.

Further, the patch constructions described herein can reduce and in some cases eliminate the need for seams. Thus, allowing for reducing or eliminating the need for seams on the major load paths of the shoe design. By reducing or eliminating such a seam on a load path of the shoe this may help maintain strength of a particular shoe design which may be useful for the design of, for example, lightweight shoes;

The apparatus also preferably comprises a control means (not shown), which facilitates the manufacture of a plurality of different shoes with the apparatus shown. The control means may also comprise an interface for interaction with at least one future wearer of one of the shoes to be manufactured. This allows a future wearer to individually adapt the shoe to be manufactured to his/her needs.

FIGS. 37-40 depict further illustrative examples of patch configurations used to create shoes. As shown, the patches are positioned to provide support based on predetermined specifications for a particular type of shoe. Thus, in some instances the patches may be positioned in a manner similar to that of conventionally placed reinforcing materials. Use of patches may allow for a more precise positioning of support elements depending on the configuration of the patches, for example, size and/or strength capabilities of materials used.

Figure 37:
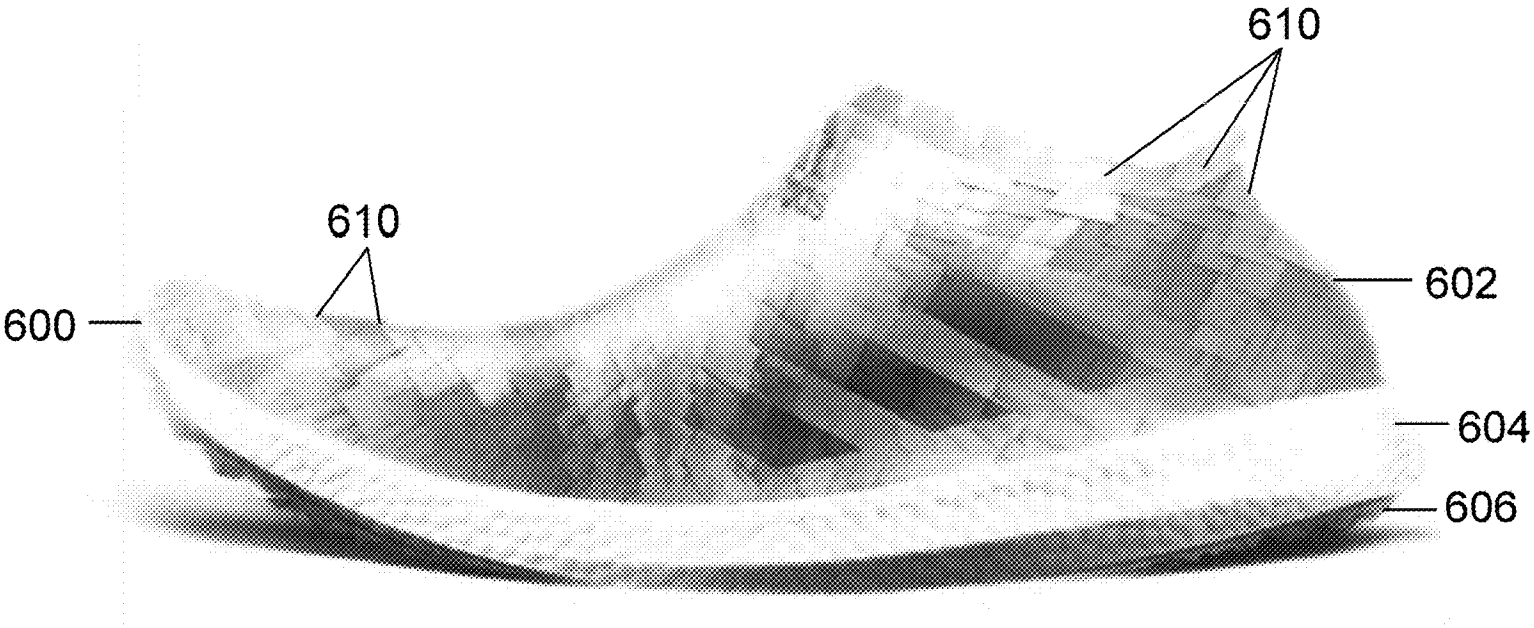
FIG. 37 shows an example of a sports shoe manufactured using a method in accordance with an embodiment.

As shown in FIG. 37, shoe upper 602 may be constructed solely from patches. Patches 610 may vary in size, material, and/or orientation to create a patched upper as is depicted. Patches overlap in part or completely depending on the configuration of the shoe. FIG. 37 depicts a multitude of overlapping patches 610 used to form a shoe 600.

Materials may vary from region to region within the shoe to impart predetermined properties to the shoe. Predetermined properties imparted to the shoe through patches may include abrasion resistance, water resistance, breathability, strength, flexibility, capability to position foot in proper position for specific sport, supporting muscles during movement, etc.

Patches and/or components may be placed on both sides of a carrier surface. For example, patches may be placed on a 2D carrier surface, such as an upper on a side that corresponds to the interior of the shoe, as well as the side that corresponds to the exterior of the shoe. As an illustrative example, cushioning patches may be placed on the interior and patches imparting grip may be placed on the exterior surface.

Besides, the base material may be folded when applying at least one component (or patch) on the base material. In some embodiments, an elastically deformable base material with a three-dimensional shape is placed on a support structure adapted to form flat faces of the base material. Such base material may be for example a sock or a shoe upper with a three-dimensional sock shape. Thereby, by forming flat faces on the base material, the placement, temporary fixation and/or consolidation of a component on the base material is facilitated compared to a complex three-dimensional shape with mainly round convex and/or concave surface such as a last.

In some embodiments, the elastically deformable base material, such as a shoe upper for example, may have a sock shape placed on a two-dimensional flat last. Such simplified last may be called a 'sword' based on its flat elongated shape. The sock placed on such sword is thus in a flat configuration with a first outer face and a second opposite outer face. Besides, the sword may comprise features such as visual indicators to ensure that the sock is correctly placed on the sword. The placement of components on the base material is in these embodiments simplified as the three-dimensional base material takes a two-dimensional shape, and can therefore be laid flat on a carrier surface in order to place, fix and consolidate the component for bonding onto the base material. The first outer face may correspond to a right side of the shoe and the second outer face may correspond to a left side of the shoe.

Figure 77:
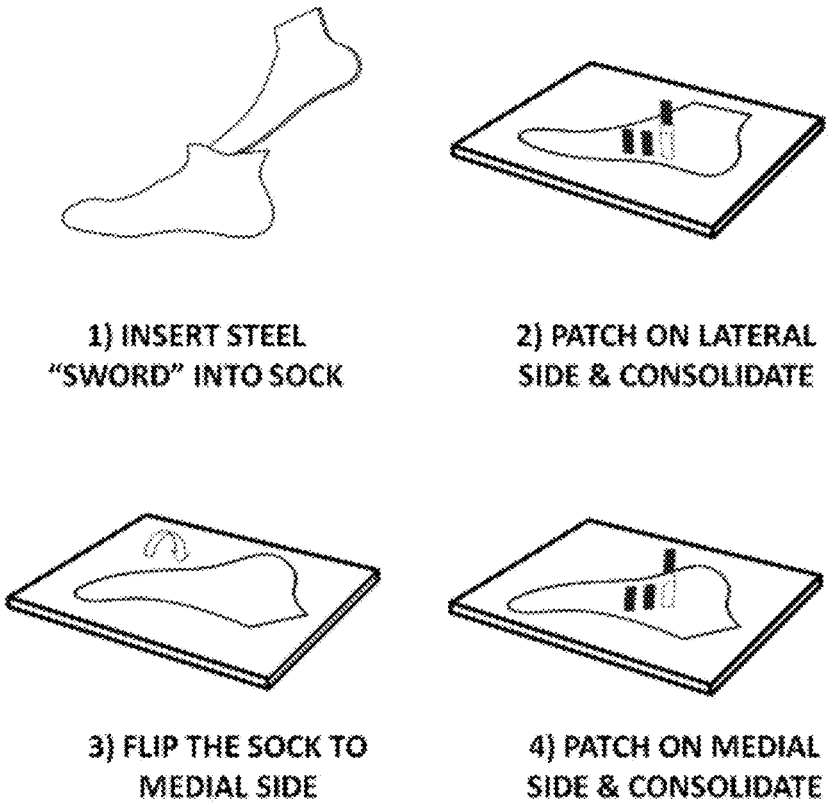
FIG. 77 shows a method of patch placement using a sock shape base material and a two-dimensional last according to an embodiment.

As illustrated in FIG. 77, after the 'sword' has been inserted into the sock (see step 1), one or more components (or patches) may be placed on the first outer face of the sock and may optionally be consolidated (see step 2). Then, the sock may be flipped (see step 3), and one or more components (or patches) may be placed on the second outer face of the sock, again followed by an optional consolidating step (see step 4). Moreover a consolidation step may only happen after components (or patches) have been placed on each side of the sock.

In such a method according to an embodiment of the invention, the carrier surface (or sock in some embodiments) may be flipped more than once:

- in a first step, a first number of components (or patches) are placed on a first face of the carrier surface,
- in a second step the carrier surface is flipped,
- in a third step, a second number of components (or patches) are placed on a second face of the carrier surface,
- in a fourth step the carrier surface is flipped,
- in a fifth step a third number of components (or patches) are placed on the first face of the carrier surface.

Additional flipping steps and steps of placing components on the carrier surface may be envisioned according to embodiments of the present invention. In particular, an assembly line adapted to carry out such method may comprise a flipping unit adapted to flip a carrier surface from one side to another side.

Placing of patches and/or components on a 3D carrier surface may also occur on both interior and exterior surfaces. For example, patches may be placed on an external surface of a 3D constructed upper while it is positioned on a last. The upper may be removed from the last and additional patches and/or components may be placed on the interior surface of the upper.

Patches may be used to secure components to a carrier surface and or secure multiple carrier surfaces together. For example, it may be desired that carrier surface has different properties along the length of the article, which may require different carrier surfaces. These different carrier surfaces may be secured to each other using patches and/or component. In particular, patches may be used to couple carrier surfaces together.

As shown in FIG. 41, an illustrative example of a shoe upper construction includes placing patches 10 on a two-dimensional carrier surface 22 (2D application of patches). As shown, multiple patches, as well as texturing may be used to varying degrees throughout the upper. Areas where stretchability is desired may include patches having smaller thicknesses, widths, and/or engraving. Areas in which additional stability is desired include overlapping patches as is indicated in the heel region 714 of FIG. 38.

In addition, FIGS. 5 and 41 provide an example of a toe box element 180 for use in the forefoot that provides variable stretch across the toe box due to an engraving pattern 66 that includes varying depths of sipes 64 in some areas of a toe box element 180. As shown in FIG. 41, various engraving patterns 66 may be used on patches to enhance stretchability in some stretch areas 182. Some areas of the upper may include multiple patches 10 positioned on each other to enhance stability in these stability areas 184. The toe box element 180 as shown in FIG. 41 may provide more stability on the medial side than the lateral side which may be desired in some applications.

In some instances, the resulting intermediate product is sewn into a 3D construction. Patches may be placed based on the use of the shoe, desired characteristics for the shoe (e.g., water resistance, breathability, support, etc.), needs of the user, and/or design considerations.

Alternately, the resulting intermediate product may be placed on a last and molded into the final form.

In some instances, patterns may be created on a patch through deposition, printing, positioning of smaller elements on the patch, etc. Such positive reinforcements may be positioned to provide specific properties to the patch and/or article construction. For example, a patch may be stiffened by selective printing, deposition, and/or patching on the patch surface.

Figure 38:
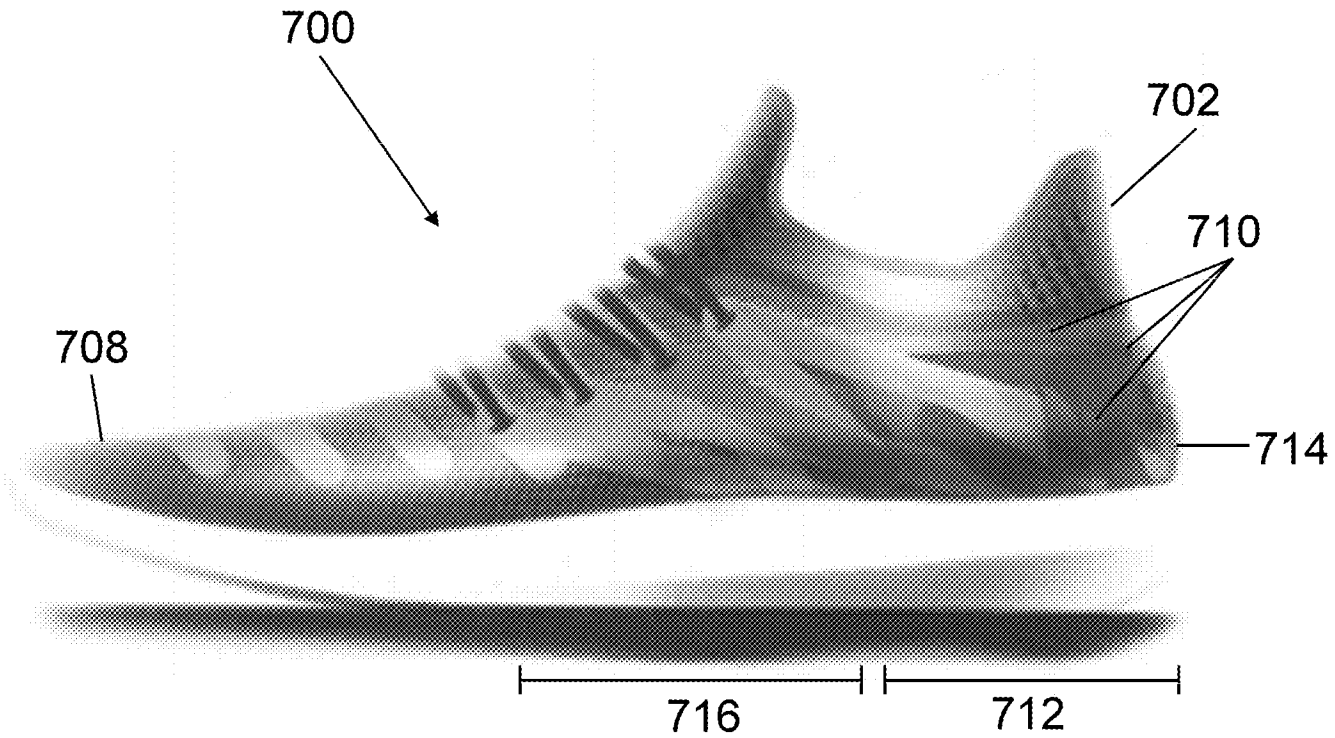
FIG. 38 shows an example of a sports shoe manufactured using a method in accordance with an embodiment.

FIG. 38 shows an example of a shoe 700 having a substrate 708 on which patches 710 are strategically placed to impart particular properties to the shoe. Placing the patches may simply involve positioning and/or fixing the patches. Fixing may be the result of a friction fit, adhesive, static forces, etc. Patches 710 in the heel region 712 are positioned such that they overlap to form a heel counter 714. Patches 710 are used in the midfoot region 716 to provide support to the midfoot. As shown, patches 710 may extend across the shoe from the midfoot region 716 to the heel region 712.

Figure 39:
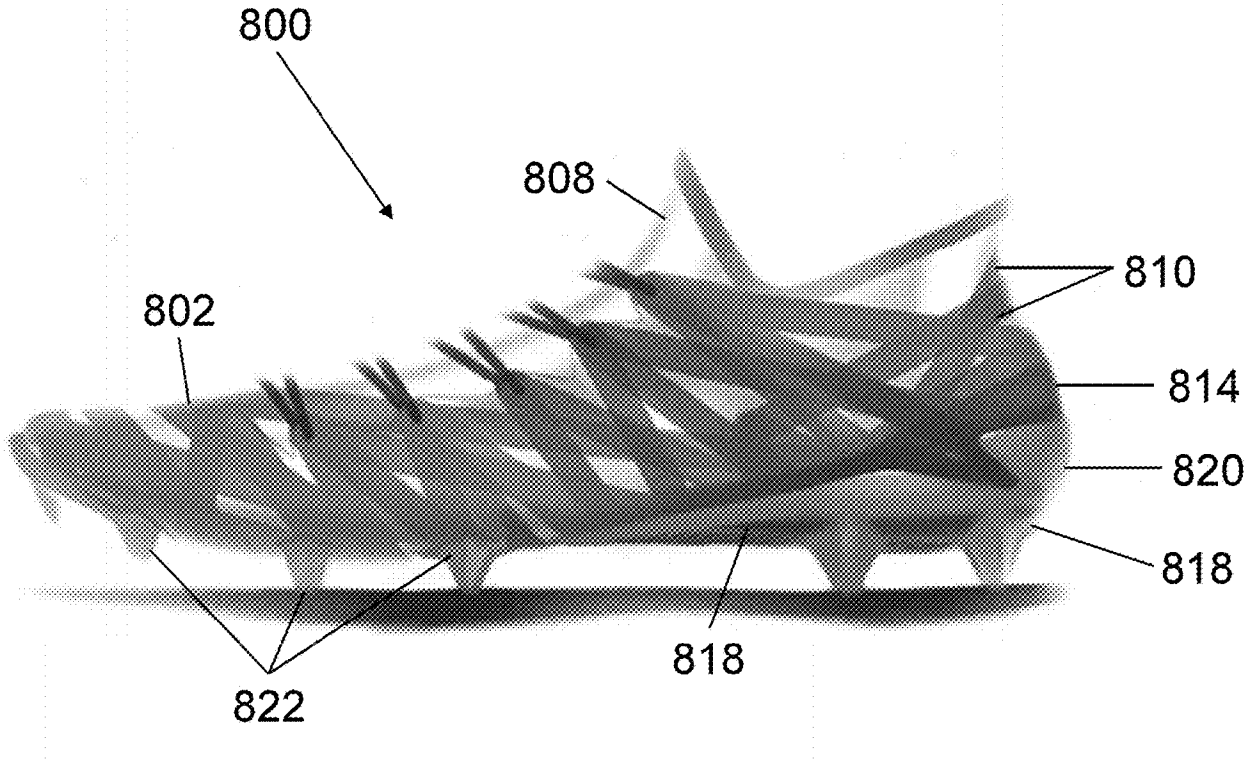
FIG. 39 shows an example of a sports shoe manufactured using a method in accordance with an embodiment.

A football shoe (i.e., soccer) 800 having a patched upper 802 and an outsole which includes studs 822 on sole plate 818 is shown in FIG. 39. Sole plate 818 also includes heel counter 820. Patches are positioned on the shoe, in particular, where additional support is needed. For example, patches 810 are positioned to create additional support proximate heel counter 820 such that a patched heel counter 814 is formed.

Alternatively, some embodiments may utilize an upper made from conventional materials, knit, woven materials, non-woven materials, leather, synthetic materials or the like in combination with a patches/elements placed to form the midsole and/or outsole.

Figure 40:
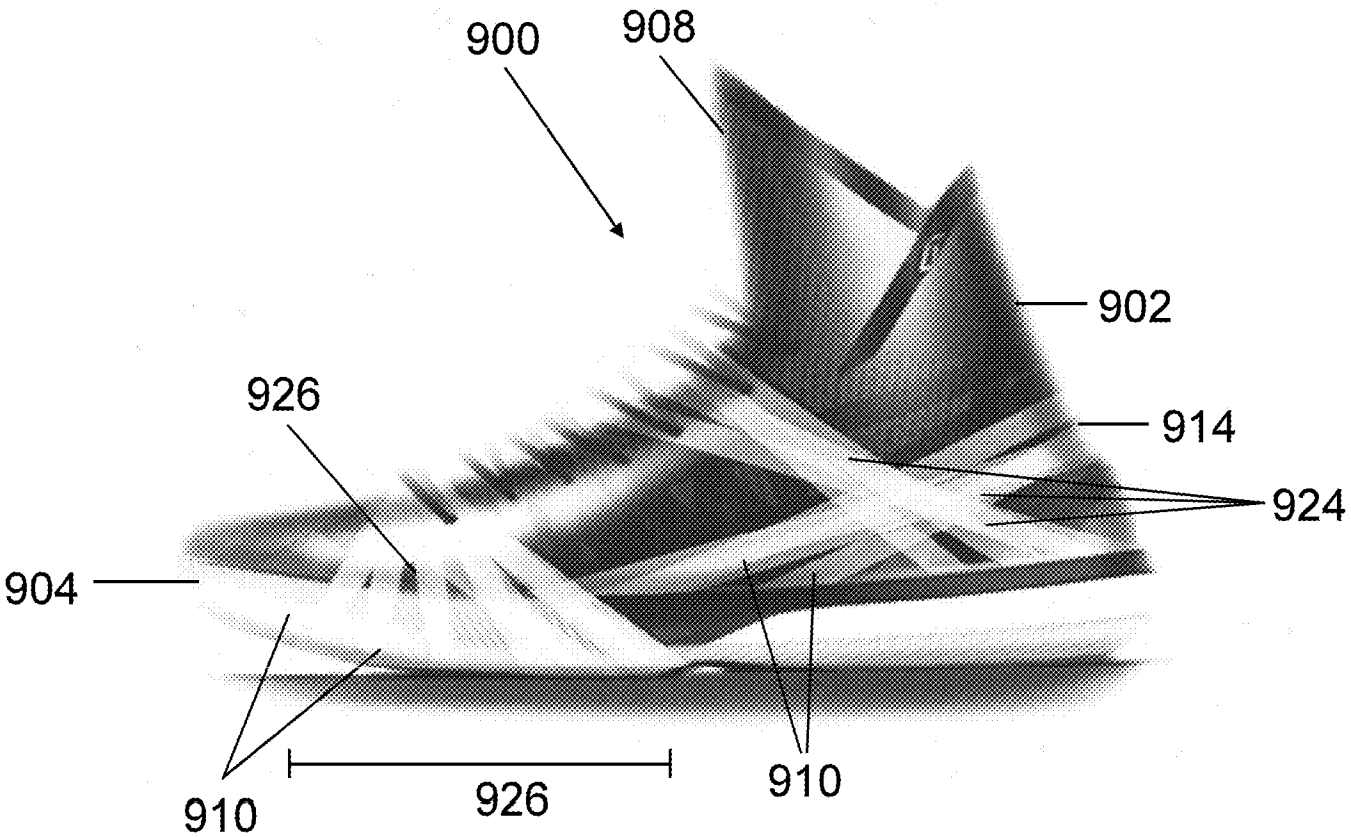
FIG. 40 shows an example of a sports shoe manufactured using a method in accordance with an embodiment.

As illustrated in FIG. 40, a basketball shoe 900 has specific structural requirements. Patches 910 are positioned on the shoe 900 where additional support is needed. For example, as shown in FIG. 40 patches are positioned around an ankle position to create support structure 924. Support structure 924 may provide additional support to the ankle and foot. For basketball, as well as other lateral sports (e.g., tennis, American football, football, etc.), it may be particularly useful to provide additional support proximate and/or in the region of the vamp 926. As depicted, at least some patches 910 cover a portion of upper 902 and extend to the midsole 904. Patches positioned on or proximate the vamp 926 may be selected to have a certain abrasion resistance. For example, vamp portions on the medial side may experience significant abrasion during use and may require increased abrasion resistance.

Figure 45:
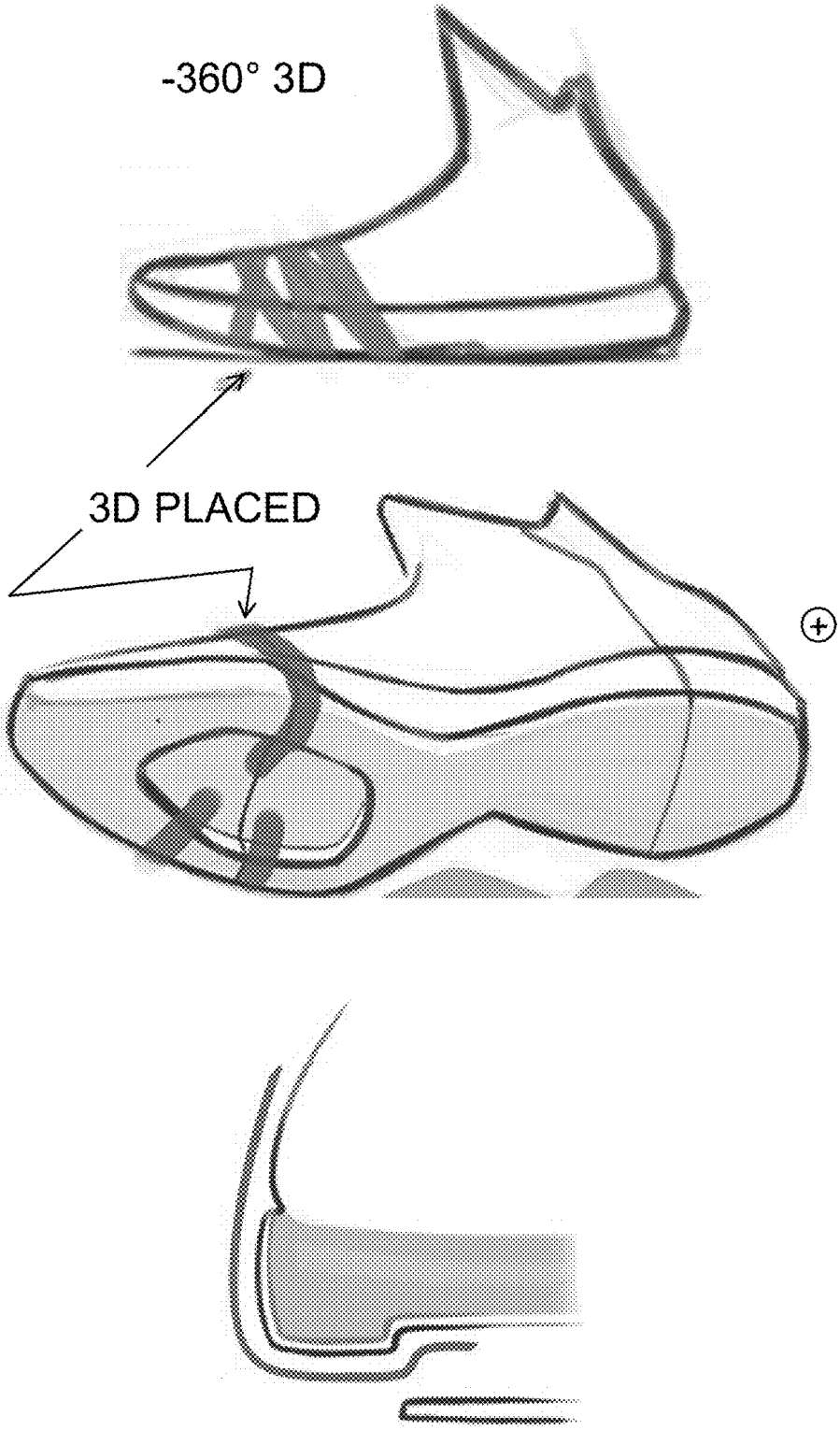
FIG. 45 shows exemplary applications of patches on shoes in accordance with some embodiments.

In certain instances, patches 10 may extend to the outsole 6 as is shown in FIG. 45. Patches positioned in such a manner may provide additional stability, fit, and/or traction benefits for the shoe. For example, a patch which includes a flex portion may have a TPU layer of less than about 0.5 mm. In particular, a TPU film having a thickness of about 0.3 mm may be used in areas requiring flex. In contrast, areas requiring stability may have patches having thickness of greater than 0.5 mm. In some cases, patches having a thickness greater than about 0.7 mm may be used. Patches and/or construction of patches which provide additional traction to the shoe may be positioned such that they engage a portion of the midsole. As depicted in FIG. 45, patches 10 may extend from the upper, over the midsole, over a portion of the outsole 6 and have another portion of outsole 6' which covers an end of the patches 10.

As depicted in FIG. 45 patches 10 may be placed on the midsole. Patches placed on the midsole may be used to control properties of the midsole. For example, patches may be placed a portion of the midsole to control shear forces in the midsole. For example, for many lateral sports patches may be selectively placed on the midsole to reduce shear.

Utilizing patches on the midsole may increase stability of the foot. For example, patches on the midsole may lock the foot down better.

Patches placed on the midsole may provide protection against wear. For example, patches may provide abrasion and/or stain resistance to a midsole.

In some instances, patches may be placed on the midsole to increase bending stiffness in predetermined areas.

Figure 46:
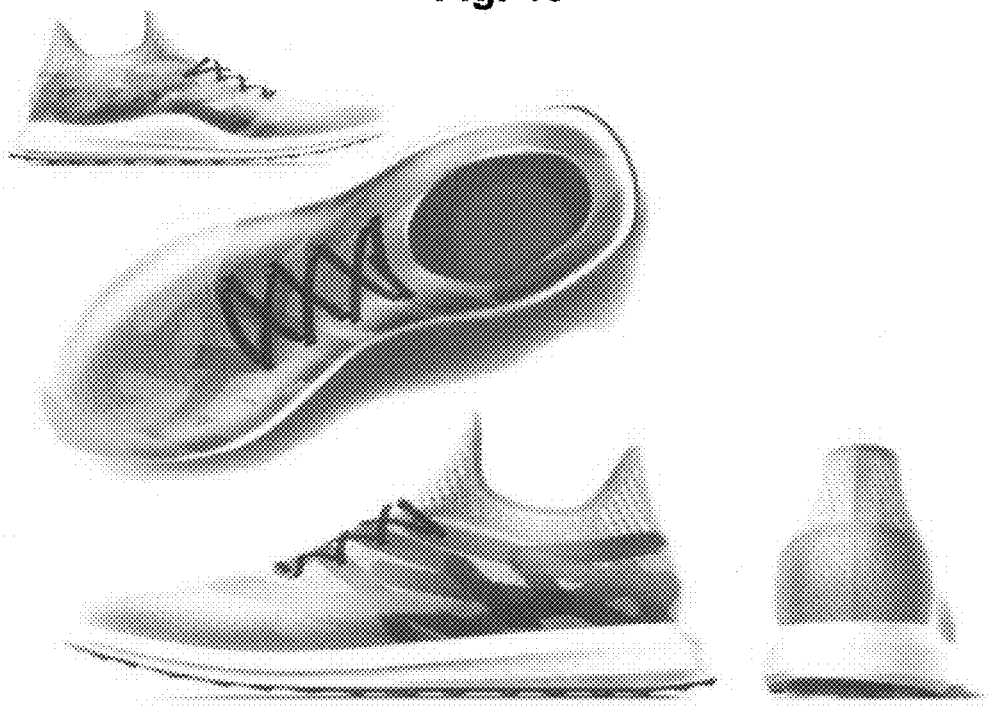
FIGS. 46-52 show additional illustrative examples of footwear in accordance with some embodiments.
Figure 47:
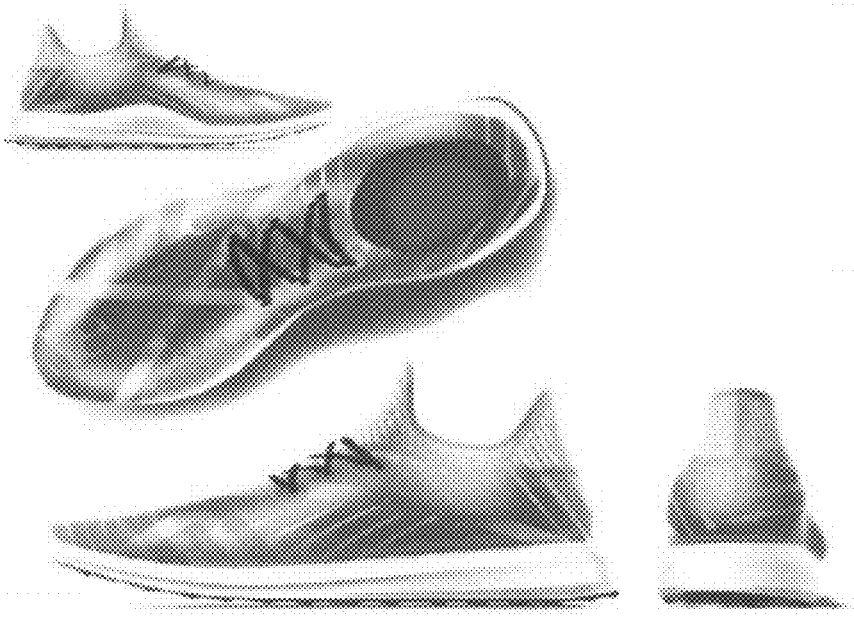

Additional constructions which provide support to various elements are depicted in FIGS. 46-47. In some instances, patches may be used to reinforce lacing elements. Furthermore, patches may be positioned along areas of the shoe that require additional support as depicted in FIG. 47. The shoe 101 depicted in FIG. 47 provides stability in the midfoot region and vamp region. All patches and placement may be customized as disclosed herein to meet the needs and desires of an end user.

Figure 49:
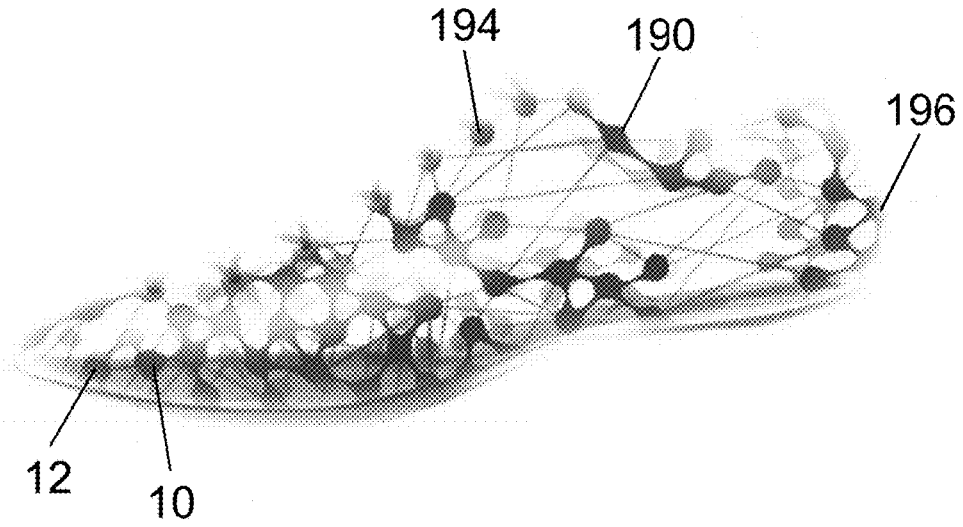
Figure 50:
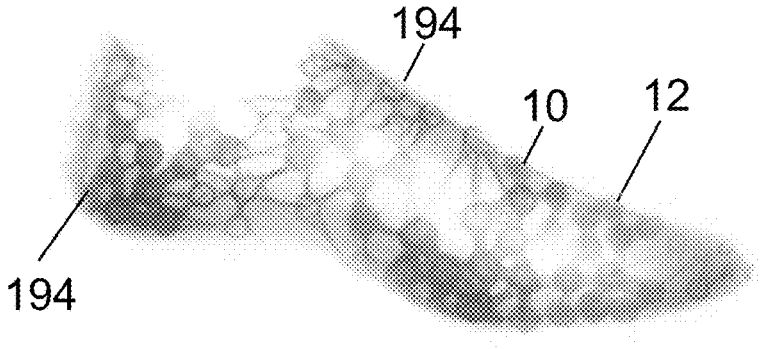
Figure 51:
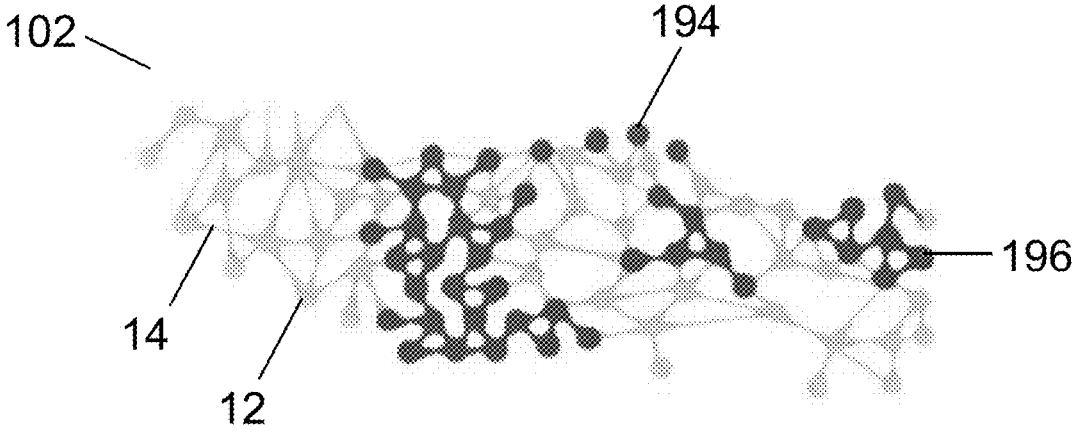

FIGS. 49 and 50 depict patches 10 capable of imparting vastly different levels of stability to different areas of a shoe 101 as needed. For example, locations having nodes 12 would generally provide more stability then areas having elongated members 14 provided that the patches are of the same material and thickness. Further, distances between nodes 12 would affect the overall stability of an area of an upper. For example, as shown in FIG. 49 nodes may be concentrated near the collar region 190, eyelet region 194, and heel region 196 to impart additional stability to these areas. FIG. 51 depicts a 2D upper 102 having patches drawn on one side to indicate areas of concentration of nodes to increase stability.

Further, in some instances, an upper may include multiple base materials in different parts of the upper in order to impart the desired properties to the shoe. This multiple base materials may be connected using patches and/or components.

Figure 52:
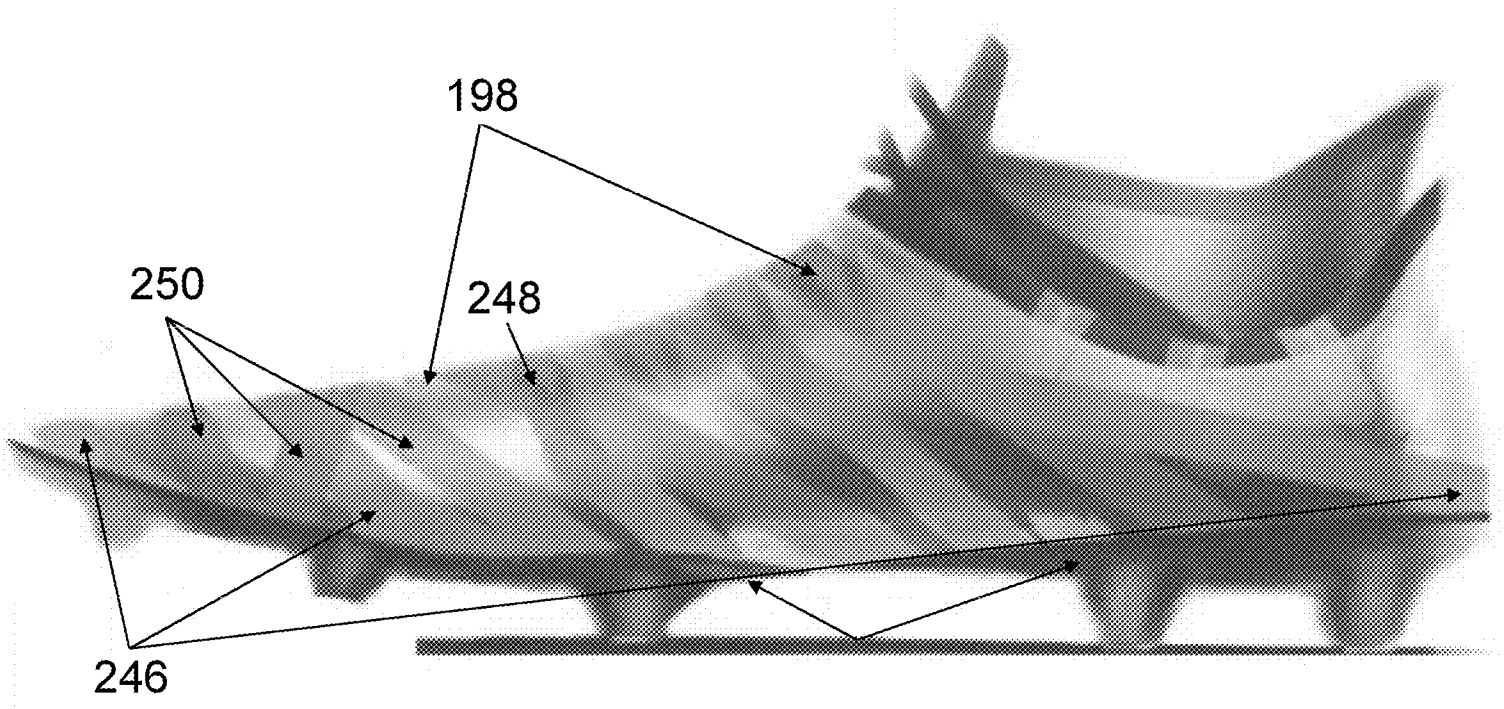

As depicted in FIG. 52, a football shoe 101 includes patches 10 having different functionality in different areas. For example, grip patches 198 may be placed throughout the shoe in areas that have high ball contact. Abrasion resistant patches 246 are provided in areas of the shoe that have high levels of engagement and/or wear. High flex patches 248 are provided in areas that require additional flex and/or stretchability. Stability patches 250 provide additional stability to areas that should provide additional stability to the user. Further, additional patches may be provided for additional functionality, for example, waterproofing, reinforcement, cushioning, insulation, design, etc.

Figure 53:
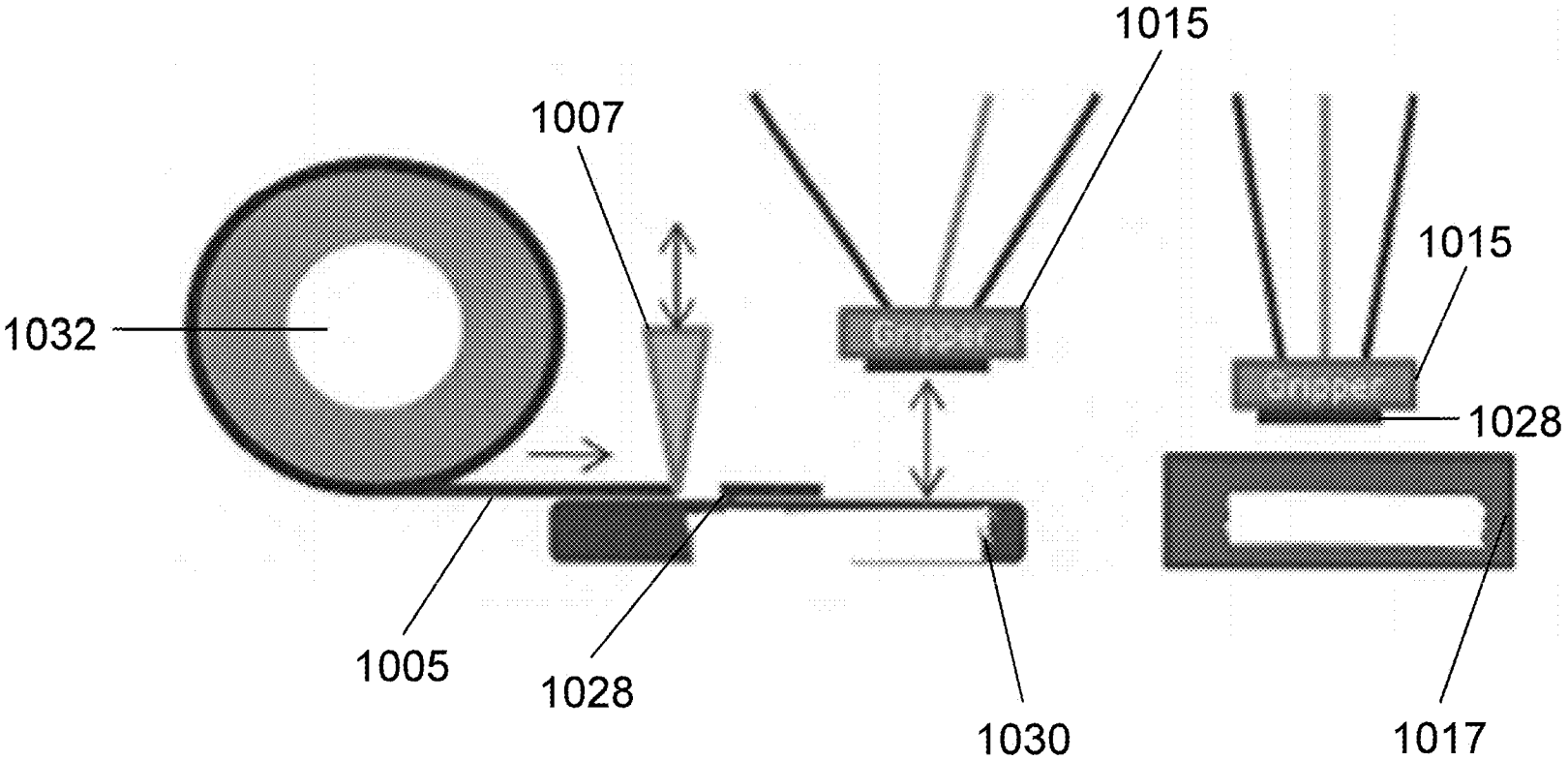
FIG. 53 shows an embodiment of a method for the manufacture of a sporting good.

In some instances, outsole elements may be cut from material, for example, a sheet of material or a roll of material and placed on a midsole and/or part of an outsole. As illustrated in FIG. 53, outsole elements 1028 are cut by a cutting device 1007 from a roll of material 1005 using an unwinding unit 1032. Outsole elements 1028 are picked up from a transportation device 1030 by a gripping device 1015 and are activated, for example, using an infrared source 1017 as shown in FIG. 53. For example, in some cases outsole elements may be coupled to the sole, midsole, and/or outsole using heat, adhesive, mechanical interlocking, or other methods known in the art.

Figure 75:
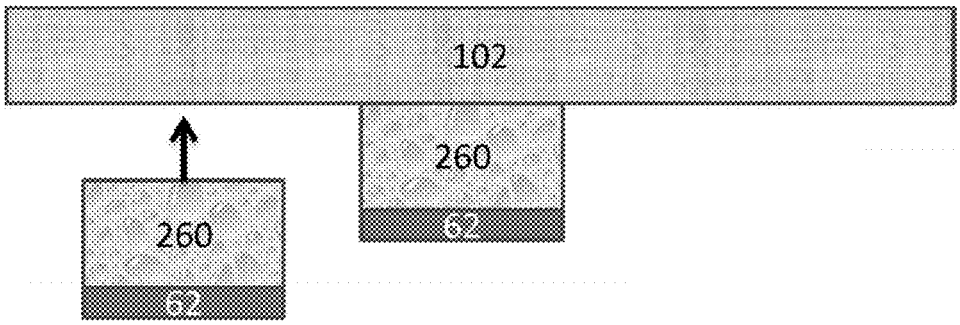
FIG. 75 shows an example of an upper surface coupled directly to cushioning elements with attached outsole elements.

In some instances, outsole elements and/or cushioning elements may be provided fully formed into the system and placed on a midsole and/or upper. An illustrative example shown in FIG. 75 includes preformed cushioning elements 260 which can be directly coupled to an upper 102 after activation. These cushioning elements may be positioned independently of one another, such that the elements are attached to another surface only on the surface contacting the upper. As shown, the cushioning elements 260 may include an outsole element 62 on the surface that would contact the ground. The cushioning elements may act as a midsole. Cushioning elements may include expanded particle foams, such as eTPU and/or ePEBA, expanded foams including EVA, or the like.

Some instances utilizing outsole elements may include an outsole element having a composition which includes a fusible material, a hot melt layer, a hot melt web, mechanical elements such as protrusions, screw elements, and/or indentations.

Figure 54:
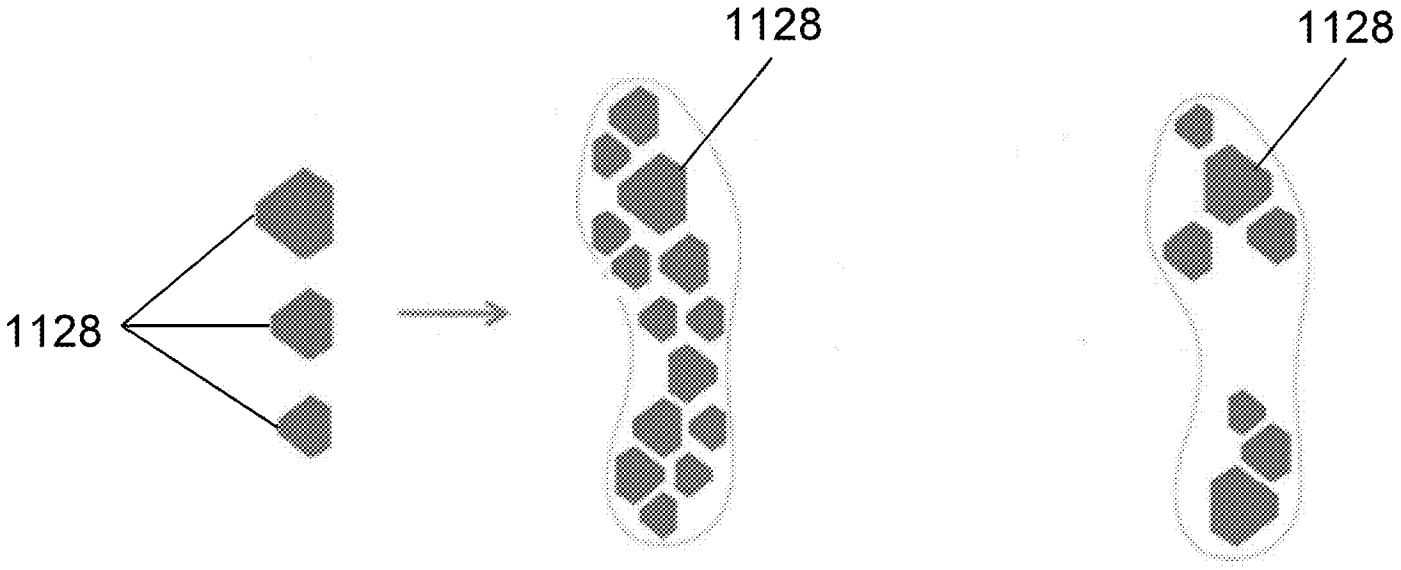
FIG. 54 shows an example of outsole elements and examples of configurations of outsole elements on an outsole manufactured using a method in accordance with an embodiment.

In some instances, outsole elements may be textured using a texturing device by the cutting device on demand, for example, a laser cutter. Alternately, outsole elements may be textured either prior to or after cutting. In other instances, outsole elements may be prefabricated and provided to the system. FIG. 54 depicts outsole elements 1128 that could be placed on a sole, midsole and/or added to an outsole to create the outsole or a portion thereof. As shown in FIG. 54, materials to be placed may include irregular shapes. Configurations of the outsole elements may vary based on the use of the shoe and/or the needs of the wearer.

Figure 55A:
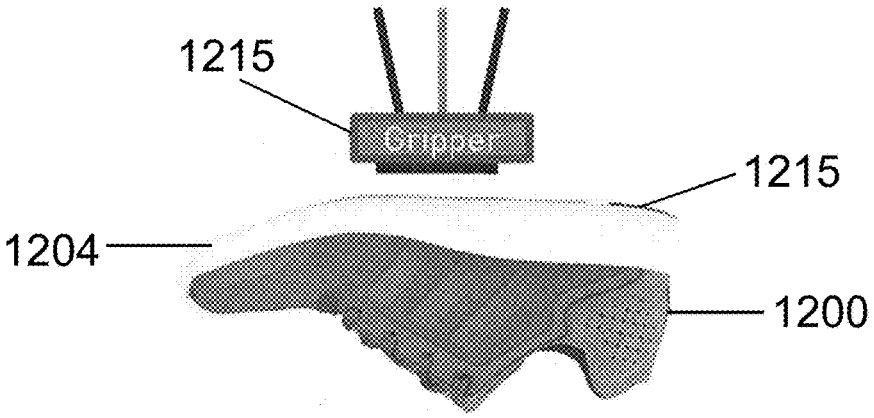
FIG. 55*a-b* show an example of a gripping device positioning outsole elements on a shoe using a method in accordance with an embodiment.
Figure 55B:
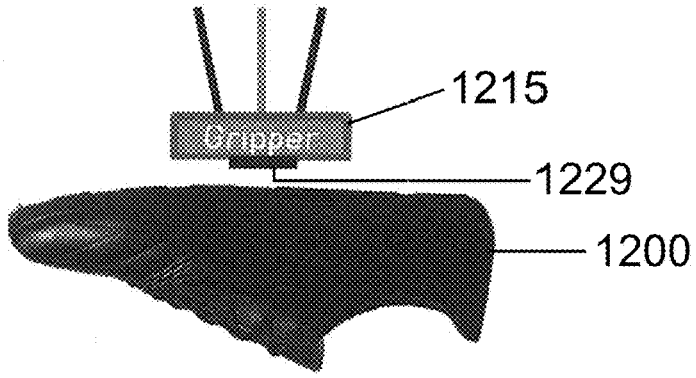

As an illustrative example, FIGS. 55*a* and 55*b* depict using a positioning device, such as gripping device 1215, to position an outsole element 1228, 1229 on shoe 1200. As shown in FIG. 55 outsole elements 1228, 1229 may be a substantially flat element. Further, outsole elements may be placed directly on the midsole. In other instances, an outsole element 1229 may be a stud as shown in FIG. 55*b*.

In some instances, outsole elements may include cushioning elements, lugs, studs, cleats, pins with claw or recess geometry, etc.

Materials for the outsole elements include, but are not limited to thermoplastic polymers such as TPU, PA12, etc., compounded materials, such as thermoplastic matrix materials, rubber, for example a rubber component having a thermoplastic adhesive on at least one side, and/or combinations thereof. In certain instances the outsole elements may be constructed from metal.

Outsole elements may be flat as shown in FIG. 55*a*. In some instances, outsole elements may be layered to increase a height of the outsole. For example, flat outsole elements may be combined with studs to increase the height of the outsole in a particular zone.

Shoes made using patches can be pre-assembled in current production and outsole is applied on demand, in-store, or close to point of sale.

Figure 57:
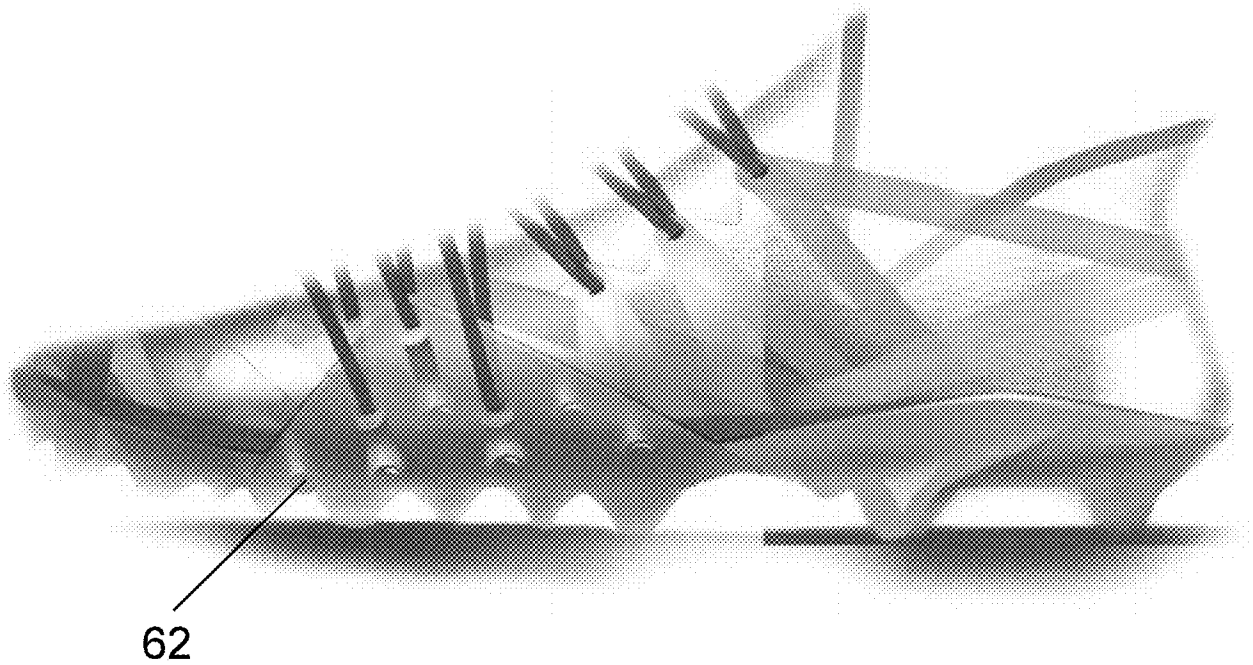
FIGS. 57-59 show additional illustrative examples of footwear in accordance with some embodiments.
Figure 58A:
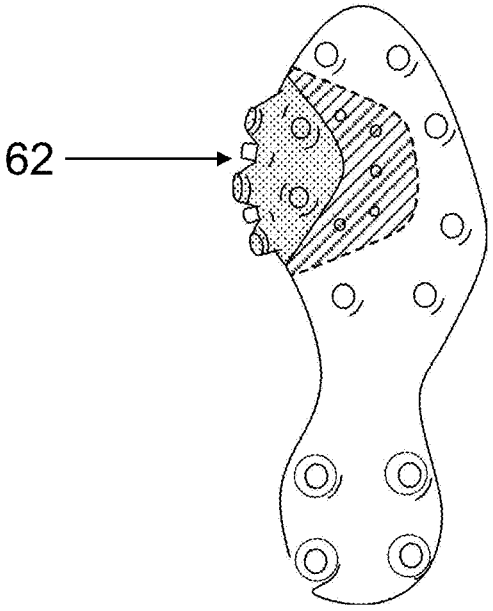
Figure 58B:
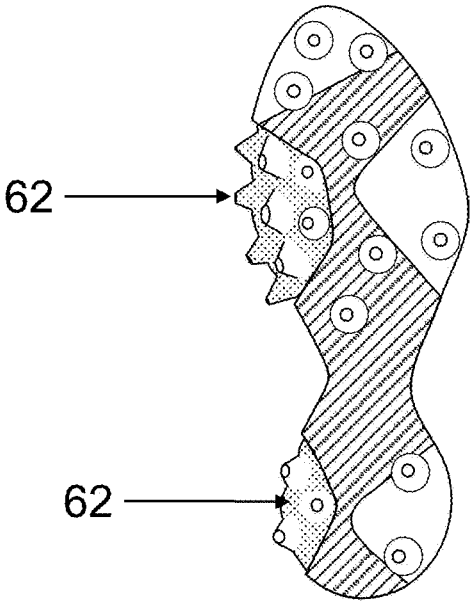
Figure 58C:
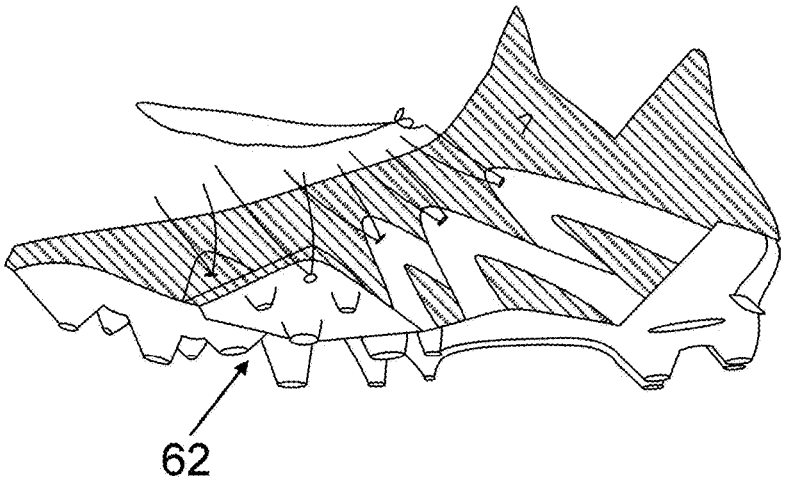
Figure 58D:
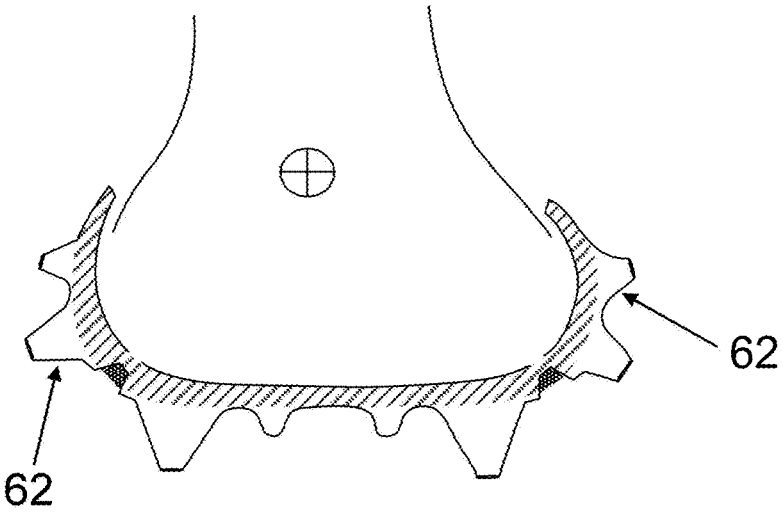
Figure 59:
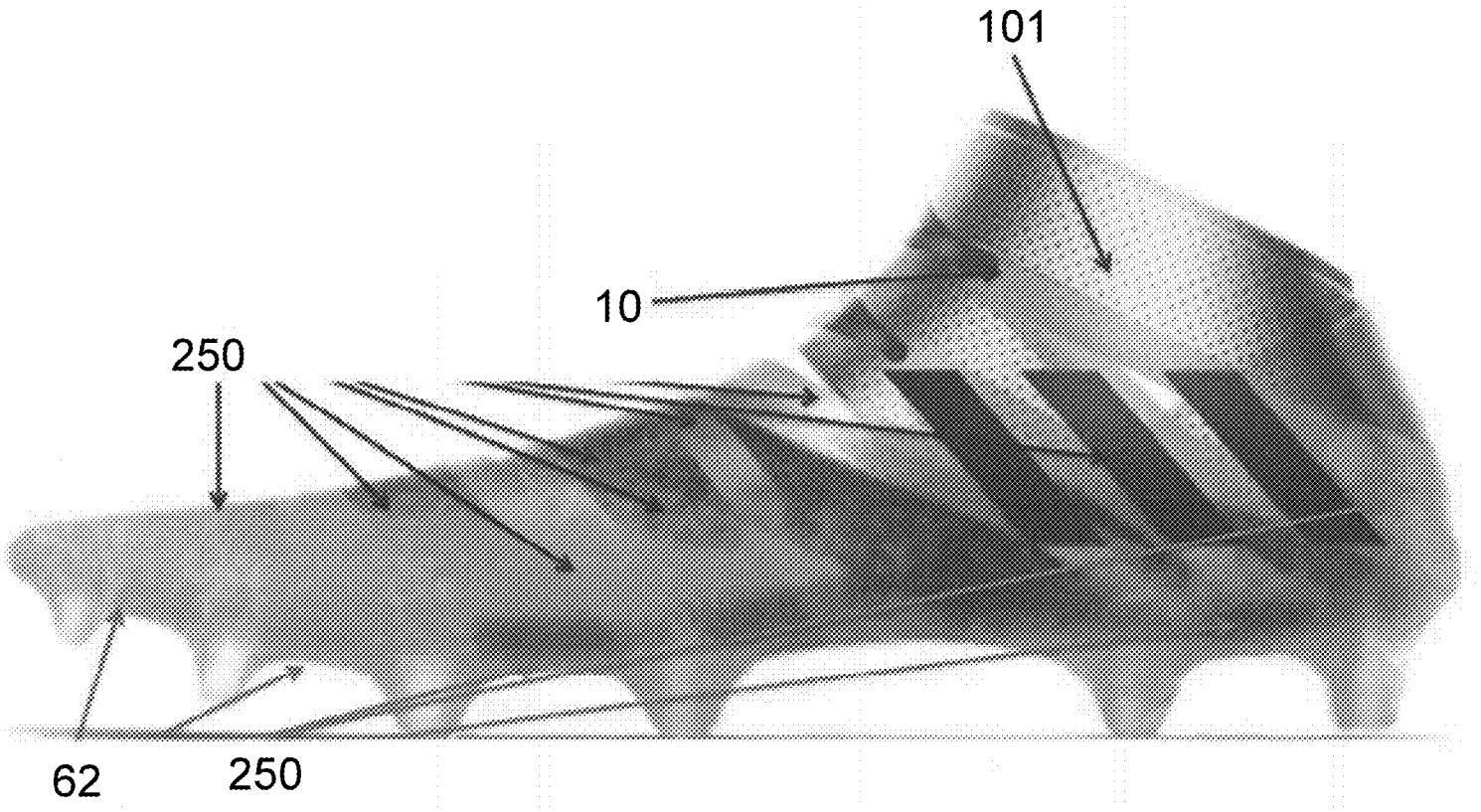

As shown in FIGS. 57-59, shoes 101 having various patched outsole elements 62 that extend from the outsole up onto the upper are depicted.

As shown in FIG. 59, grip patches 198 may be placed throughout the shoe in areas that have high ball contact. Abrasion resistant patches 246 are provided in areas of the shoe that have high levels of engagement and/or wear. High flex patches 248 are provided in areas that require additional flex and/or stretchability. Stability patches 250 provide additional stability to areas that should provide additional stability to the user. Further, additional patches may be provided for additional functionality, for example, waterproofing, reinforcement, cushioning, insulation, design, etc.

In some instances, patches may be placed on an upper, midsole, and outsole. In particular for sports involving lateral movements such as tennis, basketball, etc., additional stability in the forefoot region may be provided by patches which wrap around the shoe as shown in FIG. 12.

Figure 56:
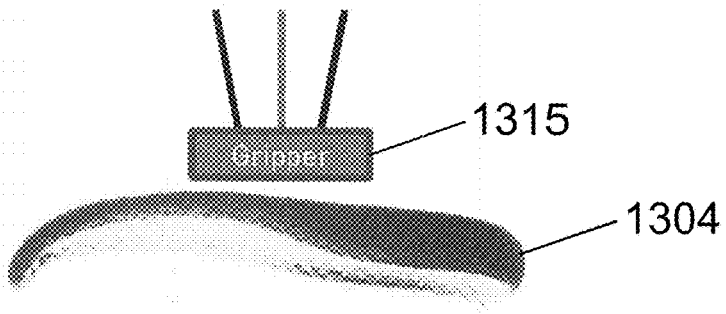
FIG. 56 shows an example of a gripping device positioning midsole using a method in accordance with an embodiment.

As illustrated in FIG. 56, a midsole 1304 as depicted herein may include any material including but not limited to particle foams, such as eTPU, foamed polymers, such as EVA, PU, solid Polymers, (e.g., PA12, TPU) and/or combinations thereof. Midsoles may also be positioned using a gripping device 1315, as shown in FIG. 56.

Figure 60:
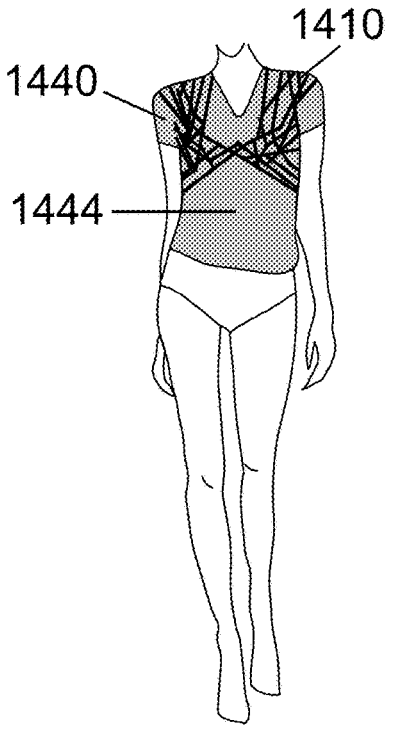
FIG. 60 shows an example of a shirt manufactured using a method in accordance with an embodiment.
Figure 61:
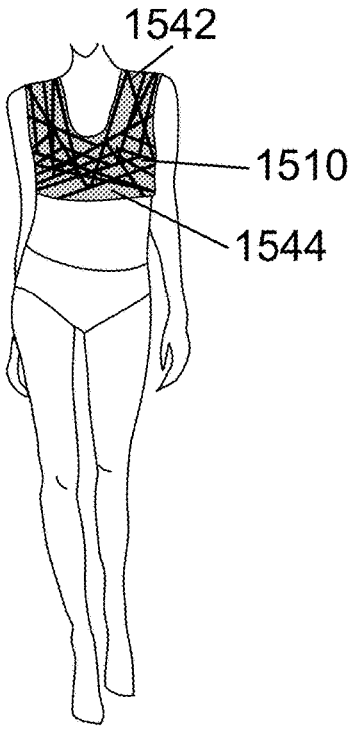
FIG. 61 shows an example of a bra manufactured using a method in accordance with an embodiment.
Figure 62:
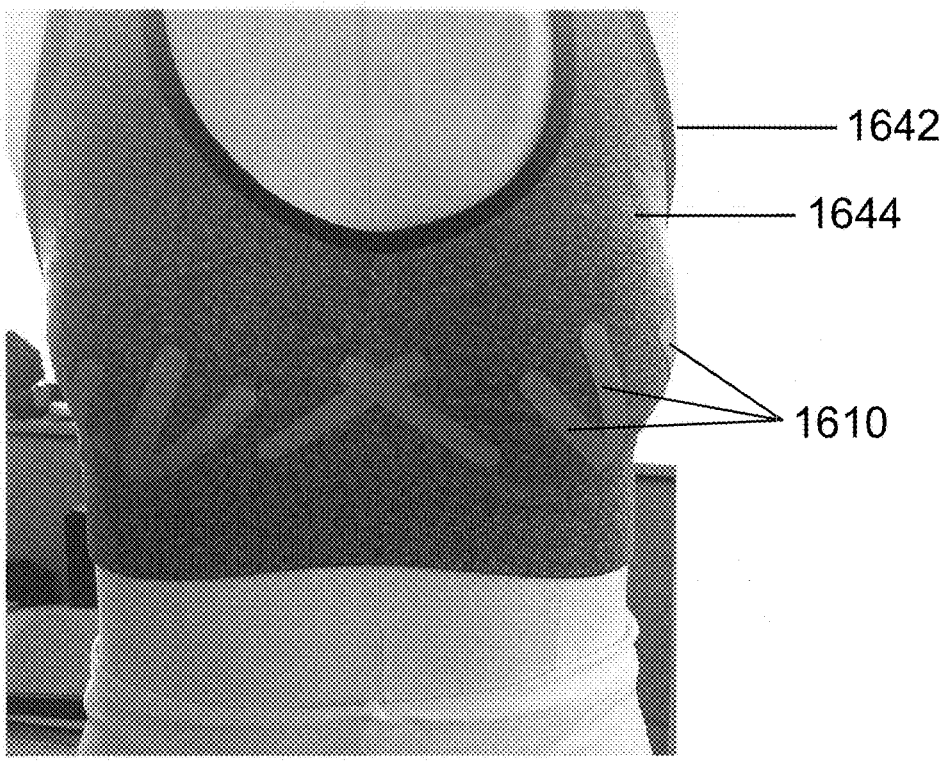
FIG. 62 shows an example of a bra manufactured using a method in accordance with an embodiment.
Figure 63:
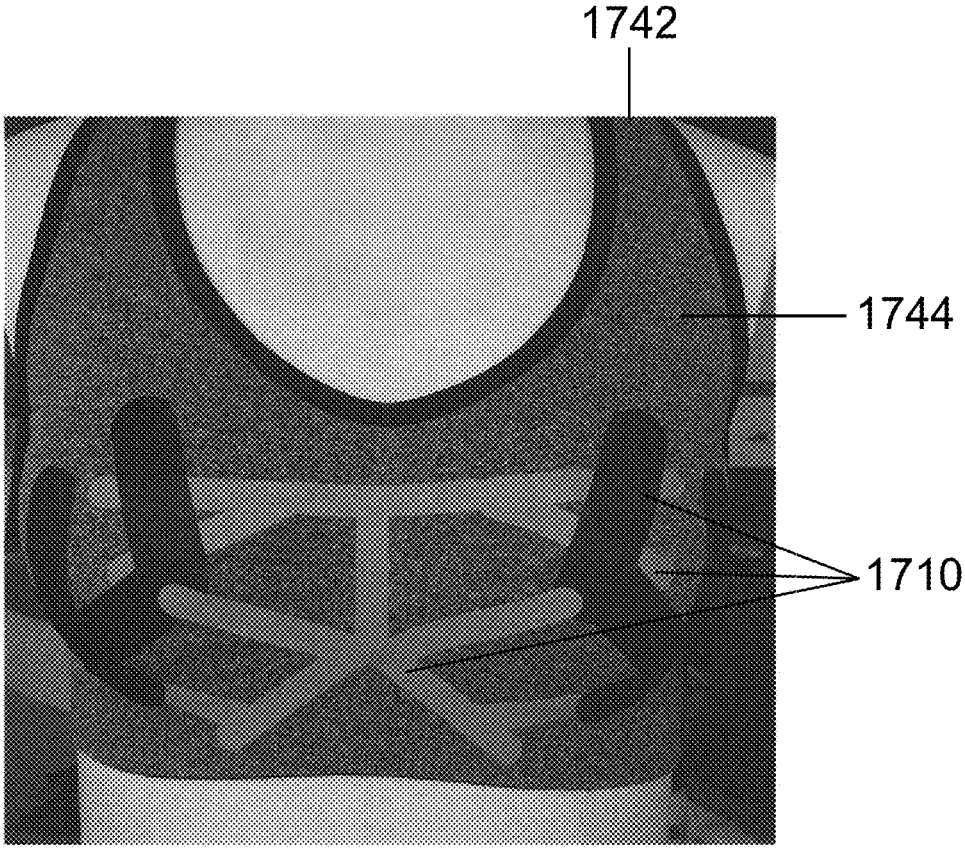
FIG. 63 shows an example of a bra manufactured using a method in accordance with an embodiment.
Figure 64:
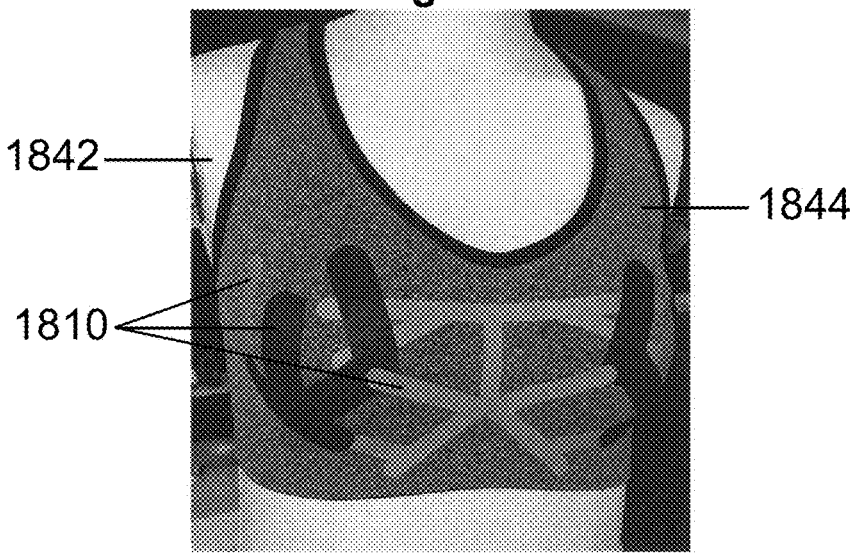
FIG. 64 shows an example of a bra manufactured using a method in accordance with an embodiment.
Figure 65:
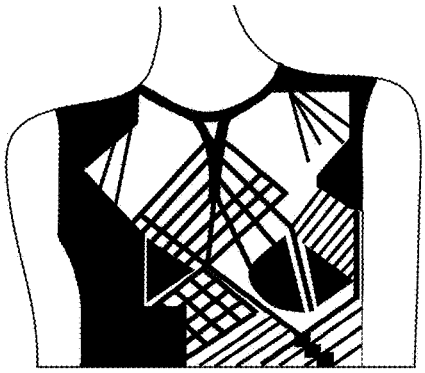
FIGS. 65-73 show examples of clothing manufactured using a method in accordance with an embodiment.
Figure 66:
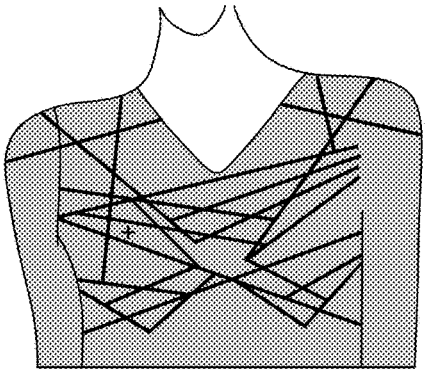
Figure 67:
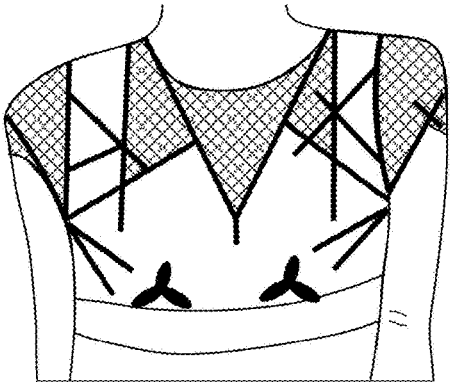
Figure 68:
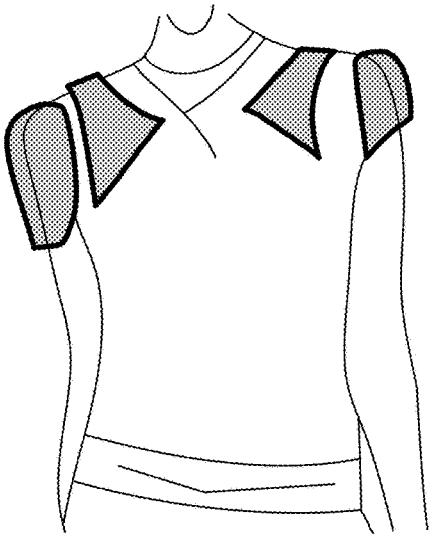
Figure 69:
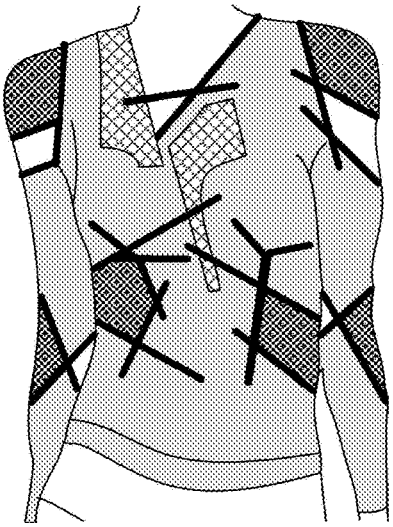
Figure 70:
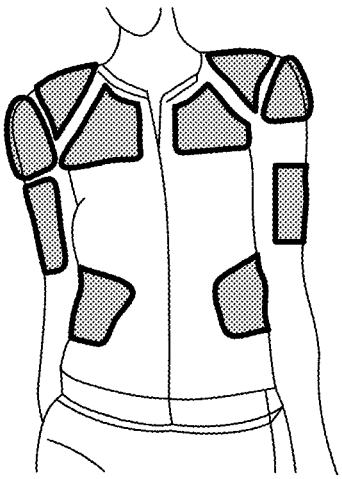

As shown in FIGS. 60-73, patches may also be used in clothing to provide support. As illustrative examples, FIGS. 60-61 show examples of a shirt 1440 and a bra 1542. Further examples of bras are shown in FIGS. 62-64. As can be seen in the various examples, configurations of the patches 1410, 1510, 1610, 1710, and 1810 on textiles 1444, 1544, 1644, 1744, and 1844 may vary depending on the needs of the wearer, since there are many different shapes of people with different needs for support, comfort, breathability, etc.

Further, patches may be used to impart properties to clothing. For example, patch constructions that include multiple patches may be layered to impart desired properties to the articles of clothing in the predetermined areas. FIGS. 3*b*-3*t* depict multilayered patches which are capable of imparting properties to articles which have been selected either by a designer or a user. Properties which may be affected by such patches include breathability, insulation, stability, cushioning, wind protection, water protection, design, reflectivity, etc.

Figure 71:
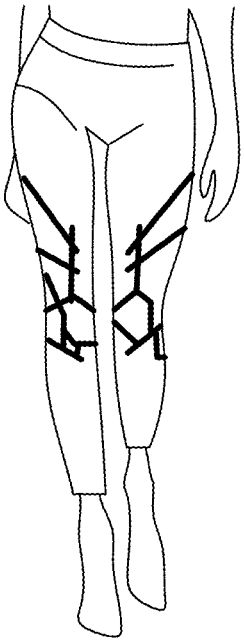
Figure 72:
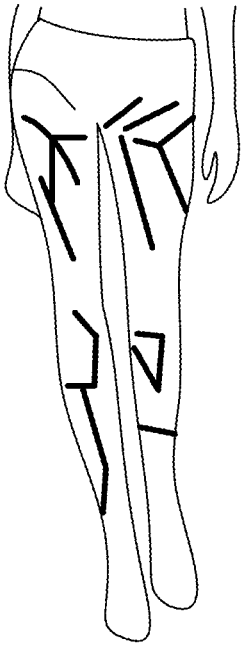

FIGS. 65-73 depict various examples of patched configurations on articles of clothing. As shown in FIGS. 71 and 72, patches 10 may be placed to correspond to muscle groups of interest.

Figure 73:
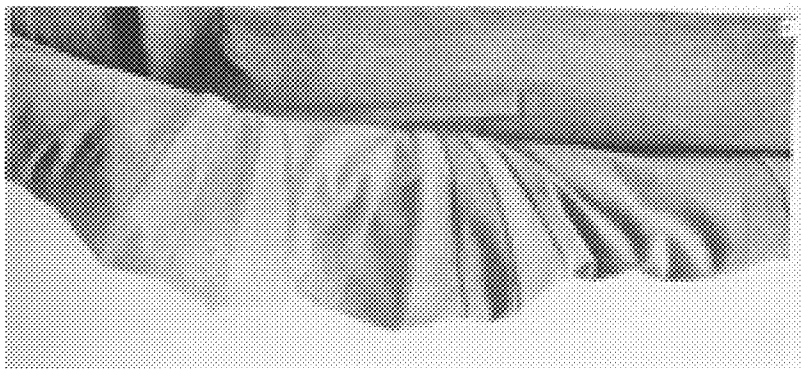

FIG. 73 depicts a patch configuration in a sleeve that allows for articulation of the arm. In this manner, patches can be placed which encourage movement in specific directions while limiting movement in others.

For example, based on data received from an athlete, observation data, and/or scan data patches may be placed on clothing to enhance the form of an athlete based on the demands of the sport of interest. In some instances, this may require an asymmetrical positioning of patches so that a sport specific motion is encouraged, for example, in baseball, tennis, baseball or golf.

Further, user information regarding weaknesses such as injuries may be used to identify areas on an article of clothing where additional support may be needed for example surrounding joints. For example as shown in FIG. 71 reinforcement around a knee region may provide additional support to the knee.

The method described above may also be utilized as a way to customize sporting goods, such as shoes, apparel, rackets, sticks, balls, and bats to meet the needs of the user/wearer.

In the case of shoes and apparel, information collected from a user to create a shoe or a piece of apparel includes, but is not limited to information entered directly by a user and/or stored in a database. User data of interest may include, but is not limited to sizing information such as measurements, for example, stored in a database, entered by a user, taken by the user or another person, such as a store associate, 3D scans, and combinations thereof. A user may input or cause this information to be inputted into a processing device such as a computer, a mobile phone, etc. that connects in some manner to a production apparatus to create the shoe or piece of apparel.

In addition, users may be asked to input data relating to preferred fit, activities, injuries, pain experienced in order to allow the system and/or a human operator to suggest configurations based on the user's needs. Thus, a customer can seek advice about suitable shoe models, articles of clothing, or suitable patch configurations, and/or the customer can individually design a desired shoe model or an article of apparel.

Similar information may be entered for the production of sporting goods such as rackets, sticks, balls and bats. In addition, it may be desirable to enter information relating to position played, batting averages, type of swings, etc. This information combined with user specific data described above allows for the production of user specific sporting goods.

Figure 74:
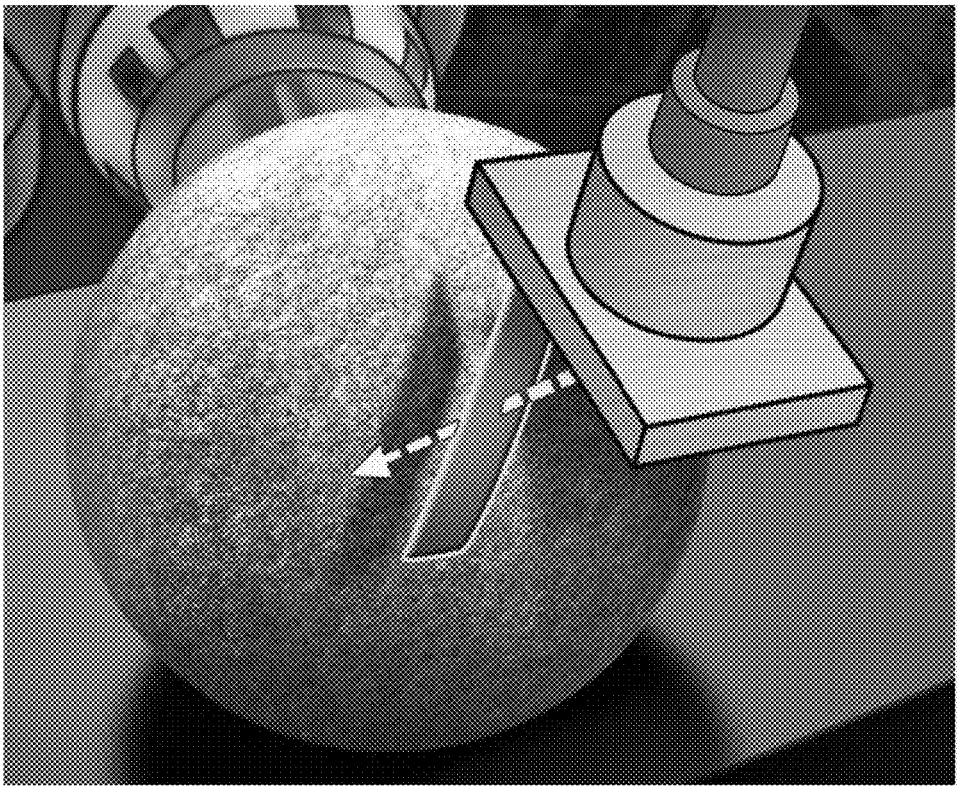
FIG. 74 shows an example of a ball manufactured using a method in accordance with an embodiment.

FIG. 74 depicts an illustrative example of the capabilities of creating a ball from a series of patches positioned on a carrier, in this case a ball bladder or structural element to create a textile layer of the ball. Further, in some instances patching may be used to create carcass or structural elements, foam layer, and/or the outer layer of the ball.

Articles constructed using this method for placing patches and/or components may have small tolerances for the accuracy of positioning. Some embodiments may have a tolerance for positioning of patches which is less than about 1 mm between the various patches, components, and/or base material. In some instances, it may be possible to operate having a positioning tolerance for the patches of less than about 0.5 mm. Further, as an illustrative example, uppers have been produced showing accurate positioning of the patches within a tolerance of 0.1 mm. In particular, it is possible to line up engravings on a first patch with those on a second patch to ensure that a look and/or physical effect is consistent. For example, patches having openings may be lined up in a multilayer configuration such that the openings are positioned above each other in such a manner that allows for an opening extending through the material.

Use of such a placing method may also reduce degradation of materials by reducing the production steps required to assemble an article. For example, a conventionally constructed shoe upper may use multiple process steps requiring heat and pressure to construct the upper, while in the placing method described herein a single consolidation may be used to fix the upper and its components after the initial placing and/or coupling of the materials. By reducing the number of steps, as well as the heat applied, the potential for degradation of patches and/or components on the upper is reduced during the manufacture of the upper.

The placement method described herein further may provide a significant reduction in waste when compared to conventional construction methods. Reductions may occur to more accurate placement and cutting of materials. Further, a need for some materials, like liquid adhesives may be drastically reduced when using the placing method described herein.

The method described above may also be utilized in a mobile sales stand, with the mobile sales stand comprising one or more apparatuses for performing an exemplary embodiment of a method according to the invention. Furthermore, a consultancy stand may be provided, where a customer can seek advice about suitable shoe models or the customer can individually design a desired shoe model or an article of apparel. After designing the desired shoe model, the production apparatus may, via the control means as described above, for example, be prompted to manufacture the shoe model designed by the customer.

The mobile sales stand may be used, for example, at trade fairs, major events, sports events, etc. For example, the mobile stand may be positioned at a sporting event with designs specific to that sport defined and available for customization by customers. Designs elements specific to a location, an event or the like may be available in the mobile sales stand for construction of the articles. For example, customers may be able to select an event themed design and modify for their particular use and/or their anatomy. In some instances, the article could be produced during the event and picked up by the customer after the event. Thus, it would be possible for customers attending a game, running a marathon, skiing for the day or the like, to stop by the mobile sales stand as they are leaving and pick up their articles, for example, clothing, shoes, balls, etc. ready for use.

In some instances, customers may be able to customize their selections in advance, allowing customers to pick up their articles at a mobile sales stand.

However, it is also conceivable that the mobile sales stand be placed in a department store. Moreover, an embodiment of a sales room comprising an apparatus for performing an exemplary embodiment of a method according to the invention is also conceivable.

Finally, the above explained embodiments for manufacturing methods may also be used in a business scenario, wherein a customer himself designs a sporting good and then places an order for the designed good. For example, the customer might use a graphical user interface provided on a website of a manufacturer or distributor for the design process and for a subsequent business transaction. The design data resulting from the input of the customer are then provided to a manufacturing apparatus as explained above, for example the at least partially transparent container mentioned above. The apparatus then produces the sporting good with the above described method based on the individually selected design data of the customer.

Regardless which specific apparatus is used, the production process may be recorded with a camera and possibly communicated back to the customer or even any other recipient using the internet or social networks. In some embodiments, the customer may even be able to see the production of his/her individualized sporting good "in real time", which leads to a unique customer experience and/or would even allow the customer to intervene, if the design of the resulting good as it is produced does not meet his/her expectations.

An exemplary embodiment of a method according to and aspect of the inventive idea of the present invention will now be described with respect to FIG. 78. Generally, the method of manufacturing sporting goods according to the present invention is suitable for manufacturing sporting goods such as sports shoes, balls (such as soccer balls, basketballs, volleyballs, etc.), sports bags, apparel, clothing, etc. The method is also useful for manufacturing parts of the mentioned sporting goods, such as shoe uppers, panels for balls, bodies of bags, parts of apparel (e.g., sleeves), etc.

The method comprises the step (a.) of selecting a base layer 22. In the example of FIG. 78, this base layer may be a textile layer, such as a woven fabric or a knit. However it may also be of different material such as non-woven, leather, etc. For example, the base layer may be a knitted upper for a sports shoe. As shown in FIG. 78, the base layer 22 is placed on a carrier 18 which forms a supporting structure for the base layer 22.

The method further comprises the step (b.) of selecting a thin component 10 comprising an at least partially meltable layer. In the example of FIG. 78, three such components are shown and denoted with the reference numeral 10. In the example of FIG. 78, the components 10 have the shape of patches.

According to the invention, any number of components (for example one, two, or more than two) may be processed at the same time and the components 10 may have an arbitrary shape. In the context of the present invention a thin component is understood as a component whose thickness is smaller than its length and its width. In particular the total thickness of the thin component before consolidation and including the hot-melt layer, may be comprised between 10 micrometers and 5 millimeters, and more particularly between 150 micrometers and 750 micrometers, for example of about 300 micrometers. In some specific applications requiring a firm support of the foot, the thickness of the thin components may be chosen with a relatively high value, for example 700 microns for a basketball shoe.

The components 10 may for example be polymeric patches with two different layers. The bottom layer, i.e., the layer facing the base layer in subsequent method steps may be the at least partially meltable layer. The top layer may be a visible layer, such as a heel counter for example. The thin component 10 may in particular comprises a meltable layer of about 100 micrometers and a top layer of about 300 micrometers. The meltable layer is activated (i.e., softened or melt) through heat at lower temperatures than the visible layer. Thus, as the component 10 is consolidated as described in more detail below, the meltable layer ensures the bonding of the visible layer with the base layer. The thin components 10 may for example be made from polyurethane or thermoplastic polyurethane, but may generally be made from any kind of material with at least an outer (bottom) meltable layer.

For thin components comprising at least a bottom layer and a visible layer (said bottom layer being adapted to be bonded with the base layer, such as for example a hot-melt layer) the material of the bottom layer and of the visible layer may be optimized for consolidation methods according to the invention, in particular in case many components are at least partially superimposed on each other. In order to ensure that the hot-melt of each component in a stack of component melts during the pre-consolidation steps and more particularly during the consolidation step, the temperature difference between the melting ranges of temperature of the hot-melt and of the other layers of the component must be sufficiently important to ensure that each hot-melt layer of the stack of component is softened or melted enough to ensure a good bonding, while the visible layers are not degraded. More particularly when two or more components overlap each other, the lower layer of the lower component (in contact with the base layer) must be melted during the consolidation step at least, while the upper layer of the top component must maintain its characteristics. This is particularly the case when the heat is applied from above the assembly, e.g., with a hot-bladder also applying pressure as described herein in some embodiments. The higher the number of components in a stack, the bigger the temperature difference between the melting ranges of temperature of the hot-melt and of the other layers of the component must be.

The temperature of the pre-consolidation and/or consolidation step (second temperature and third temperature) may also be chosen to ensure that the upper layer of each component at least softens slightly, in order to ensure a fusion with the hot-melt layer of a component placed on top of it. The melting range of temperature of the visible layer, in particular of the top layer of the component is beneficially chosen higher than and separated from the melting range of temperatures of the hot-melt (bottom) layer. Therefore the pre-consolidation and/or consolidation temperature may be chosen in the first half of the melting range of the visible layer.

Also the material of the hot-melt layer of the components and/or the temperature of the pre-consolidation and/or consolidation steps may be adapted depending on some characteristics of the base layer. More particularly, the second temperature may be chosen higher comparatively to the melting range of temperatures of the at least partially meltable layer of the thin component for a more open textile, in particular a more open knit structure. In the same way, the third temperature may be chosen higher comparatively to the melting range of temperatures of the at least partially meltable layer of the thin component for a more open textile, in particular a more open knit structure. That way the hot-melt material will be less viscous and will penetrate better the surface of the base layer to ensure a better bonding.

A thin component is understood in the context of the present invention as a component with a thickness smaller than its length. Thus, a thin component may for example be a patch as described in the co-pending application DE 10 2015 224 885.2 of the present applicant. This application also contains details on how patches may be placed on a base layer. Generally, the component 10 may be any kind of material with at least one meltable layer.

The method further comprises the step (c.) of applying at least a part of the thin component on at least part of the base layer so as to form an intermediate assembly, such that the meltable layer is at least partially in contact with the base layer. Thus, in case of a shoe upper, for example, one or many thin components may be placed in the shape of a heel counter on the shoe upper, thereby forming an intermediate assembly.

In some embodiments, a temporary fixation of the component on the base layer is performed before the subsequent method steps are performed. This temporary fixation may be obtained by heat activating the bottom layer of the components before applying them with pressure onto the base layer. For example, in one embodiment, the thin components 10 are picked up by a vacuum gripper, brought to a heat source (e.g., an infrared lamp) to activate the bottom layer and applied with pressure on the base layer. However, other methods of temporary fixation such as ultrasonic welding, stitching, etc. may be used as well.

The method further comprises (d.) a first consolidation step during which pressure is applied to the intermediate assembly at a first temperature. The consolidation consolidates the bonding of the thin component 10 to either other components placed beneath and/or to the base layer 22.

Figure 78:
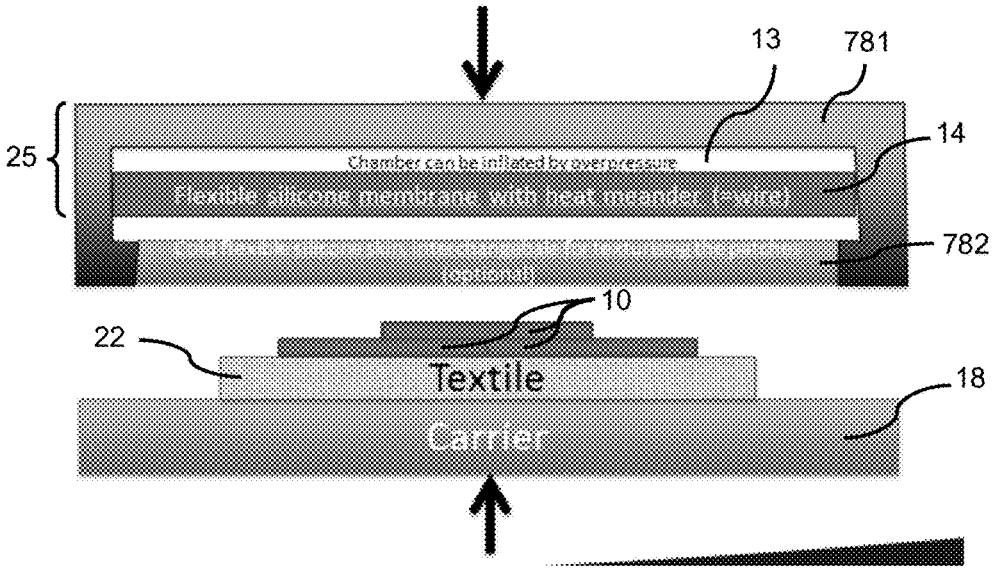
FIG. 78 shows a schematic drawing of a method in accordance with an exemplary embodiment.

In the example of FIG. 78, pressure is applied by a bladder 25 which is formed by a cavity 13 formed by a flexible silicone membrane 14 skin mounted on a frame 781. The cavity 13 can be inflated by overpressure to push the membrane downwards against the components 10. This step is performed at a first temperature which is lower than the temperature used in the subsequent second consolidation step. For example, the temperature may differ from room temperature by not more than 10° C.

Additionally, an optional contact layer 782 is arranged between the bladder 25 and the components 10. In the example of FIG. 78, this contact layer 782 is a flexible silicone skin. This contact layer 782 may be interchangeable to be replaced in case of damages. In addition, it may be textured to impart a pattern onto the visible layer of the components 10. In the example of FIG. 78, the contact layer is "cold", i.e., at the moment when applied to the intermediate assembly, the contact layer is at the first temperature. Also in the represented embodiment of FIG. 78, the contact layer does not comprise a heating device, such as electrical wires, although, this is generally possible in the context of the present invention. The inventors have observed that having a contact layer 782 is also beneficial as it sticks less to the intermediate assembly and in particular to the patches after the consolidation (application of pressure and heat), and when it does, the replacement of a contact layer is much easier, cheaper and quicker than the replacement of a hot bladder.

The method further comprises (e.) a second consolidation step during which pressure is applied to the intermediate assembly at a second temperature which is higher than the first temperature, wherein the second consolidation step is performed after the first consolidation step.

In the example of FIG. 78 the bladder 25, more precisely the silicone membrane 14, comprises embedded electrical wires so that it can be heated up to transfer heat to the intermediate assembly via the (optional) contact layer 782. The embedded wires may for example be made of carbon fiber strands. Thereby, the cold contact layer 782 heats up and transmits heat to the intermediate assembly, and, after a given delay (depending on the thickness of the contact layer, its thermal transmission properties and the temperature difference between the heated bladder 25 and the intermediate assembly), the heat is transmitted to the intermediate assembly. Thus a second temperature is reached which is higher than the first temperature of the first consolidation step.

The temperature of the heated bladder may be constant in order to maximize the manufacturing process time. Alternatively, the temperature of the heated bladder may be varied between first step and second step to reach the second temperature.

The total thickness of the contact layer 782 is comprised between 1 mm and 10 mm.

The device may comprise two or more superimposed contact layers. The inventors have noticed that it is beneficial in many ways to use more than one contact layer, said contact layer being applied simultaneously in a superimposed position. In particular they have noticed that it may delay the second step (second temperature kick-in) and reduce the adherence between the contact layer and the assembly. For example, two silicone layers may be used on top of each other, wherein the first layer that comes into contact with the intermediate assembly may have a thickness of approximately 0.3 mm and the other silicone layer between the first silicone layer and the bladder 25 may have a thickness of approximately 2 mm. However, it should be noted that another number of silicone layers and other thicknesses may be used as well in the context of the present invention.

Thus, two consolidation steps are performed according to the method of the invention with only a single device thereby facilitating the maintenance of pressure between the first and the second step, although it should be noted that both consolidation steps may also be performed on different devices. In this latter case, the pressure on the intermediate assembly may be maintained when moving the intermediate assembly between devices.

The first consolidation step described above may be performed at a temperature between 40° C. and 120° C., but heating is delayed thanks to the silicone skin (contact layer 782), as described above. In a preferred embodiment the temperature of the bladder 25 in the first consolidation step is about 80° C. The first temperature at the surface of the intermediate assembly is actually lower because of the contact layer(s) (silicone skin(s)) between the bladder 25 and the components 10.

The pressure on the intermediate assembly is increased by about two bar over the atmosphere pressure as the bladder 25 is inflated by the overpressure in the cavity 13. Because the silicone skin 782 is thick, heat transfer is poor, and the intermediate assembly of base layer 22 and components 10 first experiences a pressure application before it experiences a heating. Thus, there are two consolidation steps: A first consolidation step during which pressure is applied to the intermediate assembly (base layer 22 and components 10) at a first temperature and a second consolidation step during which pressure is applied to the intermediate assembly at a second temperature which is higher than the first temperature.

The silicone skin 782 is applied to the intermediate assembly for a duration of between 10 seconds and 200 seconds, in particular of about 60 seconds.

Figure 79:
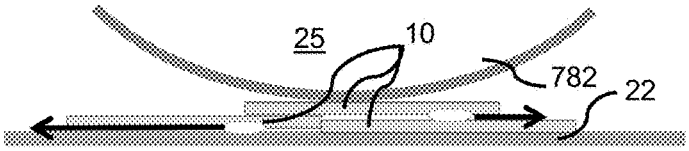
FIG. 79 shows a schematic drawing to illustrate the effect of an aspect in accordance with an embodiment.

The method according to the invention is particularly advantageous as it avoids or at least reduces the formation of bubbles in the meltable layer. This effect is amplified by using an inflatable bladder 25. As shown in more detail in FIG. 79, thanks to the shape of the bladder 25, the pressure application is progressive from a central point and along a circular pressure wave with an increasing radius, so that air trapped between patches and the base layer or between patches can escape to the sides of the patches 10 as indicated by the arrows in FIG. 79. Thus, any air bubbles are eliminated before the exterior edges of the components 10 are also pressed (and potentially heated) and sealed to the base layer 22 or another component underneath. In this way, the process prevents or at least decreases the formation of air or gas bubbles between the at least one component 10 and the base layer 22.

The methods steps described so far may lead to a pre-consolidation of the intermediate assembly, i.e., the thin components 10 are not ultimately bonded to the base layer 22 or are not ultimately bonded to each other. However, thanks to the two consolidation steps described above, air or gas bubbles have been removed or at least reduced between the thin components 10 and the base layer 22 and thanks to the application of heat, the thin components 10 have a sufficient bond to the base layer 22 and among each other to prevent the formation of new air or gas bubbles.

To ultimately consolidate the intermediate assembly of thin components 10 and base layer 22, in a preferred embodiment of the present invention, the carrier 18 and the pre-consolidated assembly on top of it may be brought to a second station of the same construction as described above with respect to FIG. 78, where heat and pressure are applied as fast as possible in order to complete the consolidation. Here, the consolidation is performed at a higher temperature. To this end, the silicone skin 782 (contact layer) may be thinner in this second station in order to allow for a quick heating. Alternatively, the silicone skin 782 is omitted and heat is applied directly by the silicone membrane 14 of the bladder 25 (see FIG. 78). In this case, the silicone skin 782 may have a thickness of preferably about 1 mm. In addition, the temperature of the bladder 25 may be higher than in the first station. To this end, the power of the second station may be higher compared to the first station (e.g., 22 kW instead of 8 kW) in order to ensure a quick heating and a constant high temperature of the bladder 25 even when applied to the pre-consolidated intermediate assembly. The temperature may be selected in the melting range of the bottom layer of the thin components 10 (melt layer), or even in the melting range of the thin component itself (functional layer). The temperature of the bladder may be selected so that the temperature applied to the pre-consolidated assembly is between the melting range of the meltable layer and the visible layer.

In some beneficial embodiments, the temperature of the bladder may be selected so that the temperature applied to the pre-consolidated assembly is in the first portion of the melting range of temperatures of the visible layer, in particular when the melting range of the visible layer is very broad. These embodiments provide a better consolidation of stacks of thin components because the top portion of the visible layer of a first component may soften and create better bonding with the hot-melt layer of second component placed on top of said first component.

However, it is also possible that the consolidation works at temperatures lower than the melting range of the functional layer, for example by increasing the cycle time, i.e., the duration of application of heat and/or pressure. In the currently preferred embodiment of the present invention, the temperature of the bladder 25 is about 130° C. to 200° C., in particular between 120° C. and 160° C., while pressure remains the same compared to the pre-consolidation steps at about 2 bar.

At the second station the silicone membrane 14 (or the contact skin 782 if used) is also applied to the intermediate assembly for a duration comprised between 10 seconds and 200 seconds, in particular between 60 seconds and 120 seconds. Longer or shorter durations are generally possible depending on heat, temperature and the material of the melting layer of the thin components 10.

Figure 80:
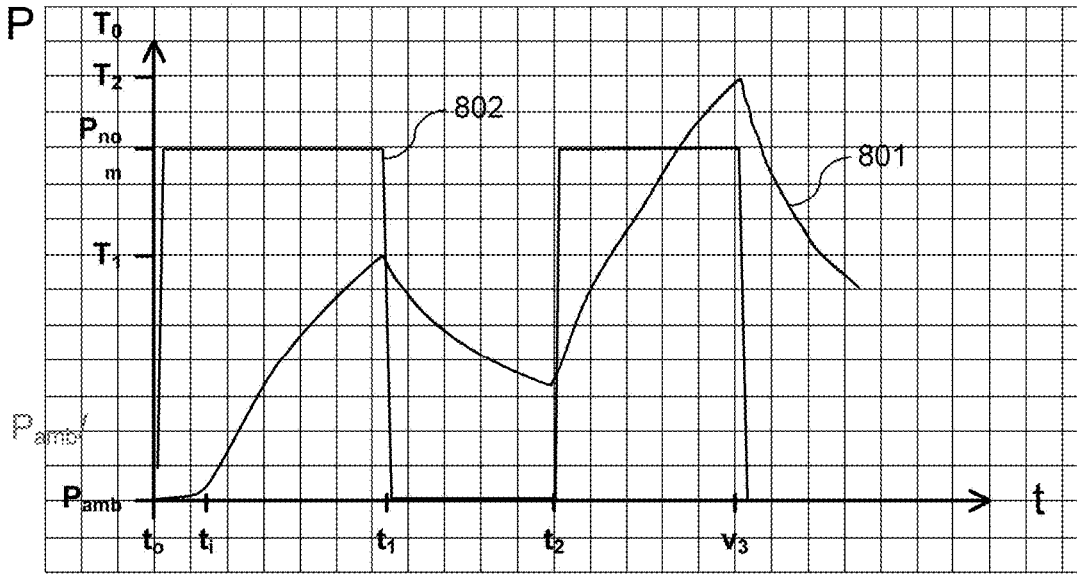
FIG. 80 shows the temperature and pressure experienced by an intermediate assembly during the process of an embodiment.

FIG. 80 shows a schematic illustration of temperature 801 and pressure 802 experienced by the intermediate assembly during the process described above. At time t0 the first contact layer 782 of the first station is applied at a pressure of 2 bar (Pnom) to the intermediate assembly. At time t1 heat starts to transfer to the intermediate assembly and the temperature rises to a temperature T1. The delay in heat transfer between time t0 and time t1 is due to the contact layer 782 between the bladder 25 and the intermediate assembly. The characteristics of the contact layer 782 such as thickness, heat transfer coefficient may be adjusted to modify the delay between time t0 and time t1. At time t1 the contact layer is removed from the intermediate assembly and the temperature starts to decrease while the carrier 18 with the intermediate assembly on top of it is brought to the second station. During this transfer, the pressure is at ambient pressure (Pamb). At time t2 the second contact layer of the second station is applied to the intermediate assembly again at 2 bar (Pnom). Heat is applied nearly immediately at time t2 as the temperature T0 of the second bladder of the second station is higher and the contact layer of the second station is thinner than the contact layer of the first station. At time t3 the contact layer is removed, pressure decreases to ambient pressure (Pamb) and the intermediate assembly starts to cool down.

Figure 81:
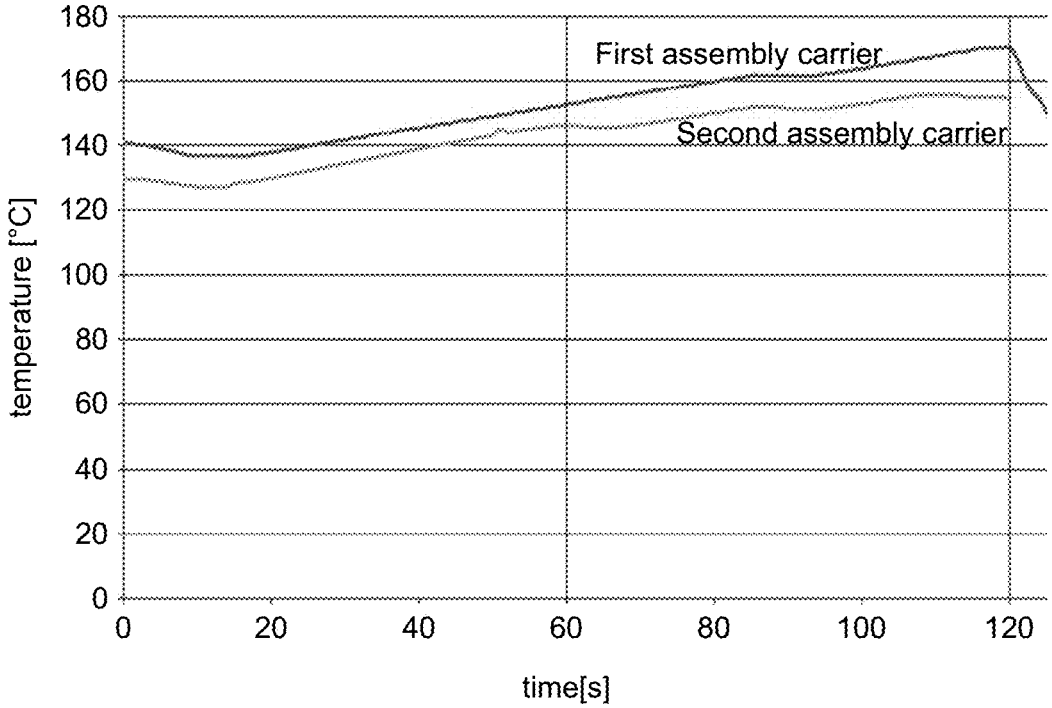
FIG. 81 shows the results of temperature measurements taken at the surface of an intermediate assembly.

FIG. 81 shows the results of temperature measurements taken at the surface of the intermediate assembly during the final consolidation step at the second station. In this case, the bladder temperature was set at 200° C.

As shown in FIG. 81, the temperature is lowering during the first 15 seconds due to the fact that the pre-consolidated intermediate assembly was warmed up in the first pre-consolidation station and cools down when being transferred to the second consolidation station where the consolidation at higher temperatures is performed. Also, when applied, the silicone membrane 14 (or the silicone skin 782 when applied) of the second consolidation station is initially cold compared to the temperature of the pre-consolidated assembly which is still warm from the first pre-consolidation station. On this FIG. 4, the time 15 seconds corresponds to the time t2 of FIG. 80, and the time 120 seconds corresponds to the time t3 of FIG. 80.

The two different graphs shown in FIG. 81 correspond to two different options of the carrier 18 (supporting structure) on which the base layer 22 is placed. The nature of the carrier has an effect on the temperature in the intermediate assembly because different carriers may have different heat transfer coefficients. In the example of FIG. 81, the first assembly carrier is better heat insulated and therefore the temperature remains higher than with the second assembly carrier.

To speed up the process according the invention, at least two contact layers may be used which are mounted on a continuous rolling belt. When the heated bladder 25 heats a first contact layer for consolidating a first assembly, the first contact layer is also heated up. After the bladder 25 is deflated and releases pressure from the intermediate assembly, the first contact layer is wound to an external side ("cooling position") of the manufacturing station to cool down, while a second contact layer moves in place between the heating bladder 25 and a new second intermediate assembly taking the place of the first intermediate assembly. Thus, the consolidation of the second intermediate assembly may immediately be performed with the cool second contact layer.

In the currently preferred embodiment of the present invention, the carrier 18 comprises a polymeric upper layer, a core glass layer and a polyether-ether-ketone (PEEK) frame under the glass layer. PEEK is a high temperature resistant thermoplastic material and belongs to the substance group of polyaryl. The upper layer is adapted to provide a high friction with the base layer of the intermediate assembly. To this end, it may comprise a surface structure comparable to a skateboard griptape in order to limit the movements of the intermediate assembly on the carrier when heat and pressure are applied so that the position of the thin components 10 remain constant relatively to the base layer 22 even when their lower melt-layer is melted.

Alternatively to the second consolidation station as described above, only one consolidation station may be used with a thin and a thick contact layer (silicone skin) mounted on a continuous rolling belt as will now be described with respect to FIG. 82. The pre-consolidation and consolidation station 51 comprises a carrier (supporting structure) 18 on which a base layer 22 may be placed as described above. A first contact layer 782*a* and a second contact layer 782*b* are mounted on a continuous rolling belt 821. The first contact layer 782*a* is attached to the continuous rolling belt 821 via two attachments 822*a* and 822*b*. The second contact layer 782*b* is attached to the continuous rolling belt 821 via two attachments 823*a* and 823*b*. The first contact layer 782*a* in this embodiment is thicker than the second contact layer 782*b*, such that it transfers heat more slowly.

The station comprises a bladder 25 with embedded heating wires. When the heated silicone membrane of the bladder 25 heats the first contact layer 782*a* for consolidating the intermediate assembly, the first contact layer 782*a* is also heated up and transfers heat and pressure to the intermediate assembly. When the bladder 25 is deflated pressure is released from the intermediate assembly. Subsequently, the first contact layer 782*a* is wound to an external side (cooling position) of the station by means of the continuous rolling belt 821 to cool down, while the second contact layer 782*b* moves in place between the bladder 25 and the intermediate assembly. Then, the bladder 25 is inflated and heat is transferred from the bladder 25 to the intermediate assembly via the second contact layer 782*b*. As the second contact layer 782*b* is thinner than the first contact layer 782*a*, heat is transferred more early and more heat is transferred in a shorter period of time compared to the first contact layer 782*a*.

Additionally, the temperature of the bladder 25 may be varied in between the first step and second step (for which the first contact layer 782*a* is used) and the third step (for which the second contact layer 782*b* is used).

Figure 82:
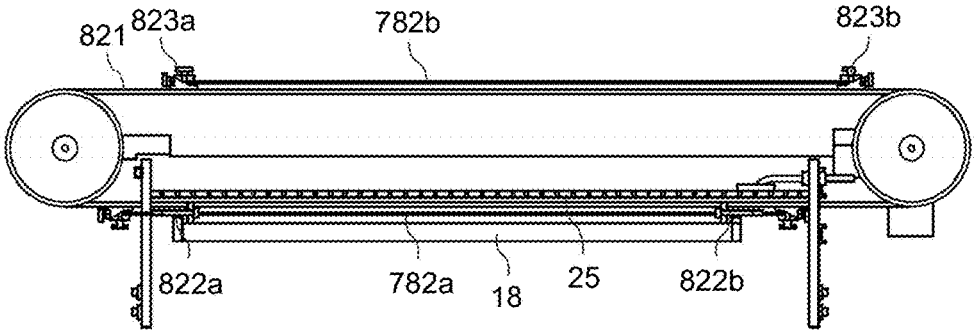
FIG. 82 shows schematic drawing of an embodiment of an apparatus.

Alternatively, two stations similar to the station depicted in FIG. 82 may be used, wherein the first station has two thick contact layers and the second station has two thin contact layers. Thus, the first station always performs pre-consolidation, i.e., the first and second steps described above, and the second station performs consolidation, i.e., the third step described above.

Generally, the duration of the pre-consolidation (first and second step) may be comprised between 10 seconds and 300 seconds, in particular about at least 60 seconds, for example about 150 seconds. The duration of the consolidation (third step) may be comprised between 10 seconds and 300 seconds, in particular about at least 60 seconds, for example about 150 seconds. That way the cycle time on each station may be the same, so as to ensure a fluid production.

Figure 83:
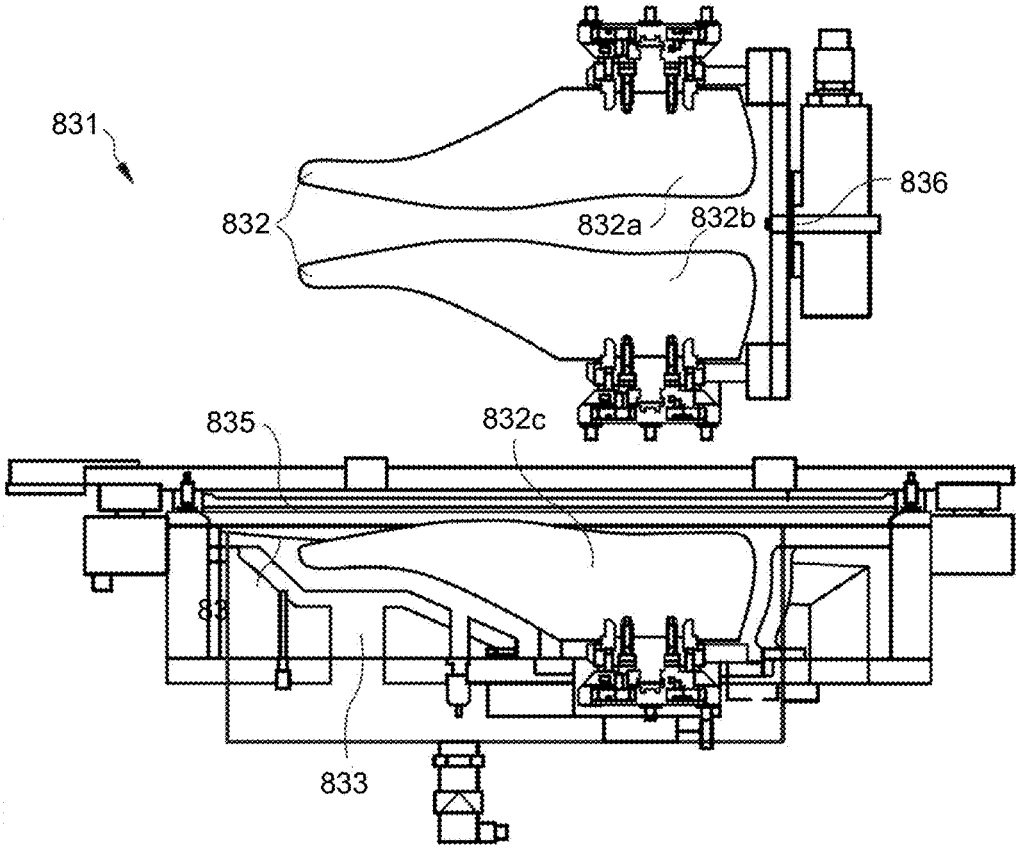
FIG. 83 shows a schematic drawing of a further embodiment of an apparatus.

FIG. 83 shows a schematic drawing of yet another pre-consolidation/consolidation station 831 which may be used in the context of the present invention. The station 831 is especially suited for the manufacturing of three-dimensional objects like for example shoe uppers. To this end the station 831 comprises a last 832 which is shown in FIG. 83 simultaneously in two positions: in the first position 832*a* the last is in an upright position, whereas in the second position 832*b* the last is rotated to a bottom position around a rotation axis 836. Patches can be placed in the first, upright position 832*a* because of gravity, as the patches are usually placed on the upper side of the shoe. During manufacturing the patches lie on a conveyor before being picked up and placed by a robot on the upper. Therefore, it is quicker for the robot to place the patches on an upright positioned last, than to do a rotation for each patch. In the bottom position 832*b* the last 832 can be lowered to enter a cavity 833 as indicated in FIG. 83 by reference numeral 832*c*. The cavity may be supplied with hot and pressurized air. Inside the cavity 833 is a flexible inflatable bladder 834. The cavity may be closed by a closing lid 835 comprising a membrane on its lower side.

The operation of the station 831 is as follows: An intermediate assembly of a base layer and one or more thin components is placed on or formed directly on the last 832. The last then enters the cavity 833. The cavity 833 is supplied with hot and pressurized air which causes the bladder 834 to contact the last and the intermediate assembly. In a preferred embodiment the bladder 834 comprises a silicone skin as a contact layer to avoid sticking of the intermediate assembly to the bladder 834 and to delay the heating as described above. The bladder 834 in this preferred embodiment is not heated by wires, but by the hot pressurized air inside the cavity 833.

It is possible that a single station such as station 831 is used for both pre-consolidation as well as final consolidation of the intermediate assembly as described herein, for example by modifying the temperature of the hot air in the cavity 833 between the second step and the third step of a method according to the invention. Alternatively, pre-consolidation may be performed at a first station, similar to station 831, and final consolidation may be performed at a second station which is also similar to station 831, but which may comprise a thinner bladder and/or contact layer, and/or higher air temperature inside the cavity 833.

In general, in the context of the present invention, it is possible that thin components are placed on the opposite side of the base layer, i.e., on the side facing away from the side to which pressure is applied ("under" the base layer). Such thin components are also pre-consolidated and/or consolidated as described herein as heat and pressure may be transmitted through the base layer. In this case, the temperature of the bladder(s) may be increased and/or the thickness of the silicone layer(s) may be decreased.

Such thin components are chosen with an outer layer (facing away from the base layer, i.e., towards the bottom) which is not a hot melt, for example a textile, in order to not stick to the carrier (supporting structure) when the pre-consolidation and/or consolidation process is performed.

Still according to the invention, pre-consolidation and/or consolidation may also in some embodiments include application of heat from the opposite side of the intermediate assembly. That may be beneficial in case of thin components placed on the opposite side of the assembly as mentioned above, or also in case of high number of thin components superimposed on each other. A simultaneous heating on both sides of the assembly may be obtained by using a heated carrier, for example a carrier which would comprise means to conduct heat such as for example hot-air conducts and/or to produce heat such as heating wires embedded.

The present invention may also be used to impart a texture to the thin components. Different surface structures of the contact layer results in different textures on the thin components after the pre-consolidation and/or consolidation process. For example, a mat finishing or small stripes may be imparted to the thin components. Also, the contact layer may comprise one first area with a first texture and another area without texture or with another texture in order to apply different textures to different thin components or different areas of the final product. According to the invention, the texture may be quickly modified on the manufacturing line by replacing the contact layers.

Furthermore, a method and/or apparatus according to the invention may be adapted to apply a first temperature to a first portion of the intermediate assembly and a second temperature to a second portion of the intermediate assembly, for example by using two or more bladders in parallel, and/or by heating a hot-bladder at different temperatures in different areas by adapting the power applied to each wire in the hot-bladder, etc. Thereby the temperature may be locally adapted depending on the nature of the components and/or the number of components overlaid on top of each other.

In the following, further examples are provided for illustrating additional aspects of the invention:

1. A sporting good customized by a user, comprising zones having properties defined by input from a user.
2. A method of manufacturing a customized shoe comprising:
   providing a shoe design in a file;
   providing the shoe design file to a computer capable of converting the shoe design file to a production plan;
   providing elements for the construction of the shoe;
   utilizing the production plan to instruct one or more devices; and
   controlling at least one of the one or more devices to produce the shoe according to the production plan.

The shoe design file may be provided by a designer (internal or external) provided that the formatting is correct. For example, external designers might be provided with structure and/or syntax needed for the design file. Potentially customers could design a shoe from the ground up. A user/designer might use predefined software to generate a design file based on limitations in the software. Also conceivable is using body scan data to generate the shoe design.

3. The method of example 2, further comprising providing user defined specifications for the shoe to the computer to aid in the creation of the production plan.
4. The method of example 3, wherein the user defined specifications were generated in part using body scan data of a user.
5. The method of any of the preceding examples, wherein the one or more devices comprise at least one of a vision system, a cutting device, a robot, and an activation device.
6. A method of producing a customized sporting good, comprising:
   providing one or more design files describing the sporting good;
   providing a user defined specification based on the one or more design files;
   utilizing the user defined specification to modify the one or more design files to form a geometry file; and positioning the selected materials based on the geometry file to form the sporting good.

7. The method of example 6, wherein the sporting good comprises at least one of a ball, bat, or stick.

8. A customized sporting good, comprising:

a carrier surface (such as a last or a flat surface, wherein patches will be placed and then removed to form the shoe upper, for example); and one or more components positioned on the carrier surface.

9. The customized sporting good of example 8, wherein at least one of the one or more components is positioned along a line of force of the finished sporting good.

10. The customized sporting good of any of the preceding examples, wherein the one or more components comprise a patch positioned at a transition point between two zones on the finished sporting good and wherein the patch has an engraved pattern or is constructed from a material which allows for a gradient transition between the two zones.

11. The customized sporting good of any of the preceding examples, wherein the one or more components comprise multiple patches such that an expansion zone is created.

12. The customized sporting good of any of the preceding examples, wherein the one or more components comprise multiple patches such that a support zone is created.

13. The customized sporting good of any of the preceding examples, wherein the one or more components comprise multiple patches such that an expansion zone is created.

14. The customized sporting good of any of the preceding examples, wherein the one or more components comprise at least two components and the at least two components are positioned such that an accuracy of the at least two positioned parts is less than about 1 mm, more preferably even less than or equal to about 0.1 mm.

15. The customized sporting good of any of the preceding examples, wherein the carrier surface comprises a feature and the one or more components are positioned on the carrier surface with respect to the feature such that an accuracy of the one or more components relative to the feature is less than about 1 mm, more preferably even less than or equal to about 0.1 mm.

16. A method for transporting flexible materials, comprising:

providing at least one gripping device configured to engage a flexible material; and providing an adapter plate capable of coupling the gripping device to at least one of a second gripping device, a heating element, or an electrostatic loading device.

17. The method of example 16, wherein the gripping device comprises a coanda gripper or another gripper disclosed herein.

18. The method of any of the above examples, wherein a flexible component is coupled to the gripping device and configured to adapt to a surface on which the flexible material is placed.

19. The method of any of the above examples, wherein the at least one gripping device comprises multiple gripping devices coupled together using the adapter plate.

20. A method of producing customized sporting goods from flexible parts:

receiving a design specification of the sporting good to be manufactured, in particular a file;

providing components specified it the design specification;

automatically generating a production plan based on the design specification; and providing a reference pattern to a system;

comparing the provided components to the reference pattern;

automatically updating the production plan based on the design specification and the comparison of the reference pattern to the provided components; and performing the step of placing the plurality of components in accordance with the updated production plan.

21. Method for the manufacture of sporting goods, in particular shoes, comprising the following steps:

a. providing a plurality of components in one of a plurality of predefined shapes; and b. placing the plurality of components onto a two-dimensional or three-dimensional carrier surface to create the sporting good or a part thereof.

22. The method of example 21, wherein the plurality of components comprises at least one of a patch;

a structural element, such as a heel counter, cage, support structure, tube or band;

an outsole component, such as a stud, lug, outsole or outsole element;

an eyelet reinforcement element;

a midsole element;

a closure mechanism, such as laces, a lacing structure or a hook and loop closure system;

an electrical component, such as a Near Field Communication, NFC, chip, a Radio Frequency Identification, RFID, chip, a motor, a chip set, an antenna, a microchip, an interface, a light source, a wire, a circuit, an energy harvesting element and/or a battery;

a sensor, such as an accelerometer, a magnetometer or a positioning sensor, such as a Global Positioning System, GPS, sensor;

a mechanical component;

or any combination thereof.

23. The method of example 21 or 22, wherein the step of providing the plurality of components comprises using a configurable cutting device to cut a plurality of patches.

24. The method of example 23, wherein the configurable cutting device comprises at least one of a laser source, a knife, a cutting die, a water jet, a heat element, a solvent, or any combination thereof.

25. The method of example 23 or 24, wherein the configurable cutting device comprises a laser source and means for controlling movement of a laser beam emitted by the laser source, wherein the means preferably comprises at least one mirror.

26. The method of any of the preceding examples, comprising the further step of consolidating the plurality of components using heat and/or pressure for a predefined amount of time.

27. The method of example 26, wherein the step of consolidating comprises at least temporarily applying a flexible membrane, preferably made of silicone, onto the plurality of components.

28. The method of example 27, wherein the flexible membrane, before being applied onto the plurality components, is substantially planar or is pre-formed to essentially match the contour of the sporting good to be manufactured.

29. The method of any of the preceding examples 27 or 28, further comprising the step of applying pressure to the plurality of components with the flexible membrane applied thereon.

30. The method of any of the preceding examples, wherein the step of providing the plurality of components comprises:

providing material from a spool, a belt, a tray, and/or a stack onto a transportation device;

cutting the plurality of components out of the material using a cutting device; and removing excess material from the transportation device in an automated way, preferably by using a second spool.

31. The method of any of the preceding examples, wherein at least one of the plurality of components and/or the carrier surface comprises a coupling mechanism such that an electrostatic force, a chemical and/or a mechanical lock is formed between at least two of the plurality of components or a portion of the sporting good.

32. The method of example 31, wherein the coupling mechanism comprises at least one of electrostatic forces, a hot melt adhesive, a solvent based process, a hook loop fastener, or any combination thereof 33. The method of any of the preceding examples, further comprising the step of activating at least one of the components, preferably by heating.

34. The method of the preceding example, wherein the step of activating comprises activating an adhesive component of at least one of the plurality of components, preferably by heating.

35. The method of any of the preceding examples, wherein the step of placing the plurality of components is performed by an automated gripping device comprising one or more grippers.

36. The method of any of the preceding examples, wherein the two-dimensional carrier surface comprises a work top or a substantially flat base material, such as a knit material or a midsole; and/or wherein the three-dimensional carrier surface comprises a work form, such as a last, or a base material carried on a work form.

37. The method of any of the preceding examples, wherein the plurality of components comprises at least one patch comprising material selected from the following group: metal, polymer, such as polyurethane, for example thermoplastic polyurethane, nylon, foam, such as expanded foam, particle foam, textile material, for example a knit, non-woven, woven, or the like, hook and loop material, synthetic leather, coated material, transparent material, colored material, printed material, structured material, natural fiber, for example silk, wool, hair such as camel hair, cashmere, mohair, or the like, cotton, flax, jute, kenaf, ramie, rattan, hemp, bamboo, sisal, coir, or the like, leather, suede, rubber, a woven structure, or any combination thereof.

38. The method of any of the preceding examples, wherein the plurality of components comprises a plurality of patches arranged in a manner to provide a characteristic such as reinforcement, breathability, visibility, color, durability, grip, flexibility, thermoplasticity, adhesiveness, water resistance, waterproofing, weight distribution, or any combination thereof.

39. The method of any of the preceding examples, further comprising the steps of:

receiving a design specification of the sporting good to be manufactured, in particular a computer-aided design, CAD, file;

automatically generating a production plan based on the design specification; and performing the step of placing the plurality of components in accordance with the production plan.

40. The method of any of the preceding examples, further comprising identifying at least one of the plurality of components by an image processing means before performing the step of placing the plurality of components.

41. The method of any of the preceding examples, further comprising identifying the carrier surface by an image processing means and providing positioning data to a controller to adjust placing of at least one of the plurality of components.

42. The method of examples 39-41, wherein automatically generating a production plan based on the design specification further comprises generating a point cloud to position at least one of the plurality of components on the carrier surface.

43. The method of any of the preceding examples, wherein the method is performed inside a movable container, wherein the movable container is preferably at least partially transparent.

44. Sporting good, in particular shoe, or part thereof, which has been manufactured by use of a method according to any one of the above examples.

45. Method of manufacturing sporting goods comprising:

a. selecting a base layer;

b. selecting a thin component comprising an at least partially meltable layer;

c. applying at least a part of the thin component on at least part of the base layer so as to form an intermediate assembly, such that the meltable layer is at least partially in contact with the base layer;

d. a first consolidation step during which pressure is applied to the intermediate assembly at a first temperature; and e. a second consolidation step during which pressure is applied to the intermediate assembly at a second temperature which is higher than the first temperature, wherein the second consolidation step is performed after the first consolidation step.

46. Method according to example 45, wherein the thickness of the thin component is smaller than its length and than its width.

47. Method according to one of the preceding examples, wherein in the first consolidation step the surface area of pressure application to the intermediate assembly is progressively increased over time.

48. Method according to one of the preceding examples, wherein in the first consolidation step pressure is applied first to a first portion of the intermediate assembly and then to a second portion of the intermediate assembly.

49. Method according to one of the preceding examples, wherein the first temperature differs from room temperature by no more than 20° C.

50. Method according to one of the preceding examples, wherein the pressure applied to the intermediate assembly is maintained between the first consolidation step and the second consolidation step.

51. Method according to one of the preceding examples, wherein the first consolidation step and the second consolidation step are performed on the same device.

52. Method according to one of the preceding examples, wherein pressure is applied by an inflatable bladder.

53. Method according to one of the preceding examples, wherein at least one contact layer is applied to the intermediate assembly during the first consolidation step.

54. Method according to one of the preceding examples, wherein at least one contact layer is applied to the intermediate assembly during the second consolidation step.

55. Method according to one of examples 53 or 54, wherein the contact layer is at the first temperature when first placed in contact with the intermediate assembly during the first consolidation step, and is heated up afterwards to the second temperature during the second consolidation step.

56. Method according to example 52 and one of examples 53 to 55, wherein the contact layer is placed between the intermediate assembly and the inflatable bladder, and wherein pressure is applied by the inflatable bladder to the contact layer.

57. Method according to one of examples 52 or 56, wherein the inflatable bladder is configured to be heated up.

58. Method according to one of the preceding examples further comprising:

a third consolidation step during which pressure and heat at a third temperature, higher than the second temperature, are applied to the intermediate assembly, wherein the third consolidation step is performed after the second consolidation step.

59. Method according to example 58, wherein:

at least one contact layer is applied to the intermediate assembly during the third consolidation step, and the pressure, third temperature and duration of the third consolidation step are adapted so that a surface texturing of the thin component is modified by application of the contact layer.

60. Method according to one of the preceding examples, wherein the thin component comprises a polymeric component.

61. Method according to one of the preceding examples, wherein the thin component is temporarily fixed to the base layer before the first consolidation step.

62. Method according to one of the preceding examples, wherein the thin component has such a shape that at least a portion of the surface of the base layer is not covered by the thin component.

63. Method according to one of the preceding examples, wherein the intermediate assembly comprises at least two thin components, each component comprising at least an overlap portion with each other.

64. Method according to one of the preceding examples, wherein an intermediate component is at least partially placed between the thin component and the base layer.

65. Method according to the preceding example, further comprising a step of removing the intermediate component.

66. Method according to one of the preceding examples, wherein the intermediate assembly comprises:

a. at least a first thin component at least partially in contact with a first face of the base layer, and b. at least a second thin component at least partially in contact with a second face of the base layer.

67. Method according to one of the preceding examples, wherein the base layer is a textile.

68. Method according to the preceding example, wherein the base layer is a knit textile.

69. Sporting good manufactured according to a method of one of the preceding examples.

70. Apparatus for manufacturing sporting goods, comprising:

a. a supporting surface on which a component may be placed;

b. a contact layer;

c. a bladder adapted to be at least partially displaced toward the supporting surface and to be heated at a higher temperature than a temperature of the supporting surface, wherein d. the contact layer is movable in a first position in which the contact layer is arranged between the supporting surface and the bladder so that the bladder may transmit heat to the contact layer, and may bring the contact layer in contact with the component on the supporting surface; and e. a cooling device adapted to cool down the contact layer.

71. Apparatus according to the preceding example, wherein the cooling device is adapted to place the contact layer in an area where it may cool down.

72. Apparatus according to one of examples 70 to 71, wherein the contact layer is mounted on a belt so as to be displaced to a cooling position.

73. Apparatus according to one of examples 70 to 72, wherein the bladder comprises a heating device.

74. Apparatus according to one of examples 70 to 73, wherein the bladder is attached to a fixed body and is adapted to be inflated to be brought into contact with the contact layer.

75. Apparatus according to one of examples 70 to 74, wherein the bladder is attached to a movable body that can be displaced between a first position and at least one second position, wherein in the first position the bladder is closer to the supporting surface than in the second position.

76. Apparatus according to one of examples 70 to 75, wherein the contact layer is textured on at least a part of its surface which is adapted to contact the component.

77. Apparatus for manufacturing sporting goods, comprising:

a. a first station comprising at least a first contact layer and at least a first bladder;

b. a second station comprising at least a second contact layer and at least a second bladder;

c. a supporting surface movable from said first station to said second station.

78. Apparatus according to the preceding example, wherein the first station and/or the second station is/are an apparatus according to one of examples 70 to 76.

79. Apparatus according to one of examples 70 to 78, wherein the supporting surface is generally flat.

80. Apparatus according to one of examples 70 to 79, wherein the supporting surface comprises at least one convex surface and/or at least one concave surface.

81. Apparatus according to one of examples 70 to 80, wherein the supporting surface may be at least partially textured.

What is claimed is:

1. A method for the manufacture of shoes, the method comprising:

providing a plurality of components in one of a plurality of predefined shapes;

placing the plurality of components onto a two-dimensional or three-dimensional carrier surface, such that at least two of the plurality of components partially overlap each other on the carrier surface, to create the shoe or a part thereof; and applying a flexible membrane onto the plurality of components during a first consolidation step and a second consolidation step, wherein during the first consolidation step, pressure is applied by the flexible membrane to the plurality of components at a first temperature, wherein a surface area of pressure application to the plurality of components increases over time, wherein during the second consolidation step, pressure is applied by the flexible membrane to the plurality of components at a second temperature higher than the first temperature, and wherein the carrier surface comprises a base material of an upper.

2. The method of claim 1, wherein the plurality of components comprises at least one of a patch, a structural element, an outsole component, an eyelet reinforcement element, a midsole element, a closure mechanism, an electrical component, a sensor, a mechanical component, or any combination thereof.

3. The method of claim 1, wherein providing the plurality of components comprises using a configurable cutting device to cut a plurality of patches, and wherein the configurable cutting device comprises a laser source and means for controlling movement of a laser beam emitted by the laser source, wherein the means comprises at least one mirror.

4. The method of claim 1, wherein the flexible membrane, before being applied onto the plurality of components, is substantially planar or is pre-formed to essentially match the contour of the shoe to be manufactured.

5. The method of claim 1, wherein providing the plurality of components comprises:

providing material from a spool, a belt, a tray, or a stack onto a transportation device;

cutting the plurality of components out of the material using a cutting device; and removing excess material from the transportation device in an automated way by using a second spool.

6. The method of claim 1, wherein at least one of the plurality of components or the carrier surface comprises a coupling mechanism such that an electrostatic force, a chemical lock, or a mechanical lock is formed between at least two of the plurality of components or a portion of the shoe.

7. The method of claim 1, further comprising activating at least one of the components by heating.

8. The method of claim 1, wherein placing the plurality of components is performed by an automated gripping device comprising one or more grippers.

9. The method of claim 1, wherein the two-dimensional carrier surface comprises a substantially flat base material, or wherein the three-dimensional carrier surface comprises a base material carried on a work form.

10. The method of claim 1, wherein the plurality of components comprises at least one patch comprising material selected from the following group: metal, polymer, nylon, foam, particle foam, textile material, non-woven, woven, hook and loop material, synthetic leather, coated material, transparent material, colored material, printed material, structured material, natural fiber, wool, hair, cashmere, mohair, cotton, flax, jute, kenaf, ramie, rattan, hemp, bamboo, sisal, coir, leather, suede, rubber, a woven structure, or any combination thereof, and wherein the plurality of components comprises a plurality of patches arranged in a manner to provide a characteristic selected from the following group: reinforcement, breathability, visibility, color, durability, grip, flexibility, thermoplasticity, adhesiveness, water resistance, waterproofing, weight distribution, or any combination thereof.

11. The method of claim 1, further comprising:

receiving a design specification of the shoe to be manufactured;

automatically generating a production plan based on the design specification; and placing the plurality of components in accordance with the production plan.

12. The method of claim 1, further comprising identifying at least one of the plurality of components by an image processing means before placing the plurality of components; and identifying the carrier surface by an image processing means and providing positioning data to a controller to adjust placing of at least one of the plurality of components.

13. The method of claim 11, wherein automatically generating a production plan is based on the design specification and further comprises generating a point cloud to position at least one of the plurality of components on the carrier surface.

14. The method of claim 1, wherein the method is performed inside a movable container, wherein the movable container is at least partially transparent.

15. A shoe which has been manufactured by use of the method according to claim 1.

* * * * *